US006098322A

United States Patent [19]

Tozawa et al.

[11] Patent Number: 6,098,322

[45] Date of Patent: Aug. 8, 2000

[54] CONTROL DEVICE OF CONSTRUCTION MACHINE

[75] Inventors: Shoji Tozawa; Tomoaki Ono, both of Tokyo, Japan

[73] Assignee: Shin Caterpillar Mitsubishi Ltd., Japan

[21] Appl. No.: 09/101,845

[22] PCT Filed: Dec. 10, 1997

[86] PCT No.: PCT/JP97/04550

§ 371 Date: Jul. 20, 1998

§ 102(e) Date: Jul. 20, 1998

[87] PCT Pub. No.: WO98/26132

PCT Pub. Date: Jun. 18, 1998

[30] Foreign Application Priority Data

| | | | |
|---|---|---|---|
| Dec. 12, 1996 | [JP] | Japan | 8-332571 |
| Dec. 20, 1996 | [JP] | Japan | 8-342231 |
| Dec. 20, 1996 | [JP] | Japan | 8-342232 |
| Mar. 10, 1997 | [JP] | Japan | 9-055343 |
| Mar. 11, 1997 | [JP] | Japan | 9-055955 |
| Mar. 11, 1997 | [JP] | Japan | 9-055956 |
| Mar. 18, 1997 | [JP] | Japan | 9-065112 |
| Mar. 18, 1997 | [JP] | Japan | 9-065113 |

[51] Int. Cl.[7] ..... E02F 3/43; E02F 9/22

[52] U.S. Cl. ..... 37/414; 37/443; 701/50

[58] Field of Search ..... 37/443, 414; 701/50; 172/2

[56] References Cited

FOREIGN PATENT DOCUMENTS

| | | |
|---|---|---|
| 55-52437 | 4/1980 | Japan . |
| 56-85037 | 7/1981 | Japan . |
| 57-92226 | 6/1982 | Japan . |
| 60-33940 | 2/1985 | Japan . |
| 61-270421 | 11/1986 | Japan . |
| 62-72826 | 4/1987 | Japan . |
| 5-196004 | 8/1993 | Japan . |
| 6-26079 | 2/1994 | Japan . |
| 63-36747 | 6/1994 | Japan . |
| 7-42199 | 2/1995 | Japan . |
| WO98/26132 | 6/1998 | WIPO . |

*Primary Examiner*—Christopher J. Novosad
*Attorney, Agent, or Firm*—Morrison & Foerster LLP.

[57] ABSTRACT

A control apparatus of a construction machine, such as hydraulic excavator, includes arms supported on the construction machine body side, a working member supported by the arms and hydraulic cylinder actuators for operating the arms and the working member, for realizing a smooth variation of an instruction value to the hydraulic cylinder actuators even if the working member is operated suddenly upon starting an operation. In the control apparatus, the arm and working members are operated by driving a control member, a target moving velocity of the working member is set so that the characteristics of the arms and working member upon starting an operation and upon ending an operation as time differentiated are regarded as those before time differentiated, and the actuators are controlled based on the target moving velocity information so that the working member is operated at the target moving velocity.

71 Claims, 35 Drawing Sheets

EXAMPLE OF SETTING OF MOVING SPEED OF BUCKET TIP (STICK DRAWING)

EXAMPLE OF CONTROL PARAMETER VARIATION

REPRESENTATIVE OIL TEMPERATURE =
TANK OIL TEMPERATURE x W +
PILOT OIL TEMPERATURE x (1 - W)

EXAMPLE OF GAIN SCHEDULE

EXAMPLE OF GAIN SCHEDULE

ACTUAL MEASUREMENT DATA IN THE PAST

EXAMPLE OF TARGET VALUE CORRECTION

CONTROL DEVICE OF CONSTRUCTION MACHINE

TECHNICAL FIELD

This invention relates to a construction machine such as a hydraulic excavator for excavating the ground, and more particularly to a control apparatus for a construction machine of the type mentioned.

BACKGROUND ART

Generally, a construction machine such as a hydraulic excavator has a construction wherein it includes, for example, as shown in FIG. 14, an upper revolving unit 100 with an operator cab (cabin) 600 provided on a lower traveling body 500 having caterpillar members 500A, and further, a joint type arm mechanism composed of a boom 200, a stick 300 and a bucket 400 is provided on the upper revolving unit 100.

And, based on extension/contraction displacement information of the boom 200, stick 300 and bucket 400 obtained by stroke sensors 210, 220, 230 and so forth, the boom 200, stick 300 and bucket 400 can be driven suitably by hydraulic cylinders 120, 121 and 122, respectively, to perform an excavating operation while keeping the advancing direction of the bucket 400 or the posture of the bucket 400 fixed so that control of the position and the posture of a working member such as the bucket 400 can be performed accurately and stably.

It is to be noted that the hydraulic cylinders 120 to 122 are operated by operation levers (not shown) normally provided in the operator cab 600.

By the way, a semiautomatic control system for such a construction machine as described above has been proposed wherein the boom 200, stick 300, bucket 400 and so forth are set so that they may perform a sequence of operations set in advance and the hydraulic cylinders 120, 121 and 122 are controlled individually so that their operations set in this manner may be performed.

Here, as the semiautomatic control mode described above, a bucket angle control mode in which the angle (bucket angle) of the bucket 400 with respect to a horizontal direction (vertical direction) is always kept fixed even if the stick 300 and the boom 200 are moved, a slope face excavation mode (bucket tip linear excavation mode or raking mode) in which a tip 112 of the bucket 400 moves linearly, and so forth are available.

By the way, in such semiconductor control modes as described above, the operation levers for controlling the operations of the hydraulic cylinders 120 to 122 function as members for setting target moving velocities for the stick 300 and the boom 200.

In particular, in a semiautomatic control mode, the moving speeds of the stick 300 and the boom 200 are determined in response to operation amounts of the operation levers.

However, a semiautomatic system applied to a conventional construction machine has such various subjects as given below.

(1) If an operator operates an operation lever suddenly upon starting of working in a semiautomatic control mode, then control instruction values to the hydraulic cylinders 120 to 122 of the boom 200, stick 300 and bucket 400 vary instantly, and it is considered that the load may be applied suddenly to the hydraulic cylinders 120, 121 and 122. In this instance, there is the possibility that the hydraulic cylinder 120, 121 or 122 may not operate smoothly but operate while accompanying a light impact, vibrations, a shock or the like, and further, there is the possibility that the accuracy of the locus of the bucket tip position may be deteriorated.

In order to eliminate such a situation as described above, it is a possible idea to increase the moving velocity of the bucket tip gradually (ramp up process) or give a smooth velocity variation through a low-pass filter even if an operation lever is operated suddenly. However, in a semiautomatic control mode, since control signals to the hydraulic cylinders are fed-back information obtained by time differentiating the cylinder positions, even if such a ramp up process as mentioned above or the like is performed, the instruction values to the hydraulic cylinders vary discontinuously depending upon the time differentiation information of the cylinder positions. Consequently, there still is a subject that the boom, stick or bucket does not operate smoothly.

(2) In semiautomatic control, where an operation (horizontal leveling operation or the like) wherein the bucket tip position is moved linearly is to be performed in a slope face excavation mode, it is supposed that the loads to the hydraulic cylinders 120 to 122 during an excavation operation may be varied by the shape of the ground, the excavation amount or the like, and in such a case, where conventional PID control is employed, there is the possibility that the degrees of positioning accuracy of the hydraulic cylinders 120 to 122 or the degree of accuracy of the locus of the bucket tip position may be deteriorated.

Further, where feedback control is performed for the hydraulic cylinders 120 to 122, it is supposed that variations of the dynamic characteristics of control objects (for example, the hydraulic cylinders 120 to 122 or solenoid valves provided in hydraulic circuits) arising from a temperature variation of operating oil have an influence on the control performances of closed loops, resulting in deterioration of the stability of the control system.

In order to eliminate such a situation as described above, the control gains of the closed loops should be reduced to increase the gain margins or the phase margins. However, there is a subject that this results in deterioration of the degrees of positioning accuracy of the hydraulic cylinders 120 to 122 or of the degree of accuracy of the locus of the bucket tip position.

(3) Where, in a semiautomatic control mode, the boom 200, stick 300 and bucket 400 are locus controlled (tracking controlled) by feedback control, since the instruction values to the cylinders 120 to 122 are calculated based on deviations of the feedback (that is, control errors between input information and output information), it is difficult to reduce the deviations during operation of the cylinders to zero, and as a result, the bucket tip position sometimes exhibits an error from a target value.

In short, in such feedback control, since actual cylinder positions or cylinder velocities are detected and compared with target cylinder positions or target cylinder velocities and control is performed so that the deviations between them may approach zero, it is difficult to eliminate the deviations completely during control, and there is a subject that a control error is caused thereby.

(4) Where such an operation as to, for example, level the ground (slope face formation) is to be performed, an operation of linearly moving the tip of the bucket 400 (that is, the stick 300) is required. However, according to the prior art, since the boom 200 and the stick 300 are controlled independently of each other by the hydraulic cylinders 120 and 121, respectively, it is very difficult to finish a slope face with a high degree of accuracy.

In particular, where the boom 200 and the stick 300 are electrically feedback controlled using solenoid valves or the like as described above, if the corresponding hydraulic cylinders 120 and 121 are controlled independently of each other, respectively, then even if the respective feedback control deviations are small, the control deviations cannot be ignored depending upon the positions (postures) of the boom 200 and the stick 300, and an error from a target tip position (control target value) of the bucket 400 sometimes becomes very large.

For example, if control of the boom 200 is delayed with respect to the stick 300 due to the control deviations described above when the bucket 400 is at a position at which a slope face is to be formed subsequently, then the tip of the bucket 400 will bite into the ground, but if control of the stick 300 is delayed with respect to the boom 200, then the bucket 400 will operate while it remains floating in the air.

In this manner, there is a subject that, if the boom 200 and the stick 300 are individually controlled fully independently of each other, then it is very difficult to operate the boom 200 and the stick 300 while maintaining control target values.

(5) Where an operation of moving the tip of the bucket 400 linearly (called bucket tip linear excavation mode) such as horizontal leveling of the ground (slope face formation) is required, with the conventional control apparatus for a hydraulic excavator, the operation is realized by feedback controlling the boom 200 (hydraulic cylinder 120) and the stick 300 (hydraulic cylinder 121) electrically independently of each other. However, since the hydraulic cylinders 120 and 121 are feedback controlled independently of each other based on control target values obtained from a target bucket tip position, for example, when it is tried to pull the stick 300 from a condition wherein the bucket 400 is positioned far from the construction machine body 100 toward the construction machine body 100 side to linearly move the tip of the bucket 400, if the position deviation of the boom 200 is small (the delay is little) and the position deviation of the stick 300 is large (the delay is much), then the actual tip position of the bucket 400 is displaced upwardly from the target position (target slope face). As a result, there is a subject that the finish accuracy of the slope face is deteriorated very much.

(6) Where an operation (raking) of linearly moving the tip of the bucket 400 as in, for example, a horizontal leveling operation is performed automatically by a controller, solenoid valves (control valve mechanisms) in the hydraulic circuits for supplying and discharging operating oil to and from the hydraulic cylinders 120, 121 and 122 are electrically PID feedback controlled to control extension/contraction operations of the hydraulic cylinders 120, 121 and 122 to control the postures of the boom 200, stick 300 and bucket 400. However, in the hydraulic circuits which control the extension/contraction operations of the hydraulic cylinders 120, 121 and 122, operating oil pressures are produced by pumps which are driven by an engine (prime mover), and if the rotational speed of the engine is varied by an external load or the like then, then also the rotational speeds of the pumps are varied by the variation, resulting in variation of the discharges (delivery capacities) of the pumps. Consequently, even if the instruction values (electric currents) to the solenoid valves are equal, the extension/contraction velocities of the hydraulic cylinders 120, 121 and 122 are varied. As a result, the posture control accuracy of the bucket 400 is deteriorated, and the finish accuracy of a horizontally leveled face or the like by the bucket 400 is deteriorated.

Thus, it is a possible idea to use, in order to cope with such a rotational speed variation of the engine as described above, a pump of the variable discharge type (variable delivery pressure type, variable capacity type) for the pumps and adjust the tilt angles of the pumps to control the pumps so that the delivery capacities of the pumps may be fixed even if the rotational speed of the engine (that is, the rotational speeds of the pumps) varies. However, since such tilt angle control is slow in response, there is a subject that target cylinder extension/contraction velocities cannot be secured and deterioration of the finish accuracy cannot be avoided.

(7) With the prior art wherein a circuit of the open center type is used for the hydraulic circuits, for example, where the excavation load is extremely heavy, as the load increases, the oil pressures of the boom 200 (hydraulic cylinder 120) and the stick 300 (hydraulic cylinder 121) rise and the extension/contraction displacement velocities of the hydraulic cylinders 120 and 121 drop, and finally, the operations of the boom 200 and the stick 300 (that is, the operation of the bucket tip) sometimes stop.

In this instance, with the PID feedback control system, since the velocity information (P) of the bucket tip becomes equal to zero and the position information (D) is fixed to a value equal to that upon stopping of the stick, they have no influence on target velocities for the extension/contraction displacement velocities of the hydraulic cylinders 120 and 121 which are based on the information (proportional operation factors), but since I (an integration factor) is involved in the control system, the target velocities of the hydraulic cylinders 120 and 121 resultantly continue to increase.

Accordingly, if, for example, a rock under excavation which has been caught by the bucket tip breaks in this condition and the load is removed suddenly from the boom 200 and the stick 300, then the hydraulic cylinders 121 and 122 will suddenly begin to move at velocities much higher than their target velocities. As a result, there is a subject that the finish accuracy of an excavation operation is deteriorated significantly.

(8) Where such control that the angle (bucket angle) of the bucket 400 with respect to the horizontal direction (vertical direction) is always kept fixed even if the boom 200 and the stick 300 are moved such as where excavated sand and earth or the like are conveyed while they are accommodated in the bucket 400, with the PID feedback control system for the bucket 400 (hydraulic cylinder 122), if the deviation between the actual bucket angle and the target bucket angle becomes large during operation of the boom 200 and/or the stick 300, then the instruction value (control target value) to the hydraulic cylinder 122 is increased to decrease the deviation by an action of the I (integration factor) of the P (proportion factor), I (integration factor) and D (differentiation factor). However, when the operation levers (operation members) 6 and 8 for the boom 200, stick 300 and bucket 400 are moved to their neutral positions (inoperative positions) to stop the bucket 400, since the instruction value to the hydraulic cylinder 122 is not reduced to zero immediately due to an accumulation amount of the I (integration factor) till the stopping time. Consequently, there is a subject that, even if the operation levers 6 and 8 are moved to the inoperative positions, the bucket 400 does not stop immediately and an overshoot occurs, resulting in deterioration of the control accuracy.

The present invention has been made in view of such various subjects as described above, and it is an object of the present invention to provide a control apparatus for a construction machine having a semiautomatic control mode which achieves further augmentation of functions.

DISCLOSURE OF THE INVENTION

To this end, according to the present invention, a control apparatus for a construction machine wherein arm members are supported for rocking movement on a construction machine body side and a working member is supported for rocking movement at an end portion of the arm members and the rocking movements of the arm members and the working member are performed individually by extension/contraction operations of cylinder type actuators is characterized in that it comprises operation levers for operating the arm members and the working member, target moving velocity setting means for setting a target moving velocity of the working member so that a target moving velocity characteristic upon starting of operation by the operation levers may exhibit a characteristic of the same type even if the target moving velocity characteristic is time differentiated, and control means for receiving information of the target moving velocity set by the target moving velocity setting means as an input and controlling the actuators so that the working member may exhibit the target moving velocity.

With such a construction as described above, there is an advantage that, even if an operator operates the operation levers suddenly upon starting of operation, the arm members and the working member can be operated smoothly.

Preferably, the target moving velocity characteristic upon starting of the operation is set to a cosine wave characteristic. By this, when information obtained by time differentiation of the positions of the actuators is fed back to the control means to set control signals, the fed back time differentiation information and the target moving velocity characteristic upon starting of the operation have characteristics of the same type and the cosine wave characteristic has a continuous curve, and consequently, the control signals to be outputted are suppressed from varying instantly suddenly. Accordingly, there is an advantage that, upon starting of operation, operations of the cylinder type actuators can be performed smoothly. Further, by setting the target moving velocity characteristic to the cosine wave characteristic, there is another advantage that control superior in operation responsibility upon starting of operation can be realized.

Where the target moving velocity characteristic upon ending of the operation by the working member is set so that it may exhibit a characteristic of the same type even if the target moving velocity characteristic is time differentiated, also when the operator operates the operation levers suddenly not only upon starting of operation but also upon ending of the operation, the arm members and the working member can be operated smoothly.

Where the target moving velocity characteristic upon ending of the operation is set to a cosine wave characteristic, control which is superior in operation responsibility also upon ending of the operation can be realized.

Preferably, the target moving velocity setting means includes a target moving velocity outputting section for outputting first target moving velocity data corresponding to positions of the operation levers, a storage section in which second target moving velocity data with which the target moving velocity characteristics upon starting of the operation and upon ending of the operation exhibit characteristics of the same types even if the target moving velocity characteristics are time differentiated are stored, and a comparison section for comparing the data of the storage section and the data of the target moving velocity outputting section and outputting a lower one of the data as target moving velocity information.

Where the control apparatus for a construction machine is constructed in such a manner as just described, there is an advantage that, when a skilled operator operates the operation levers in a condition more appropriate than by control of the cylinder type actuators by the storage section, the operation by the operator is given priority to control the operation of the cylinder type actuators.

Further, according to the present invention, a control apparatus for a construction machine wherein arm members are supported for rocking movement on a construction machine body side and a working member is supported for rocking movement at an end portion of the arm members and the rocking movements of the arm members and the working member are performed individually by extension/contraction operations of cylinder type actuators is characterized in that it comprises target value setting means for setting target operation information of the arm member with the working member in response to a position of an operation member, detection means having at least operation information detection means for detecting operation information of the arm member with the working member and operation condition detection means for detecting an operation condition of the construction machine, and control means of a variable control parameter type for receiving a detection result from the operation information detection means and the target operation information set by the target value setting means as inputs and controlling the actuators so that the arm member with the working member may exhibit a target operation condition, and a control parameter scheduler capable of varying the control parameter in response to the operation condition of the construction machine detected by the operation condition detection means is provided in the control means.

Where such a construction as just described is employed, there is an advantage that the stability in control and the accuracy in position of the working member can be augmented.

The control means may include feedback loop type compensation means having a variable control parameter and feedforward type compensation means having a variable control parameter. Where such a construction as just described is employed, there is an advantage that control deviations can be reduced and velocity instruction values can be outputted irrespective of the magnitudes of position deviations from target velocities of the actuators.

Where the control parameter scheduler is constructed so as to allow the control parameter to be varied in response to positions of the actuators, the control parameter can be corrected in response to the operation posture of the construction machine, and there is an advantage that augmentation of the stability of controlling systems and augmentation of the accuracy of the position of the working member can be achieved.

Meanwhile, where the control parameter scheduler is constructed so as to allow the control parameter to be varied in response to loads to the actuators, correction of the control parameter can be performed in response to the operation load to the construction machine, and there is an advantage that, similarly as described above, augmentation of the stability of controlling systems and augmentation of the accuracy of the position of the working member can be achieved.

On the other hand, where the control parameter scheduler is constructed so as to allow the control parameter to be varied in response to a temperature relating to the actuators, the variation of the temperature relating to the actuators can be compensated for, and there still is an advantage that augmentation of the stability of controlling systems and augmentation of the accuracy of the position of the working member can be achieved.

Preferably, for the temperature relating to the actuators, a temperature of operating oil or a temperature of controlling oil of the actuators is used. In this instance, upon operation, a variation of the temperature of the operating oil or controlling oil which is comparatively likely to vary upon operation can be compensated for, and there still is an advantage that augmentation of the stability of controlling systems and augmentation of the accuracy of the position of the working member can be achieved.

Further, according to the present invention, a control apparatus for a construction machine wherein arm members are supported for rocking movement on a construction machine body side and a working member is supported for rocking movement at an end portion of the arm members and the rocking movement of the arm member with the working member is performed individually by extension/contraction operations of cylinder type actuators is characterized in that it comprises target value setting means for setting target operation information of the arm member with the working member in response to a position of an operation lever, operation information detection means for detecting operation information of the arm member with the working member, control means for receiving a detection result of the operation information detection means and the target operation information set by the target value setting means as inputs and controlling the actuators so that the arm member with the working member may exhibit a target operation condition, and correction information storage means for storing correction information for correcting the target operation information, and the control means is constructed so as to control the actuators using correction target operation information corrected with the correction information from the correction information storage means so that the arm member with the working member may exhibit the target operation condition.

Where such a construction as described above is employed, there is an advantage that a deviation between target operation information and an actual operation can be eliminated to the utmost and the degrees of control accuracy of the actuators can be augmented. In particular, by taking correction information obtained from the correction information storage means into consideration of target operation information set by the target value setting means, the degrees of accuracy of the position control and the velocity control of the actuators can be improved remarkably. Further, the present apparatus is advantageous also in that it requires little increase in cost or little increase in weight due to its simple construction that the correction information storage section is provided.

The correction information storage means may be constructed so as to cause the arm member with the working member to perform a predetermined operation to collect and store the correction information.

Where such a construction is employed, there is an advantage that deviations appearing between target operation information of the actuators set by the target value setting means and actual operation information of the actuators can be obtained by simulation. Further, since the target value setting means is corrected using the deviations, the deviations between the target operation information and the actual operation information can be eliminated to the utmost and the accuracy in operation control of the arm member with the working member can be further augmented.

Further, the correction information storage means may be constructed so as to store correction information which is different for different operation modes of the arm member with the working member, and the control means may be constructed so as to control the actuators using the correction target operation information corrected with the correction information obtained in response to an operation mode of the arm member with the working member so that the arm member with the working member may exhibit the target operation condition.

In this instance, there is an advantage that a deviation between target operation information and actual operation information can be updated for each of the operation modes and, in whichever operation mode control is performed, the deviation between the target operation information and the actual operation information can be eliminated to the utmost thereby to augment the control accuracy.

Further, according to the present invention, a control apparatus for a construction machine wherein, when at least one pair of arm members connected for pivotal motion to each other and composing a joint type arm mechanism provided on a construction machine body are driven by cylinder type actuators, the cylinder type actuators are feedback controlled based on detected posture information of the arm members so that the arm members may individually assume predetermined postures is characterized in that the pair of arm members are controlled in a mutually associated relationship with each other such that a control target value of a controlling system of each of the arm members may be controlled based on feedback deviation information of a controlling system of the other arm member than the self arm member.

In the control apparatus having such a construction as described above, when the pair of arm members mentioned above are controlled individually, since the arm members are controlled in a mutually associated relationship with each other such that the control target value of the controlling system of each of the arm members may be corrected based on the feedback deviation information of the controlling system of the other arm member than the self arm member, the arm members can be operated in an ideal condition in which no feedback deviation information is involved.

Further, according to the present invention, a control apparatus for a construction machine is characterized in that it comprises a construction machine body, a joint type arm mechanism having at least one pair of arm members having one end portion pivotally mounted on the construction machine body and having a working member on the other end side and connected to each other by a joint part, a cylinder type actuator mechanism having a plurality of cylinder type actuators for performing extension/contraction operations to actuate the arm mechanism, posture detection means for detecting posture information of the arm members, and control means for controlling the cylinder type actuators based on a detection result detected by the posture detection means so that the arm members may exhibit predetermined postures, the control means including a first controlling system for feedback controlling the first cylinder type actuator for one arm member of the pair of arm members, a second controlling system for feedback controlling the second cylinder type actuator for the other arm member of the pair of arm members, a first correction controlling system for correcting a control target value of the first controlling system based on feedback deviation information of the second controlling system, and a second correction controlling system for correcting a control target value of the second controlling system based on feedback deviation information of the first correction controlling system.

In the control apparatus of the present invention constructed in such a manner as described above, since, when the control means (first and second controlling systems) controls the (first and second) actuators based on the detection result detected by the posture detection means so that the arm members may assume predetermined postures, the first or second controlling system corrects the control target value of the self (first or second) controlling system based on the feedback deviation information of the second or first controlling system, correction of the control target values mutually taking the control conditions of the actuators into consideration is performed, and the arm members operate in an ideal condition in which no feedback deviation information is involved.

It is to be noted that preferably the posture detection means is constructed as extension/contraction displacement detection means for detecting extension/contraction displacement information of the cylinder type actuators. By this, in the present control apparatus, posture information of the arm members can be detected simply and conveniently by detecting extension/contraction displacement information of the cylinder type actuators.

Meanwhile, the control apparatus for a construction machine may be constructed such that the first correction controlling system includes a first correction value generation section for generating a first correction value for correcting the control target value of the first controlling system from the feedback deviation information of the second controlling system, and the second correction controlling system includes a second correction value generation section for generating a second correction value for correcting the control target value of the second controlling system from the feedback deviation information of the first controlling system.

Where the control apparatus for a construction machine is constructed in such a manner as just described, by the simple construction that the first correction value generation section is provided in the first correction controlling system and the second correction value generation section is provided in the second correction controlling system, the first correction value for correcting the control target value of the first controlling system and the second correction value for correcting the control target value of the second controlling system can be generated to effect correction of the control target values with certainty.

Further, the first correction controlling system may include a first weight coefficient addition section for adding a first weight coefficient to the first correction value. By this, in the first correction controlling system, the first correction value for correcting the control target value of the first controlling system can be varied when necessary, and correction of the control target value can be performed flexibly.

On the other hand, the second correction controlling system may include a second weight coefficient addition section for adding a second weight coefficient to the second correction value. By this, also in the second correction controlling system, the second correction value for correcting the control target value of the second controlling system can be varied when necessary, and correction of the control target value can be performed flexibly.

Further, according to the present invention, a control apparatus for a construction machine is characterized in that it comprises a construction machine body, a boom connected at one end thereof for pivotal motion to the construction machine body, a stick connected at one end thereof for pivotal motion to the boom by a joint part and having a bucket, which is capable of excavating the ground at a tip thereof and accommodating sand and earth therein, mounted for pivotal motion at the other end thereof, a boom hydraulic cylinder interposed between the construction machine body and the boom for pivoting the boom with respect to the construction machine body by expanding or contracting a distance between end portions thereof, a stick hydraulic cylinder interposed between the boom and the stick for pivoting the stick with respect to the boom by expanding or contracting a distance between end portions thereof, boom posture detection means for detecting posture information of the boom, stick posture detection means for detecting posture information of the stick, a boom controlling system for feedback controlling the boom hydraulic cylinder based on a detection result of the boom posture detection means, a stick controlling system for feedback controlling the stick hydraulic cylinder based on a detection result of the stick posture detection means, a boom correction controlling system for correcting a control target value of the boom controlling system based on feedback deviation information of the stick controlling system, and a stick correction controlling system for correcting a control target value of the stick controlling system based on feedback deviation information of the boom controlling system.

In the control apparatus for a construction machine of the present invention constructed in such a manner as described above, when the boom/stick controlling systems feedback control the boom/stick hydraulic cylinders based on detection results detected by the corresponding boom/stick posture detection means, since the boom/stick correction controlling systems correct the control target values of the self controlling systems based on feedback deviation information of the stick/boom controlling systems, respectively, correction of the control target values mutually taking the control conditions of the hydraulic cylinders into consideration is normally performed, and the boom and the stick individually operate in an ideal condition wherein no feedback deviation information is involved.

Preferably, the boom posture detection means is constructed as boom hydraulic cylinder extension/contraction displacement detection means for detecting extension/contraction displacement information of the boom hydraulic cylinder, and the stick posture detection means is constructed as stick hydraulic cylinder extension/contraction displacement detection means for detecting extension/contraction displacement information of the stick hydraulic cylinder.

By this, in the present control apparatus, posture information of the boom/stick can be detected simply and conveniently by detecting extension/contraction displacement information of the boom/stick hydraulic cylinders.

Further, the boom correction controlling system may include a boom correction value generation section for generating a boom correction value for correcting the control target value of the boom controlling system from the feedback deviation information of the stick controlling system, and the stick correction controlling system may include a stick correction value generation section for generating a stick correction value for correcting the control target value of the stick controlling system from the feedback deviation information of the boom controlling system.

And, by such a simple construction as just described, a boom correction value for correcting the control target value of the boom controlling system and a stick correction value for correcting the control target value of the stick controlling system can be generated to effect correction of the control target values with certainty.

Further, the boom correction controlling system may include a boom weight coefficient addition section for adding a boom weight coefficient to the boom correction value. In this instance, in the boom correction controlling system, the boom correction value for correcting the control target value of the boom controlling system can be varied when necessary, and correction of the control target value can be performed flexibly.

Furthermore, the stick correction controlling system may include a stick weight coefficient addition section for adding a stick weight coefficient to the stick correction value. By this, also in the stick correction controlling system, the stick correction value for correcting the control target value of the stick controlling system can be varied when necessary, and correction of the control target value can be performed flexibly.

Further, according to the present invention, a control apparatus for a construction machine wherein, when at least one pair of arm members connected for pivotal motion to each other and composing a joint type arm mechanism provided on a construction machine body are actuated by cylinder type actuators, the cylinder type actuators are controlled based on a calculation control target value obtained from operation position information of operation members so that the arm members may assume predetermined postures, is characterized in that, from actual posture information of a self one and the other of the arm members, an actual control target value of a controlling system for the self arm member of the arm members is determined and a composite control target value is determined from the actual control target value and the calculation control target value, and the hydraulic type cylinder is controlled based on the composite control target value so that a desired one arm member of the pair of arm members may assume a predetermined posture.

In the control apparatus for a construction machine of the present invention having such a construction as just described, since the posture of the desired arm member is controlled based on a target value (composite control target value) obtained by composition of an ideal calculation control target value obtained by calculation from the operation position information of the arm mechanism operation members (an ideal target value for controlling the arm members to target postures) and an actual control target value determined from actual postures of the arm members taking the actual postures into consideration, the postures of the arm members can always be controlled taking actual postures of the arm members into consideration automatically.

Further, according to the present invention, a control apparatus for a construction machine is characterized in that it comprises a construction machine body, a joint type arm mechanism having at least one pair of arm members having one end portion pivotally mounted on the construction machine body and having a working member on the other end side and connected to each other by a joint part, a cylinder type actuator mechanism having a plurality of cylinder type actuators for actuating the arm mechanism by performing extension/contraction operations, calculation control target value setting means for determining a calculation target control value from operation position information of an arm mechanism operation member, and control means for controlling the cylinder type actuators based on the calculation control target value obtained by the calculation control target value setting means so that the arm members may individually assume predetermined postures, the control means including actual control target value calculation means for determining, for a desired one arm member of the pair of arm members, an actual control target value for a controlling system for the self arm member from actual posture information of the self and the other one of the arm members, composite control target value calculation means for determining a composite control target value from the actual control target value obtained by the actual control target value calculation means and the calculation control target value obtained by the calculation control target value setting means, and a controlling system for controlling the cylinder type actuator based on the composite control target value obtained by the composite control target value calculation means so that the desired one arm member may assume a predetermined posture.

In the construction machine for a construction machine of the present invention having such a construction as just described, since the cylinder type actuator for the desired arm member is controlled based on a target value (composite control target value) obtained by composition of an ideal calculation control target value obtained by calculation from the operation position information of the arm mechanism operation members (an ideal target value for controlling the arm members to target postures) and an actual control target value determined from actual postures of the arm members taking the actual postures into consideration, the postures of the arm members can always be controlled simply and conveniently taking actual postures of the arm members into consideration automatically.

Here, if the controlling system described above is constructed so as to feedback control the cylinder type actuators based on the composite control target value obtained by the composite control target value calculation means and the posture information of the arm members detected by the arm member posture detection means so that the arm members may individually assume predetermined postures, then the control described above can be realized with a simple construction.

Further, if the arm member posture detection means is constructed as extension/contraction displacement detection means for detecting extension/contraction displacement information of the cylinder type actuators, then actual postures of the arm members can be detected simply, conveniently and accurately.

Furthermore, if the composite control target value calculation means is constructed so as to add predetermined weight information to the actual control target value and the calculation control target value to determine the composite control target value, then to which one of the actual target control value and the calculation control target value importance should be attached to effect control can be changed in response to a situation (actual postures of the arm members).

Further, where fluid pressure circuits for the cylinder type actuators are open center type circuits with which extension/contraction displacement velocities of the cylinder type actuators depend upon a load acting upon the cylinder type actuators, since the extension/contraction displacement velocities of the cylinder type actuators vary in response to the load acting upon the cylinder type actuators, it is particularly effective to control the cylinder type actuators taking the actual postures of the arm members into consideration as described above.

Further, according to the present invention, a control apparatus for a construction machine is characterized in that it comprises a construction machine body, a boom connected at one end thereof for pivotal motion to the construction machine body, a stick connected at one end thereof for pivotal motion to the boom by a joint part and having a bucket, which is capable of excavating the ground at a tip thereof and accommodating sand and earth therein, mounted for pivotal motion at the other end thereof, a boom hydraulic cylinder interposed between the construction machine body and the boom for pivoting the boom with respect to the construction machine body by expanding or contracting a distance between end portions thereof, a stick hydraulic cylinder interposed between the boom and the stick for pivoting the stick with respect to the boom by expanding or contracting a distance between end portions thereof, stick control target value setting means for determining a stick control target value for stick control from operation position information of an arm mechanism operation member, a stick controlling system for controlling the stick hydraulic cylinder based on the stick control target value obtained by the stick control target value setting means, boom control target value setting means for determining a boom control target value for boom control from operation position information of the arm mechanism operation member, actual boom control target value calculation means for determining an actual boom control target value for boom control from actual posture information of the boom and the stick, composite boom control target value calculation means for determining a composite boom control target value from the actual boom control target value obtained by the actual boom control target value calculation means and the boom control target value obtained by the boom control target value setting means, and a boom controlling system for controlling the boom hydraulic cylinder based on the composite boom control target value obtained by the composite boom control target value calculation means so that the boom may assume a predetermined posture.

In the control apparatus for a construction machine of the present invention having such a construction as described above, since the boom hydraulic cylinder is controlled based on a target value (composite boom control target value) obtained by composition of an ideal stick control target value and boom control target value obtained by calculation from the operation position information of the arm mechanism operation members (ideal target values for controlling the stick and the boom to respective target postures) and a target value (actual boom control target value) determined from actual postures of the stick and the boom taking the actual postures into consideration, the posture of the boom can always be controlled simply and conveniently taking actual postures of the boom and the stick into consideration automatically.

Here, if the stick controlling system is constructed so as to feedback control the stick hydraulic cylinder based on the stick control target value and the posture information of the stick detected by the stick posture detection means, and the boom controlling system is constructed so as to feedback control the boom hydraulic cylinder based on the composite boom control target value and the posture information of the boom detected by the boom posture detection means so that the boom may assume a predetermined posture, then the control described above can be realized with a simple construction.

Further, if the stick posture detection means is constructed as extension/contraction displacement detection means for detecting extension/contraction displacement information of the stick hydraulic cylinder, and the boom posture detection means is constructed as extension/contraction displacement detection means for detecting extension/contraction displacement information of the boom hydraulic cylinder, then the actual postures of the stick and the boom can be detected simply, conveniently and accurately.

Furthermore, if the actual boom control target value calculation means includes an actual bucket tip position calculation section for calculating tip position information of the bucket from the actual posture information of the boom and the stick, and an actual boom control target value calculation section for determining the actual boom control target value from the tip position information of the bucket obtained by the actual bucket tip position calculation section, then the boom (boom hydraulic cylinder) can be controlled so that the tip position of the bucket may assume a predetermined posture (position).

Further, if the composite boom control target value calculation means is constructed so as to add predetermined weight information to the actual boom control target value and the boom control target value to determine the composite boom control target value, then to which one of the actual boom control target value and the boom control target value importance should be attached to effect control can be changed in response to a situation (actual postures of the boom and stick).

It is to be noted that, if the weight information added by the composite boom control target value calculation means is set so as to assume a value higher than 0 but lower than 1, then to which one of the actual boom control target value and the boom control target value importance should be attached can be changed simply and conveniently.

Further, if the composite boom control target value calculation means is constructed so as to add a first weight coefficient to the boom control target value and add a second weight coefficient to the actual boom control target value to determine the composite boom control target value, then the weight coefficients of the target values can individually be varied in response to actual postures of the boom and the stick.

In this instance, if the first weight coefficient and the second weight coefficient added by the composite boom control target value calculation means are set so as to both assume values higher than 0 but lower than 1, then the target values can be varied simply and conveniently.

Further, in this instance, if the first weight coefficient and the second weight coefficient are set so that the sum thereof may be 1, then to which one of the actual boom control target value and the boom control target value importance should be attached can be set only by setting one of the weight coefficients.

It is to be noted that, if the first weight coefficient added by the composite boom control target value calculation means is set so as to decrease as an extension amount of the stick hydraulic cylinder increases, then control wherein increasing importance is attached to the actual boom control target value as the extension amount of the stick hydraulic cylinder increases is performed.

Further, where fluid pressure circuits for the boom hydraulic cylinder and stick hydraulic cylinder are open center type circuits with which extension/contraction displacement velocities of the cylinders depend upon a load acting upon the cylinders, since the extension/contraction displacement velocities of the cylinder type actuators vary in response to the load acting upon the hydraulic cylinders, it is particularly effective to control the hydraulic cylinders taking the actual postures of the boom and the stick into consideration as described above.

Further, according to the present invention, a control apparatus for a construction machine wherein, when a joint type arm mechanism provided on a construction machine body is actuated by cylinder type actuators which are connected to fluid pressure circuits having at least pumps driven by a prime mover and control valve mechanism and operate with delivery pressures from the pumps, control signals are supplied to the control valve mechanism based on detected posture information of the joint type arm mechanism to control the cylinder type actuators so that the joint type arm mechanism may assume a predetermined posture, is characterized in that, if a delivery capacity variation factor of the pumps in the prime mover is detected, then the control signals are corrected in response to the delivery capacity variation factor.

In the control apparatus for a construction machine described above, since, if a delivery capacity variation factor of the pumps in the prime mover is detected, then the control signals to the control valve mechanism are corrected in response to the delivery capacity variation factor, even if a delivery capacity variation factor of the pumps occurs, control of the control valve mechanism is performed in response to the variation and the cylinder type actuators are controlled rapidly against the variation, and consequently, the operation velocities thereof can be secured.

Further, according to the present invention, a control apparatus for a construction machine is characterized in that it comprises a construction machine body, a joint type arm mechanism having at least one pair of arm members having one end portion pivotally mounted on the construction machine body and having a working member on the other end side and connected to each other by a joint part, a cylinder type actuator mechanism having a plurality of cylinder type actuators for actuating the arm mechanism by performing extension/contraction operations, fluid pressure circuits at least having pumps driven by a prime mover and control valve mechanism for supplying and discharging operating fluid to and from the cylinder type actuator mechanism to cause the cylinder type actuators of the cylinder type actuator mechanism to effect extension/contraction operations, posture detection means for detecting posture information of the arm members, control means for supplying control signals to the control valve mechanism based on a detection result detected by the posture detection means to control the cylinder type actuators so that the arm members may individually assume predetermined postures, and variation factor detection means for detecting a delivery capacity variation factor of the pumps in the prime mover, the control means including correction means for correcting, when a delivery capacity variation factor of the pumps is detected by the variation factor detection means, the control signals in response to the delivery capacity variation factor.

In this instance, the control apparatus for a construction machine may be constructed such that the prime mover is constructed as a rotational output type prime mover, and the variation factor detection means is constructed as means for detecting rotational speed information of the prime mover, and besides the correction means corrects, when it is detected by the variation factor detection means that the rotational speed information of the prime mover has varied, the control signals in response to the variation.

Further, the correction means may include reference rotational speed setting means for setting reference rotational speed information of the prime mover, deviation calculation means for calculating a deviation between the reference rotational speed information set by the reference rotational speed setting means and actual rotational speed information of the prime mover detected by the variation factor detection means, and correction information calculation means for calculating correction information for correcting the control signals in response to the deviation obtained by the deviation calculation means.

Furthermore, the correction information calculation means may include storage means for storing correction information for correcting the control signals in response to the deviation obtained by the deviation calculation means.

In the control apparatus for a construction machine, if a delivery capacity variation factor of the pumps in the prime mover is detected by the variation factor detection means, then since the control signals from the control means to the control valve mechanism are corrected in response to the delivery capacity variation factor by the correction means, even if a delivery capacity variation factor of the pumps occurs, control of the control valve mechanism is performed in response to the variation and the cylinder type actuators are controlled rapidly against the variation, and consequently, the operation velocities thereof can be secured.

In this instance, if the prime mover is a rotational output type prime mover, then by detecting rotational speed information of the prime mover by the variation factor detection means, a variation of rotational speed information of the prime mover is detected as a delivery capacity variation factor of the pumps in the prime mover, and the correction means corrects the control signals in response to the variation of the rotational speed information of the prime mover.

Further, in the correction means, a deviation between the reference rotational speed information set by the reference rotational speed setting means and actual rotational speed information of the prime mover detected by the variation factor detection means is calculated by the deviation calculation means, and correction information for correcting the control signals is calculated in response to the deviation by the correction information calculation means.

Furthermore, where correction information for correcting the control signals in response to a deviation obtained by the deviation calculation means is stored in the storage means in advance, correction information corresponding to a deviation obtained by the deviation calculation means can be read out from the storage means to effect calculation of correction information.

Further, according to the present invention, a control apparatus for a construction machine wherein, when arm members which compose a joint type arm mechanism provided on a construction machine body are actuated by cylinder type actuators whose extension/contraction displacement velocities vary in response to a load thereto, the cylinder type actuators are controlled based on a control target value so that the joint type arm mechanism may assume a predetermined posture, is characterized in that the control apparatus is constructed so as to reduce, when the load to the actuators is higher than a predetermined value, the control target value to reduce the extension/contraction displacement velocities of the cylinder type actuators.

Further, according to the present invention, a control apparatus for a construction machine, characterized in that it comprises a construction machine body, a joint type arm mechanism having at least one pair of arm members having one end portion pivotally mounted on the construction machine body and having a working member on the other end side and connected to each other by a joint part, a cylinder type actuator mechanism having a plurality of cylinder type actuators for actuating the arm mechanism by effecting extension/contraction operations such that extension/contraction displacement velocities may vary depending upon a load, control target value setting means for calculating a control target value from operation position information of operation members, control means for controlling the cylinder type actuators based on the control target value obtained by the target value setting means so that the arm members may individually assume predetermined postures, and actuator load detection means for detecting load conditions to the cylinder type actuators, the control means having first correction means for reducing, when the load to the cylinder type actuators detected by the actuator load detection means is higher than a predetermined value, the control target value set by the target value setting means in response to the load condition of the cylinder type actuators to lower the extension/contraction displacement velocity by the cylinder type actuators.

With such a construction as described above, since, when the load to the cylinder type actuators for actuating the arm members is higher than the predetermined value, the control target value is reduced to control the actuators so that the extension/contraction displacement velocities of them may be reduced, even if the load to the actuators is removed (reduced) suddenly, the extension displacements of them can be controlled very smoothly without being varied suddenly. Consequently, the finish accuracy in a desired construction operation can be augmented significantly.

Further, the control apparatus for a construction machine may be constructed such that it comprises posture detection means for detecting the posture information of the arm members, and the control means feedback controls the cylinder type actuators based on the control target value obtained by the target value setting means and the posture information of the arm members detected by the posture detection means so that the arm members may individually assume predetermined postures.

With such a construction as just described, since the arm members can be controlled so as to assume predetermined postures with a higher degree of accuracy if the actuators are feedback controlled based on the control target value and the posture information of the arm members so that the arm members may assume the predetermined postures, the finish accuracy in a desired construction operation can be further augmented.

Furthermore, the arm member posture detection means may be constructed as extension/contraction displacement detection means for detecting extension/contraction displacement information of the cylinder type actuators. In this instance, since posture information can be obtained simply and conveniently with a very simple construction, this contributes very much to simplification of the present control apparatus.

Meanwhile, the control means may be constructed as means for controlling the cylinder type actuators by feedback controlling systems which at least have a proportion operation factor and an integration operation factor so that the arm members may individually assume predetermined postures, and have second correction means for regulating, when the load to the actuators detected by the actuator load detection means is higher than the predetermined value, feedback control by the integration operation factor in response to the load conditions of the cylinder type actuators.

Where such a construction as just described is employed, when the load to the actuators described above is higher than the predetermined value, if the feedback control of the actuators by the integration operation factor is regulated in response to the load condition, then the extension/contraction displacement velocities can be prevented from continuing to be increased by the integration operation factor with certainty while necessary minimum extension/contraction displacement velocities of the actuators are secured (maintained) by the proportional operation factor. Accordingly, a desired construction operation can be performed with a higher degree of accuracy and efficiently.

The first correction means may be constructed so as to increase a reduction amount of the control target value to reduce the extension/contraction displacement velocity by the cylinder type actuators as the load to the actuators increases. In this instance, since the extension/contract displacement velocities of the actuators can be reduced (varied) very smoothly by simple and easy setting, this contributes very much to simplification and augmentation in performance of the present control apparatus.

Furthermore, the second correction means may be constructed so as to increase the regulation amount of the feedback control by the integration operation factor as the load to the cylinder type actuators increases. By this, since an increase of the extension/contraction displacement velocities of the actuators by the integration operation factor can be regulated very rapidly by simple and easy setting, also this contributes very much to simplification and augmentation in performance of the present control apparatus.

Further, the control means may include third correction means for increasing, under a transition condition wherein the load to the cylinder type actuators detected by the actuator load detection means changes from a condition wherein the load is higher than the predetermined value to another condition wherein the load is lower than the predetermined value, the extension/contraction displacement velocities by the cylinder type actuators based on a result obtained through integration means which moderates a variation of a detection result obtained by the actuator load detection means.

With such a construction as just described, since, even if the load to the actuators is removed suddenly, the extension/contraction displacement velocities of them can be caused to increase moderately, the arm members can be controlled very smoothly to augment the finish accuracy in a desired construction operation very much.

Further, according to the present invention, a control apparatus for a construction machine is characterized in that it comprises a construction machine body, a boom connected at one end thereof for pivotal motion to the construction machine body, a stick connected at one end thereof for pivotal motion to the boom by a joint part and having a bucket, which is capable of excavating the ground at a tip thereof and accommodating sand and earth therein, mounted for pivotal motion at the other end thereof, a boom hydraulic cylinder interposed between the construction machine body and the boom for pivoting the boom with respect to the construction machine body by expanding or contracting a distance between end portions thereof, a stick hydraulic cylinder interposed between the boom and the stick for pivoting the stick with respect to the boom by expanding or contracting a distance between end portions thereof, control target value setting means for determining a control target value from operation position information of operation members, control means for controlling the boom hydraulic cylinder and the stick hydraulic cylinder based on the control target value obtained by the control target value setting so that the bucket may move at a predetermined moving velocity, and hydraulic cylinder load detection means for detecting a load condition of the boom hydraulic cylinder or the stick hydraulic cylinder, and the control means includes fourth correction means for reducing, when any of the cylinder loads detected by the hydraulic cylinder load detection means is higher than a predetermined value, the control target value set by the target value setting means in response to the cylinder load condition to reduce the bucket moving velocity by the boom hydraulic cylinder and the stick hydraulic cylinder.

With such a constructed as just described, when the load to the hydraulic cylinders is higher than the predetermined value, since the hydraulic cylinders are controlled to reduce the control target value to reduce the extension/contraction displacement velocities of them, even if the load to the hydraulic cylinders is removed (reduced) suddenly, the extension/contraction displacements of them can be controlled very smoothly without allowing them to vary suddenly. Consequently, the finish accuracy in a desired construction operation can be augmented remarkably.

The control apparatus for a construction machine may be constructed such that it comprises boom posture detection means for detecting posture information of the boom, and stick posture detection means for detecting posture information of the stick, and the control means is constructed so as to feedback control the boom hydraulic cylinder and the stick hydraulic cylinder based on the control target value obtained by the control target value setting means and the posture information of the boom and the stick detected by the boom posture detection means and the stick posture detection means so that the bucket may move at a predetermined moving velocity.

In this instance, if the hydraulic cylinders are feedback controlled based on the control target value and the posture information of the boom and the stick so that the bucket may move at the predetermined velocity, then since the boom and the stick can be controlled so as to assume predetermined postures with a higher degree of accuracy, the finish accuracy in a desired construction operation can be further augmented.

The stick posture detection means may be constructed as extension/contraction displacement detection means for detecting extension/contraction displacement information of the stick hydraulic cylinder, and the boom posture detection means may be constructed as extension/contraction displacement detection means for detecting extension/contraction displacement information of the boom hydraulic cylinder. This contributes very much to simplification of the present apparatus since posture information can be obtained simply and conveniently with a very simple construction.

The control means may be constructed as means for controlling the boom hydraulic cylinder and the stick hydraulic cylinder based on the control target value by feedback controlling systems which have at least a proportion operation factor and an integration operation factor so that the bucket may move at the predetermined moving velocity, and include fifth correction means for regulating, when the cylinder load detected by the hydraulic cylinder load detection means is higher than a predetermined value, the feedback control by the integration operation factor in response to the cylinder load condition.

In this instance, the extension/contraction displacement velocities can be prevented from continuing to be increased by the integration operation factor with certainty while necessary minimum extension/contraction displacement velocities of the hydraulic cylinders are secured (maintained) by the proportion operation factor. Accordingly, a desired construction operation can be performed with a higher degree of accuracy and efficiently.

Further, where the fourth correction means is constructed so as to increase the reduction amount of the control target value to reduce the bucket moving velocity as the cylinder load increases, since the bucket moving velocity can be reduced (varied) very smoothly by simple and easy setting, this contributes very much to simplification and augmentation in performance of the present control apparatus.

Further, where the fifth correction means is constructed so as to increase the regulation amount of the feedback control by the integration operation factor as the cylinder load increases, since an increase of the bucket moving velocity by the integration operation factor can be regulated very rapidly by simple and easy setting, also this contributes very much to simplification and augmentation in performance of the present control apparatus.

Furthermore, the control means may include sixth correction means for increasing, under a transition condition wherein any of the cylinder loads detected by the hydraulic cylinder load detection means changes from a condition wherein the load is higher than the predetermined value to another condition wherein the load is lower than the predetermined value, the bucket moving velocity by the boom hydraulic cylinder and the stick hydraulic cylinder based on a result obtained through integration means which moderates a variation of a detection result obtained by the hydraulic cylinder load detection means.

Where such a construction as described above is employed, even when the load to the hydraulic cylinders is removed suddenly, the bucket moving velocity can be caused to increase moderately, and accordingly, the arm members can be controlled very smoothly to increase the finish accuracy in a desired construction operation remarkably.

It is to be noted that, if the integration means is a low-pass filter, then the controls described above can be realized readily with a very simple construction.

Further, the present control apparatus is effectively particularly where fluid pressure circuits (hydraulic circuits) for the actuators (hydraulic cylinders) described above are open center type circuits with which extension/contraction displacement velocities of the actuators (hydraulic cylinders) depend upon a load acting upon the actuators (hydraulic cylinders), and can always control very smoothly without allowing the extension/contraction displacements of the actuators (hydraulic cylinders) to vary suddenly.

Further, according to the present invention, a control apparatus for a construction machine wherein, when a working member mounted for pivotal motion at an end of a joint type arm mechanism provided on a construction machine body is actuated by cylinder type actuators, the cylinder type actuators are controlled based on a control target value determined from operation position information of operation members by feedback controlling systems which have a proportion operation factor, an integration proportion factor and a differentiation operation factor so that the working member may assume a predetermined posture, is characterized in that feedback control by the proportion operation factor, the differentiation operation factor and the integration operation factor is performed when a first condition that the operation positions of the operation members are inoperative positions and control deviations of the feedback controlling systems are higher than a predetermined value is satisfied, but when the first condition is not satisfied, feedback control by the integration operation factor is inhibited and feedback control by the proportion operation factor and the differential operation factor is performed.

Further, according to the present invention, a control apparatus for a construction machine is characterized in that it comprises a construction machine body, a working member mounted on the construction machine body by a joint type arm mechanism, a cylinder type actuator mechanism having cylinder type actuators for actuating the working member by performing extension/contraction operations, control target value setting means for determining a control target value from operation position information of operation members, posture detection means for detecting posture information of the working member, control means for controlling the cylinder type actuators based on the control target value obtained by the control target value setting means and the posture information of the working member detected by the posture detection means by feedback controlling systems which have a proportional operation factor, an integration operation factor and a differentiation operation factor so that the working member may assume a predetermined posture, operation position detection means for detecting whether or not operation positions of the operation members are in inoperative positions, and control deviation detection means for detecting whether or not control deviations of the feedback controlling systems are higher than a predetermined value, and the control means includes first control means for performing feedback control by the proportion operation factor, the differentiation operation factor and the integration operation factor when a first condition that the operation positions of the operation members detected by the operation position detection means are the inoperative positions and the control deviations of the feedback controlling systems detected by the control deviation detection means are higher than the predetermined value is satisfied, and second control means for inhibiting feedback control by the integration operation factor and performing feedback control by the proportion operation factor and the differentiation operation factor when the first condition is not satisfied.

It is to be noted that the posture detection means may be constructed as extension/contraction displacement detection means for detecting extension/contraction displacement information of the cylinder type actuators.

Further, the joint type arm mechanism may be composed of a boom and a stick connected for pivotal motion relative to each other by a joint part, and the working member may be constructed as a bucket which is mounted for pivotal motion on the stick and is capable of excavating the ground at a tip thereof and accommodating sand and earth therein.

With such a construction as described above, while the operation members are in the operative positions, since feedback control by the integration operation factor is inhibited, a large variation of the control target value of the cylinder type actuators which arises from by the integration operation factor can be regulated. Accordingly, when the operation members are in the inoperative positions and the control deviation is higher than the predetermined value, if feedback control by the integration operation factor is added to feedback control by the proportion operation factor and the differentiation operation factor, then a control deviation which cannot be reduced fully to zero where only feedback control by the proportion operation factor and the differentiation operation factor is performed can be reduced close to zero very rapidly, and consequently, the working member can be controlled to a desired posture rapidly and accurately and the working member can be controlled with a very high degree of accuracy.

BRIEF DESCRIPTION OF THE DRAWINGS

FIG. 22(*b*) is a view for explaining an operation according to the third embodiment of the present invention and is a view illustrating an example of correction of a target value;

BEST MODE FOR CARRYING OUT THE INVENTION

In the following, embodiments of the present invention are described with reference to the drawings.

(1) Description of the First Embodiment

First, a control apparatus for a construction machine according to a first embodiment of the present invention is described. The control apparatus for a construction machine of the present embodiment is constructed such that, even if an operation lever or the like is operated suddenly upon starting of operation or ending of operation in a semiautomatic control mode, a variation of an instruction value to a hydraulic cylinder is smooth.

Figure 1:
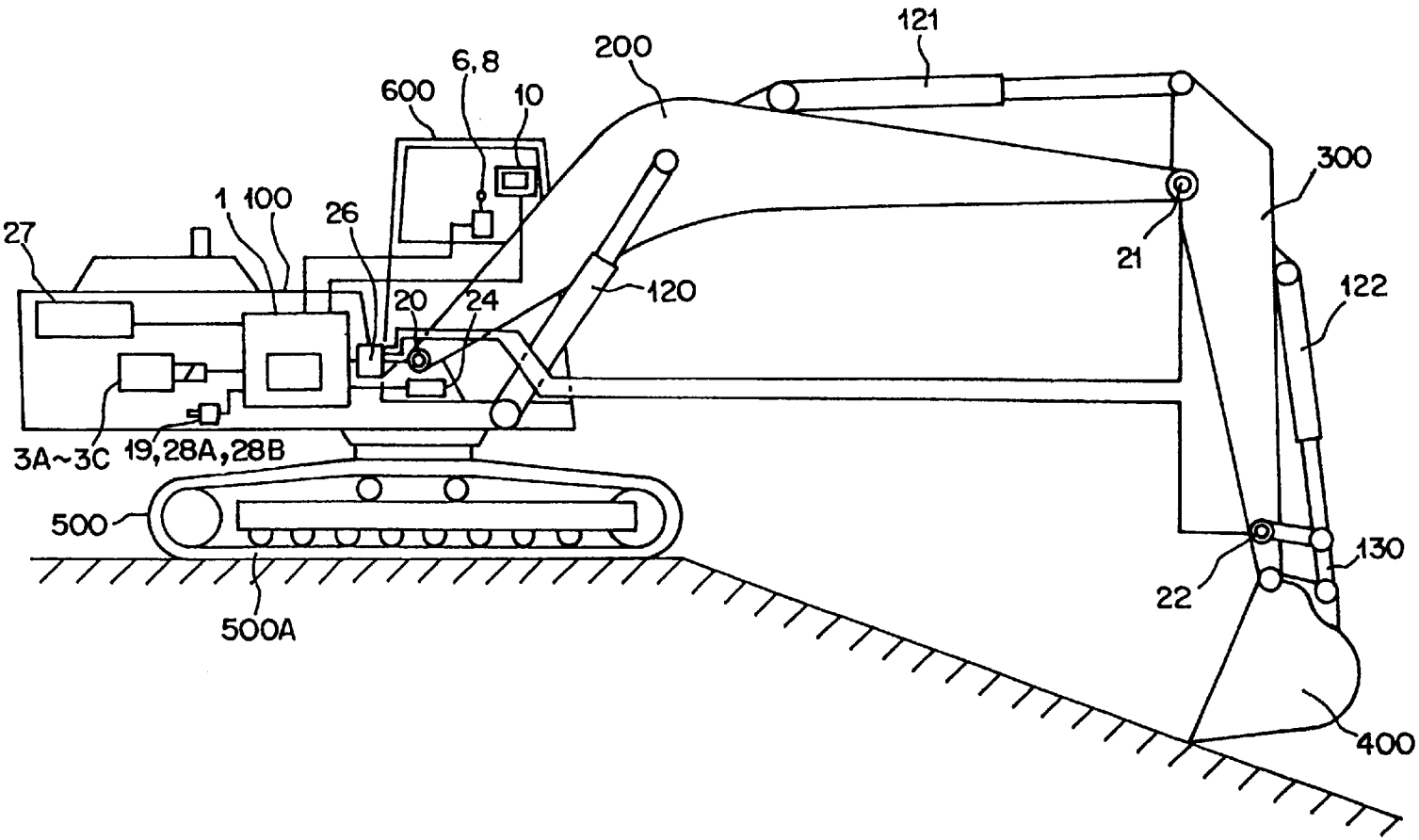
FIG. 1 is a schematic view showing a hydraulic excavator on which a control apparatus according to a first embodiment of the present invention is provided.

Here, a hydraulic excavator as a construction machine according to the present embodiment includes, as shown in FIG. 1, an upper revolving unit (construction machine body) 100 with an operator cab 600 for revolving movement in a horizontal plane on a lower traveling unit 500 which has caterpillar members 500A on the left and right thereof.

A boom (arm member) 200 having one end connected for swingable motion is provided on the upper revolving unit 100, and a stick (arm member) 300 connected at one end thereof for swingable motion by a joint part is provided on the boom 200.

A bucket (working member) 400 which is connected at one end thereof for swingable motion by a joint part and can excavate the ground with a tip thereof and accommodate earth and sand therein is provided on the stick 300.

In this manner, in the present embodiment, a joint type arm mechanism is composed of the boom 200, stick 300 and bucket 400. In particular, a joint type arm mechanism which is mounted at one end portion thereof for swingable motion on the upper revolving unit 100 and has the bucket 400 on the other end side thereof and further has at least a pair of arms (boom 200 and stick 300) connected to each other by the joint part is composed.

Further, a boom hydraulic cylinder 120, a stick hydraulic cylinder 121 and a bucket hydraulic cylinder 122 (in the following description, the boom hydraulic cylinder 120 may be referred to as boom cylinder 120 or merely as cylinder 120, the stick hydraulic cylinder 121 may be referred to as stick cylinder 121 or merely as cylinder 121, and the bucket hydraulic cylinder 122 may be referred to as bucket cylinder 122 or merely as cylinder 122) as cylinder type actuators are provided.

Here, the boom hydraulic cylinder 120 is connected at one end thereof for swingable motion to the upper revolving unit 100 and is connected at the other end thereof for swingable motion to the boom 200. In other words, the boom cylinder 120 is interposed between the upper revolving unit 100 and the boom 200, such that, as the distance between the opposite end portions is expanded or contracted, the boom 200 can be pivoted with respect to the upper revolving unit 100.

The stick cylinder 121 is connected at one end thereof for swingable motion to the boom 200 and connected at the other end thereof for swingable motion to the stick 300. In other words, the stick cylinder 121 is interposed between the boom 200 and the stick 300, such that, as the distance between the opposite end portions is expanded or contracted, the stick 300 can be pivoted with respect to the boom 200.

The bucket cylinder 122 is connected at one end thereof for swingable motion to the stick 300 and connected at the other end thereof for swingable motion to the bucket 400. In other words, the bucket cylinder 122 is interposed between the stick 300 and the bucket 400, such that, as the distance between the opposite end portions thereof is expanded or contracted, the bucket 400 can be pivoted with respect to the stick 300. It is to be noted that a linkage 130 is provided at a free end portion of the bucket hydraulic cylinder 122.

In this manner, a cylinder type actuator mechanism having a plurality of cylinder type actuators for driving the arm mechanism by performing expanding and contracting operations is composed of the cylinders 120 to 122 described above.

It is to be noted that, though not shown in the figure, also hydraulic motors for driving the left and right caterpillar members 500A and a revolving motor for driving the upper revolving unit 100 to revolve are provided.

Figure 2:
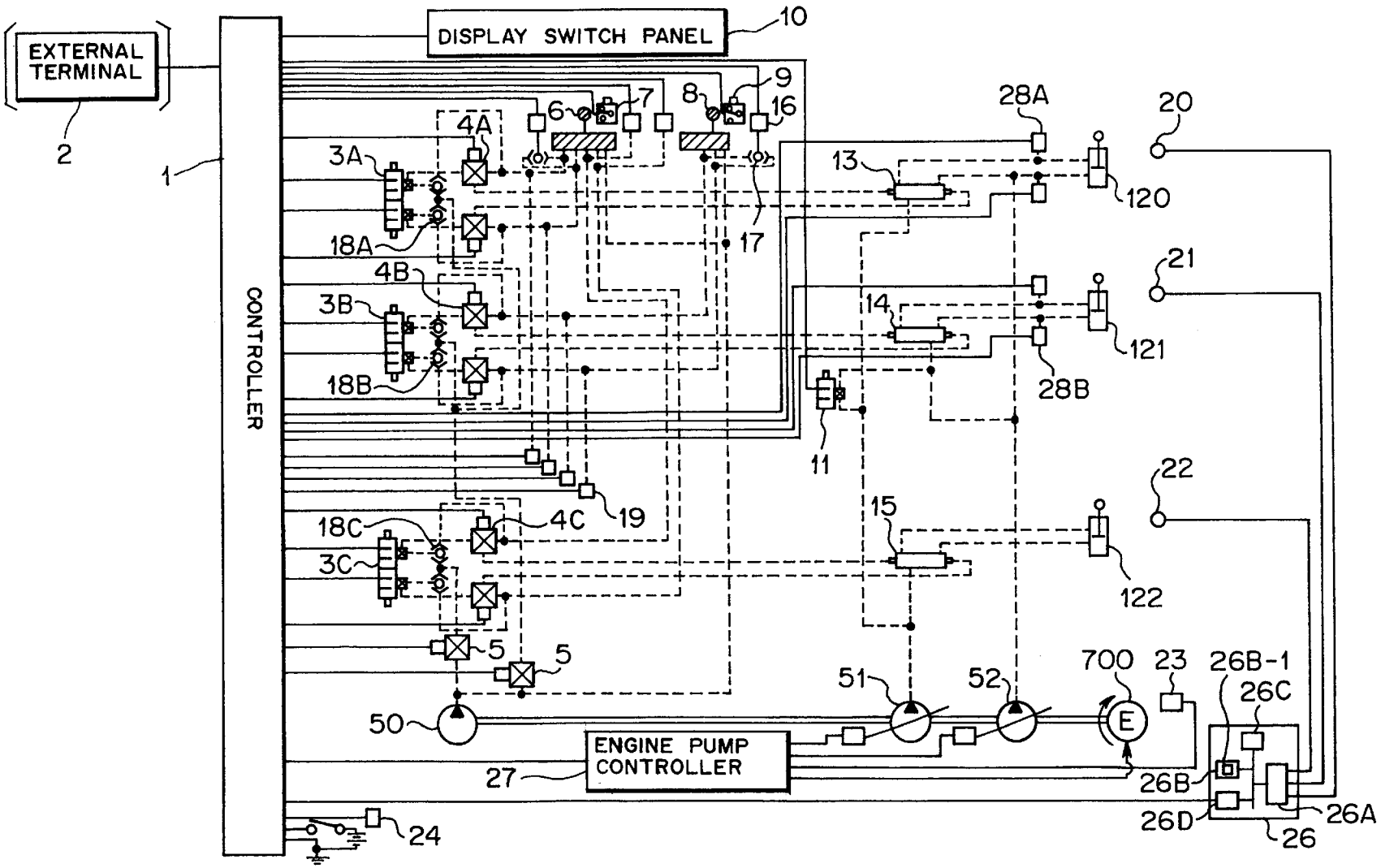
FIG. 2 is a view schematically showing a construction of a control system according to the first embodiment of the present invention.

By the way, as shown in FIG. 2, a hydraulic circuit (fluid pressure circuit) for the cylinders 120 to 122, the hydraulic motors and the revolving motor described above is provided, and pumps 51 and 52 which are driven by an engine 700, main control values (main control valves) 13, 14 and 15 and so forth are interposed in the hydraulic circuit.

Further, in order to control the main control valves 13, 14 and 15, a pilot hydraulic circuit is provided, and a pilot pump 50, solenoid proportional valves 3A, 3B and 3C, solenoid directional control valves 4A, 4B and 4C, selector valves 18A, 18B and 18C and so forth driven by the engine 700 are interposed in the pilot hydraulic circuit. It is to be noted that, in FIG. 2, where each line which interconnects different components is a solid line, this represents that this line is an electric system, but where each line which interconnects different components is a broken line, this represents that the line is a hydraulic system.

By the way, a controller (controlling means) 1 for controlling the main control valves 13, 14 and 15 via the solenoid proportional valves 3A, 3B and 3C to control the boom 200, the stick 300 and the bucket 400 so that they may have desired extension/contraction displacements is provided. It is to be noted that the controller 1 is composed of a microprocessor, memories such as a ROM and a RAM, suitable input/output interfaces and so forth.

To the controller 1, detection signals (including setting signals) from various sensors are inputted, and the controller 1 executes the control described above based on the detection signals from the sensors. It is to be noted that such control by the controller 1 is called semiautomatic control, and even in a semiautomatic excavation mode, it is possible to manually effect fine adjustment of the bucket angle and the target slope face height during excavation.

As a mode of the semiautomatic control described above, a bucket angle control mode (refer to FIG. 9), a slope face excavation mode (bucket tip linear excavation mode or raking mode) (refer to FIG. 10), a smoothing mode which is a combination of the slope face excavation mode and the bucket angle control mode (refer to FIG. 11), a bucket angle automatic return mode (automatic return mode) (refer to FIG. 12) and so forth are available.

Figure 9:
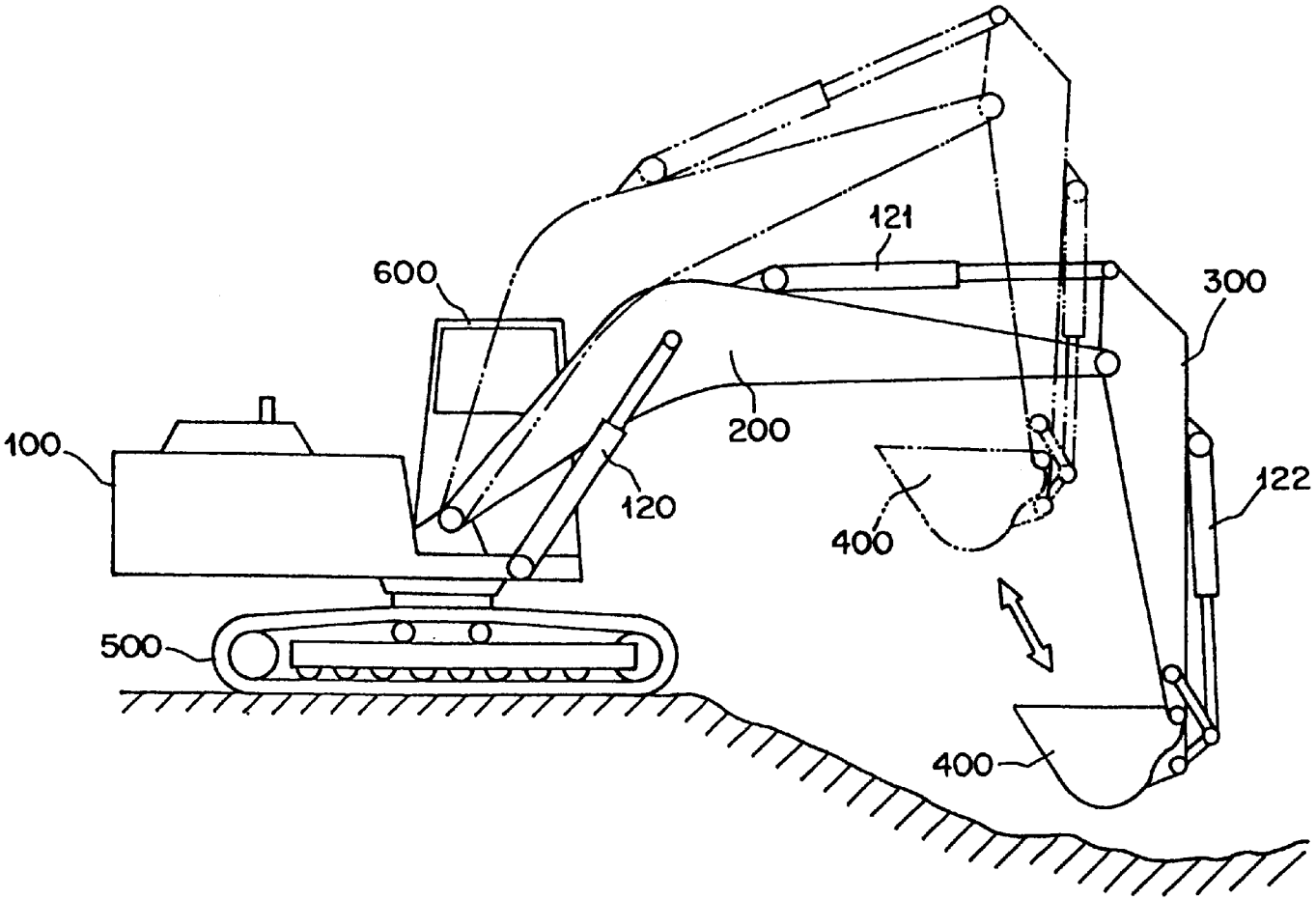
FIG. 9 is a schematic view illustrating an operation of the hydraulic excavator to which the first embodiment of the present invention is applied.

Here, the bucket angle control mode is a mode in which the angle (bucket angle) of the bucket 400 with respect to the horizontal direction (vertical direction) is always kept constant even if the stick 300 and the boom 200 are moved as shown in FIG. 9, and this mode is executed if a bucket angle control switch on a display switch panel shown in FIG. 2 or a monitor panel 10 with a target slope face setting unit (which is hereinafter referred to merely as monitor panel) is switched ON. It is to be noted that this mode is cancelled when the bucket 400 is moved manually, and a bucket angle at a point of time when the bucket 400 is stopped is stored as a new bucket holding angle.

Figure 10:
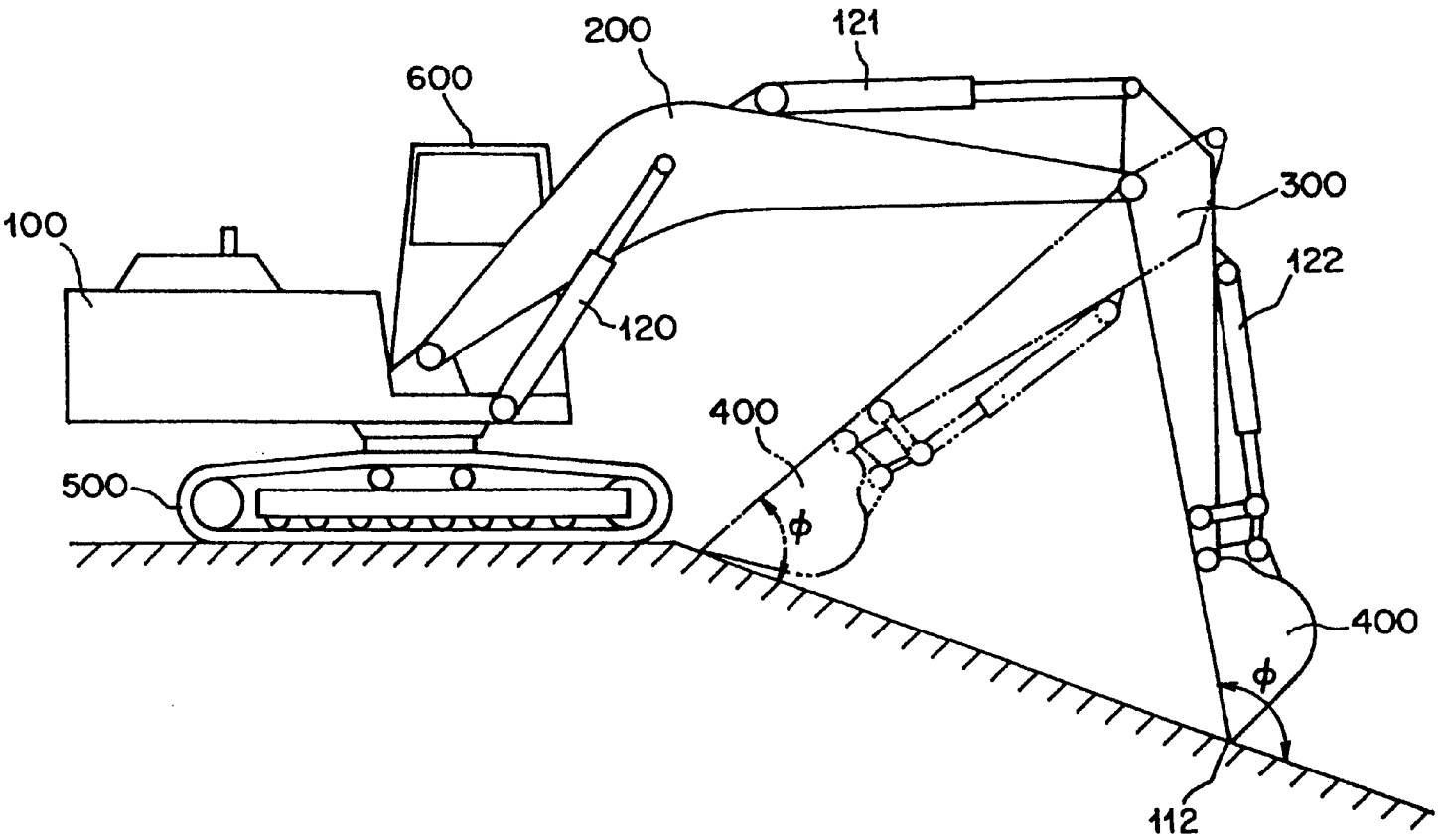
FIG. 10 is a schematic view illustrating an operation of the hydraulic excavator to which the first embodiment of the present invention is applied.

The slope face excavation mode is a mode in which a tip 112 of the bucket 400 moves linearly as shown in FIG. 10. However, in this instance, the bucket hydraulic cylinder 122 does not move, and accordingly, the bucket angle $\phi$ (angle of the tip 112 of the bucket 400 with respect to a slop face) varies as the bucket 400 moves.

Figure 11:
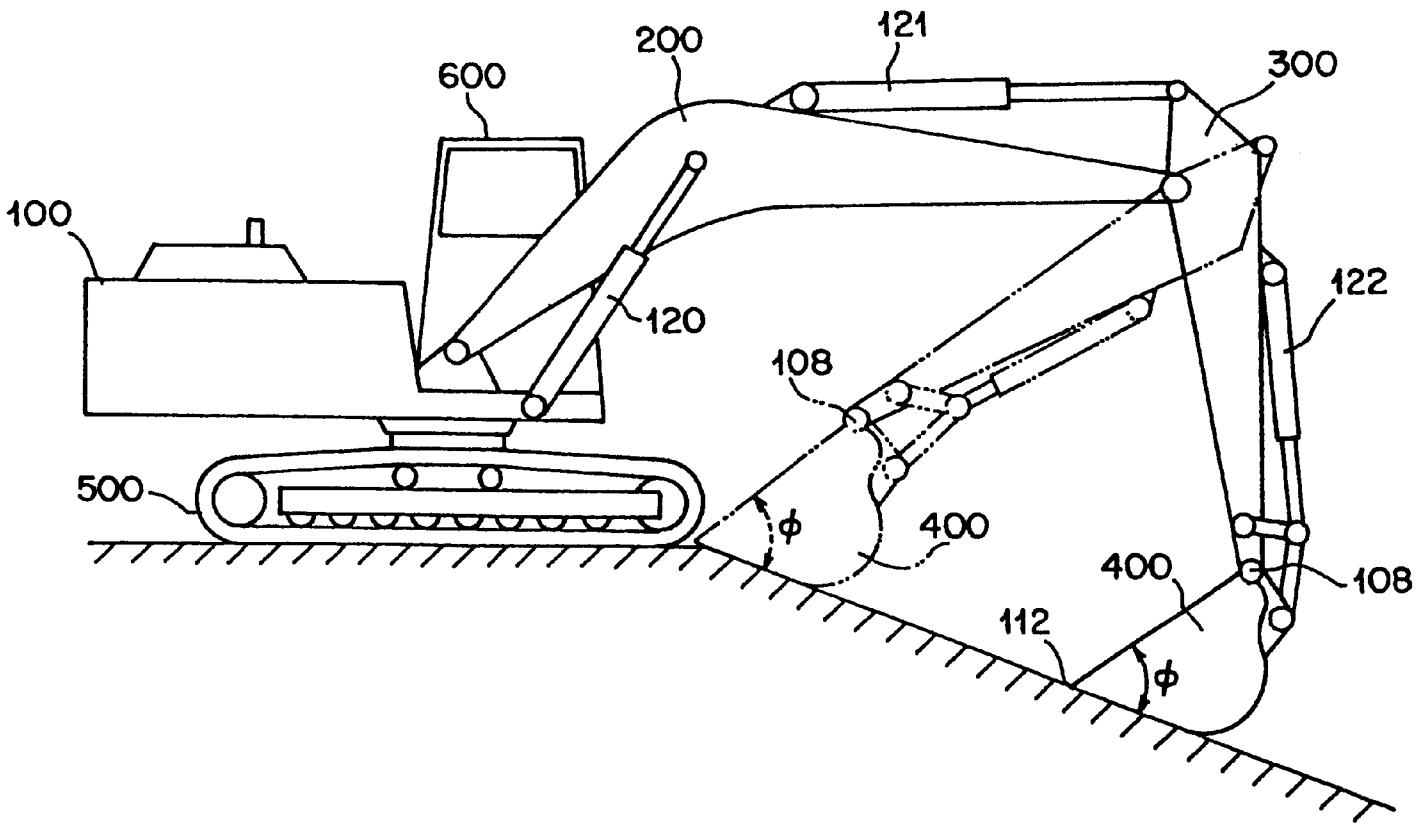
FIG. 11 is a schematic view illustrating an operation of the hydraulic excavator to which the first embodiment of the present invention is applied.

The slope face excavation mode + bucket angle control mode (smoothing mode) is a mode in which the tip 112 of the bucket 400 moves linearly and also the bucket angle $\phi$ is kept constant during excavation as shown in FIG. 11.

Figure 12:
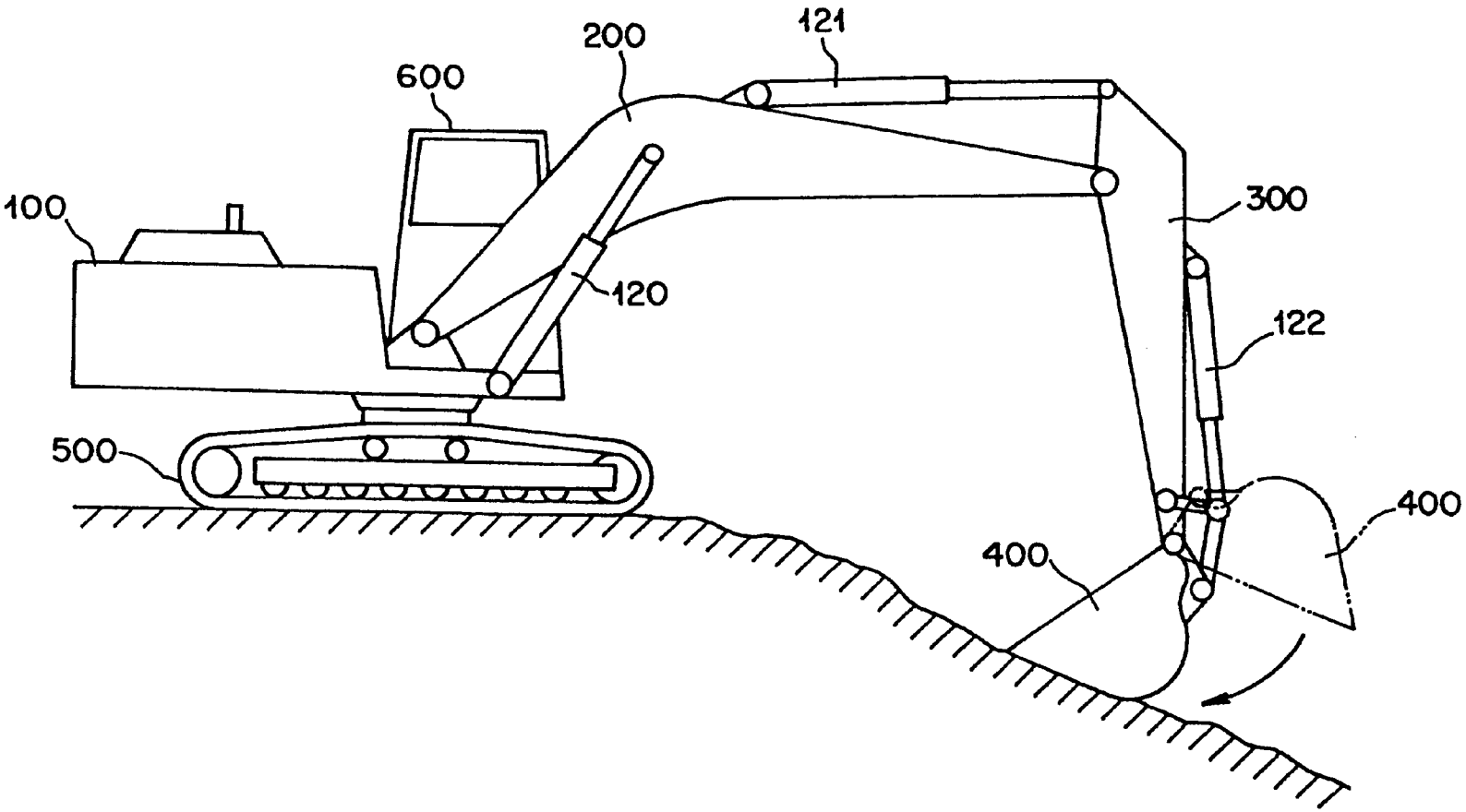
FIG. 12 is a schematic view illustrating an operation of the hydraulic excavator to which the first embodiment of the present invention is applied.

The bucket automatic return mode is a mode in which the bucket angle is automatically returned to an angle set in advance as shown in FIG. 12, and the return bucket angle is set by the monitor panel 10. This mode is started when a packet automatic return start switch 7 on an operation lever 6 is switched ON, and this mode is cancelled at a point of time when the bucket 400 returns to the angle set in advance. It is to be noted that the operation lever 6 is an operation member for operating both of the boom 200 and the bucket 400, and is hereinafter referred to as boom operation lever or boom/bucket operation lever.

Further, the slope face excavation mode and the smoothing mode described above are started when a semiautomatic control switch on the monitor panel 10 is switched ON and a slope face excavation switch 9 on a stick operation lever 8 is switched ON and besides both or either one of the stick operation lever 8 and the boom/bucket operation lever 6 is moved. It is to be noted that the target slope face angle is set by a switch operation on the monitor panel 10.

Further, in the slope face excavation mode and the smoothing mode, a bucket tip moving velocity in a parallel direction to the target slope face angle is set by the operation amount of the stick operation lever 8, and a bucket tip moving velocity in the perpendicular direction to the target slope face angle is set by the operation amount of the boom/bucket operation lever 6.

Accordingly, if the stick operation lever 8 is operated, then the bucket tip 112 starts its linear movement along the target slope face angle, and fine adjustment of the target slope face angle by a manual operation can be performed by moving the boom/bucket operation lever 6 during excavation.

Further, if the stick operation lever 8 and the boom/bucket operation lever 6 are operated at the same time, then the moving direction and the moving velocity of the bucket tip 112 are determined by a composite vector of the parallel and vertical directions with respect to the set inclined face (slope face).

Further, in the slope face excavation mode and the smoothing mode, not only the bucket angle during excavation can be adjusted finely by operating the boom/bucket operation lever 6, but also the target slope face height can be changed. In other words, also in the semiautomatic excavation modes, fine adjustment of the bucket angle and the target slope face height can be performed manually during excavation.

It is to be noted that, in the present system, also a manual mode is possible, and in this manual mode, not only operation equivalent to that of a conventional hydraulic excavator is possible, but also coordinate indication of the tip 112 of the bucket 400 is possible.

Also a service mode for performing service maintenance of the entire semiautomatic system is prepared, and this service mode is enabled by connecting an external terminal 2 to the controller 1. And, by this service mode, adjustment of control gains, initialization of various sensors and so forth are performed.

By the way, as the various sensors connected to the controller 1, as shown in FIG. 2, pressure switches 16, pressure sensors 19, 28A and 28B, resolvers (angle sensors) 20 to 22, an inclination angle sensor 24 and so forth are provided. Further, to the controller 1, an engine pump controller 27, ON-OFF switches 7 and 9, the monitor panel 10 are connected. It is to be noted that the external terminal 2 is connected to the controller 1 upon adjustment of the control gains, initialization of the sensors and so forth.

It is to be noted that the engine pump controller 27 receives engine speed information from an engine rotational speed sensor 23 and controls the engine 700, and the engine pump controller 27 can communicate coordination information with the controller 1. Further, detection signals of the resolvers 20 to 22 are inputted to the controller 1 via a signal converter (conversion means) 26.

The pressure sensors 19 are sensors which are attached to pilot pipes connected from the operation lever 8 for the stick 300 and the operation lever 6 for the boom 200 to the main control valves 13, 14 and 15 and detect pilot hydraulic pressures in the pilot pipes. Since the pilot hydraulic pressures in such pilot lines are varied by the operation amounts of the operation levers 6 and 8, the operation amounts of the operation levers 6 and 8 can be estimated by measuring the hydraulic pressures.

The pressure sensors 28A and 28B detect hydraulic pressures supplied to the boom cylinder 120 and the stick cylinder 121 to detect extension/contraction conditions of the cylinders 120 and 121.

The pressure switches 16 are attached to the pilot pipes for the operation levers 6 and 8 with selectors 17 or the like interposed therebetween and are provided as neutral detection switches for detecting whether or not the operation positions of the operation levers 6 and 8 are neutral. Then, when the operation lever 6 or 8 is in the neutral condition, the output of the pressure switch 16 is OFF, but when the operation lever 6 or 8 is operated (when it is not in a neutral condition), the output of the pressure switch 16 is ON. It is to be noted that the pressure switches 16 are used also for detection of an abnormal condition of the pressure sensors 19 and for switching between the manual/semiautomatic modes.

The resolver 20 is provided at a pivotally mounted portion (joint part) of the boom 200 on the upper revolving unit 100 and functions as a first angle sensor for detecting (monitoring) the posture of the boom 200. The resolver 21 is provided at a pivotally mounted portion (joint part) of the stick 300 on the boom 200 and functions as a second angle sensor for detecting (monitoring) the posture of the stick 300. Further, the resolver 22 is provided at a linkage pivotally mounted portion and functions as a third angle sensor for detecting (monitoring) the posture of the bucket 400. By those resolvers 20 to 22, angle detection means for detecting the posture of the arm mechanism in angle information is composed.

The signal converter (conversion means) 26 converts angle information obtained by the resolver 20 into extension/contraction displacement information of the boom cylinder 120, converts angle information obtained by the resolver 21 into extension/contraction of the stick cylinder 121, and converts angle information obtained by the resolver 22 into extension/contraction of the bucket cylinder 122, that is, converts angle information obtained by the resolvers 20 to 22 into corresponding extension/contraction displacement information of the cylinders 120 to 122. To this end, the signal converter 26 includes an input interface 26A for receiving signals from the resolvers 20 to 22, a memory 26B including a lookup table 26B-1 for storing extension/contraction displacement information of the cylinders 120 to 122 corresponding to angle information obtained by the resolvers 20 to 22, a main arithmetic unit (CPU) 26C which can calculate the extension/contraction displacement information of the cylinders 120 to 122 corresponding to angle information obtained by the resolvers 20 to 22 and communicate the cylinder extension/contraction displacement information with the controller 1, an output interface 26D for sending out the cylinder extension/contraction displacement information from the main arithmetic unit (CPU) 26C, and so forth.

By the way, the extension/contraction displacement information θbm, θst and θbk of the cylinders 120 to 122 corresponding to the angle information λbm, λst and λbk obtained by the resolvers 20 to 22 can be calculated using the cosine theorem in accordance with the following expressions:

$$\lambda bm=[L_{101102}^2+L_{101111}^2-2L_{101102}\cdot L_{101111}\cos(\theta bm+Axbm)]^{1/2} \quad (1\text{-}1)$$

$$\lambda st=[L_{103104}^2+L_{104105}^2-2L_{103104}\cdot L_{104105}\cos\theta st]^{1/2} \quad (1\text{-}2)$$

$$\lambda bk=[L_{106107}^2+L_{107109}^2-2L_{106107}\cdot L_{107109}\cos\theta bk]^{1/2} \quad (1\text{-}3)$$

Here, in the expressions above, $L_{ij}$ represents a fixed length, Axbm represents a fixed angle, and the suffix ij to L has information between the nodes i and j. For example, $L_{101102}$ represents the distance between the node 101 and the node 102. It is to be noted that the position of the node 101 is determined as the origin of the xy coordinate system (refer to FIG. 8).

Naturally, each time the angle information θbm, θst and θbk is obtained by the resolvers 20 to 22, the expressions above may be calculated by arithmetic means (for example, the CPU 26C). In this instance, the CPU 26C forms the arithmetic means which calculates, from the angle information obtained by the resolvers 20 to 22, extension/contraction displacement information of the cylinders 120 to 122 corresponding to the angle information by calculation.

It is to be noted that signals obtained by the conversion by the signal converter 26 are utilized not only for feedback control upon semiautomatic control but also to measure coordinates for measurement/indication of the position of the bucket tip 112.

The position of the bucket tip 112 in a semiautomatic control mode is calculated using a certain one point of the upper revolving unit 100 of the hydraulic excavator as the origin. However, when the upper revolving unit 100 is inclined in the front linkage direction, it is necessary to correct the coordinate system for control calculation by an angle by which the vehicle is inclined. The inclination sensor 24 is provided in order to correct the coordinate system.

The solenoid proportional valves 3A to 3C receive control signals from the controller 1 and control the hydraulic pressures supplied from the pilot pump 50, and the controlled hydraulic pressures are passed through the control valves 4A to 4C or the selector valves 18A to 18C so as to act upon the main control valves 13, 14 and 15 to control the spool positions of the main control valves 13, 14 and 15 so that target cylinder velocities may be obtained.

On the other hand, if the control valves 4A to 4C are changed over to the manual mode side, then the cylinders 120 to 122 can be controlled manually.

It is to be noted that a stick confluence control proportional valve 11 adjusts the confluence ratio of the two pumps 51 and 52 in order to obtain an oil amount corresponding to a target cylinder velocity.

Further, the ON-OFF switch (slope face excavation switch) 9 is mounted on the stick operation lever 8, and as an operator operates this switch, selection or no selection of a semiautomatic control mode is performed. Then, if a semiautomatic control mode is selected, then the bucket tip 112 can be moved linearly as described above.

Furthermore, the ON-OFF switch (packet automatic return start switch) 7 is mounted on the boom/bucket operation lever 6, and as an operator switches the switch 7 ON, the bucket 400 can be automatically returned to an angle set in advance.

Safety valves 5 are provided to switch the pilot pressures to be supplied to the solenoid proportional valves 3A to 3C, and only when the safety valves 5 are in an ON state, the pilot pressures are supplied to the solenoid proportional valves 3A to 3C. Accordingly, when some failure occurs in semiautomatic control or in a like case, automatic control can be stopped rapidly by switching the safety valves 5 to an OFF state.

By the way, the rotational speed of the engine 700 is different depending upon the position of the engine throttle set by an operator, and further, even if the engine throttle is fixed, the engine rotational speed varies depending upon the load. Since the pumps 50, 51 and 52 are directly coupled to the engine 700, if the engine rotational speed varies, then also the pump discharges vary, and consequently, even if the spool positions of the main control valves 13, 14 and 15 are fixed, the cylinder velocities are varied by the variation of the engine rotational speed. Thus, in order to correct this, the engine rotational speed sensor 23 is attached to the engine 700. In particular, when the engine rotational speed is low, the target moving velocity of the bucket tip 112 is set slow.

The monitor panel 10 is not only used as a setting unit for the target slope face angle α (refer to FIGS. 8 and 13) and the packet return angle, but also used as an indicator for coordinates of the bucket tip 112, the slope face angle α measured or the distance between coordinates of two points measured. It is to be noted that the monitor panel 10 is provided in the operator cab 600 together with the operation levers 6 and 8.

In particular, in the system according to the present embodiment, the pressure sensors 19 and the pressure switches 16 are incorporated in conventional pilot hydraulic lines to detect operation amounts of the operation levers 6 and 8 and feedback control is effected using the resolvers 20, 21 and 22, and such control makes it possible to effect multiple freedom degree feedback control independently for each of the cylinders 120, 121 and 122. Consequently, the requirement for addition of an oil unit such as a pressure compensation valve is eliminated. It is to be noted that an influence of inclination of the upper revolving unit 100 is corrected using the vehicle inclination angle sensor 24. Further, an operator can select a mode (semiautomatic modes and manual mode) arbitrarily using the change-over switch 9 and besides can set a target slope face angle α.

In the following, a control algorithm of the semiautomatic control mode (except the bucket automatic return mode) effected by the controller 1 is described with reference to FIG. 4.

In particular, the moving velocity and direction of the bucket tip 122 are first calculated based on information of the target slope face set angle, the pilot hydraulic pressures for controlling the stick cylinder 121 and the boom cylinder 120, the vehicle inclination angle and the engine rotational speed. Then, target velocities of the cylinders 120, 121 and 122 are calculated based on the information. In this instance, the information of the engine rotational speed is used to determine an upper limit to the cylinder velocities.

Figure 3:
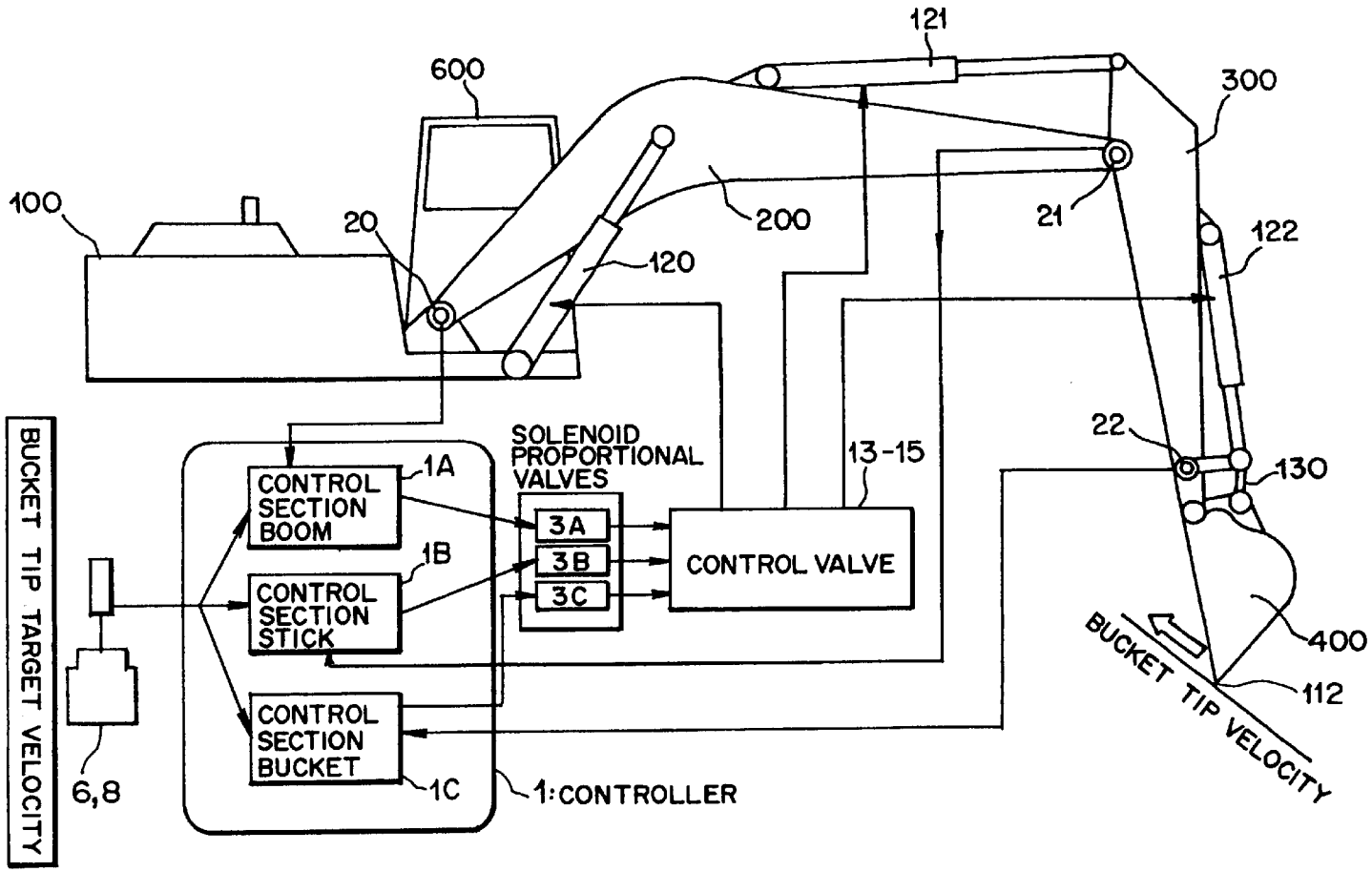
FIG. 3 is a view schematically showing a construction of an entire controlling system of the control apparatus according to the first embodiment of the present invention.
Figure 4:
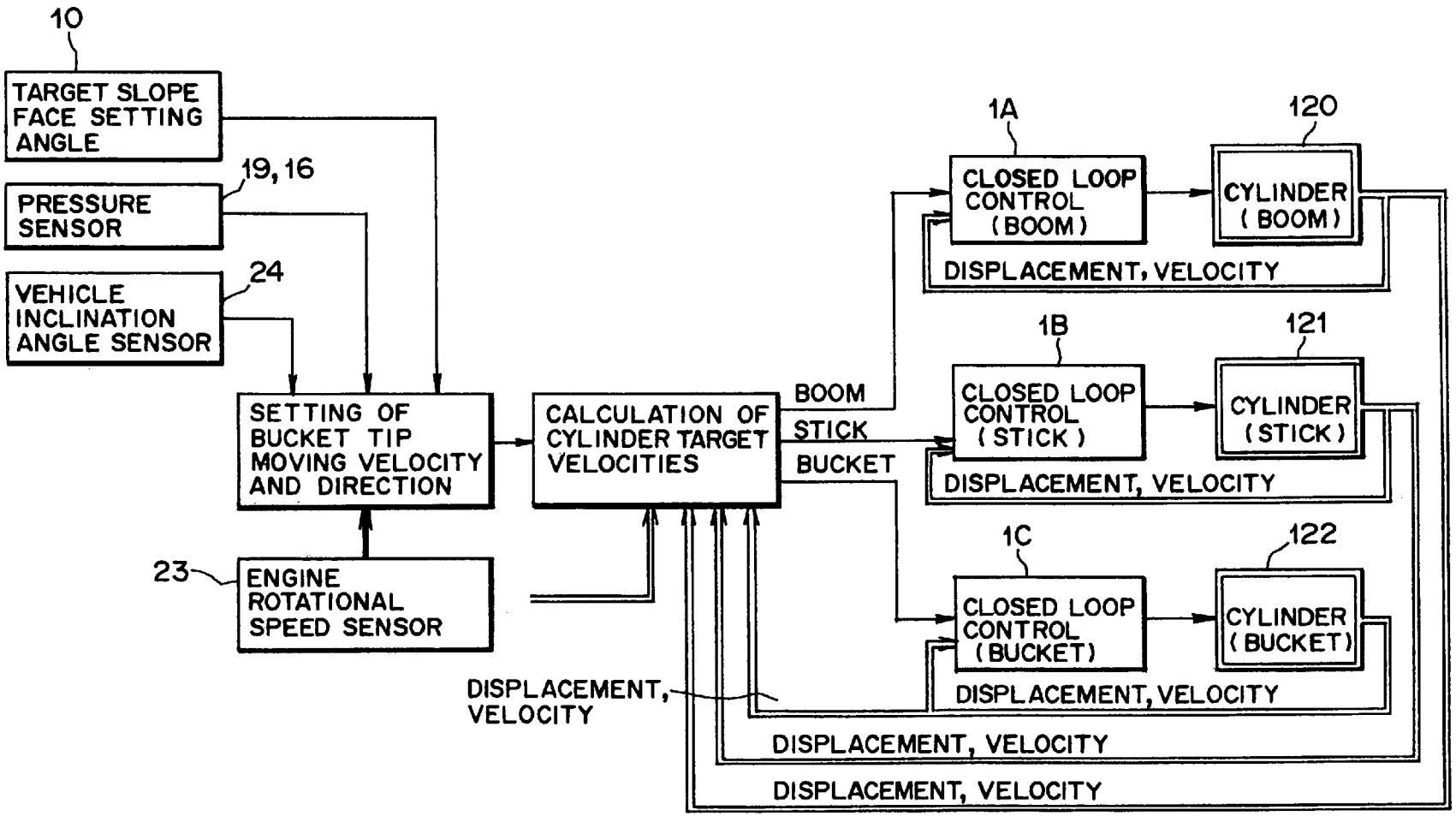
FIG. 4 is a view showing a constriction of the entire control system according to the first embodiment of the present invention.

Further, the controller 1 includes, as shown in FIGS. 3 and 4, control sections 1A, 1B and 1C provided independently of each other for the cylinders 120, 121 and 122, and the controls are constructed as independent control feedback loops as shown in FIG. 4 so that they may not interfere with each other.

Figure 5:
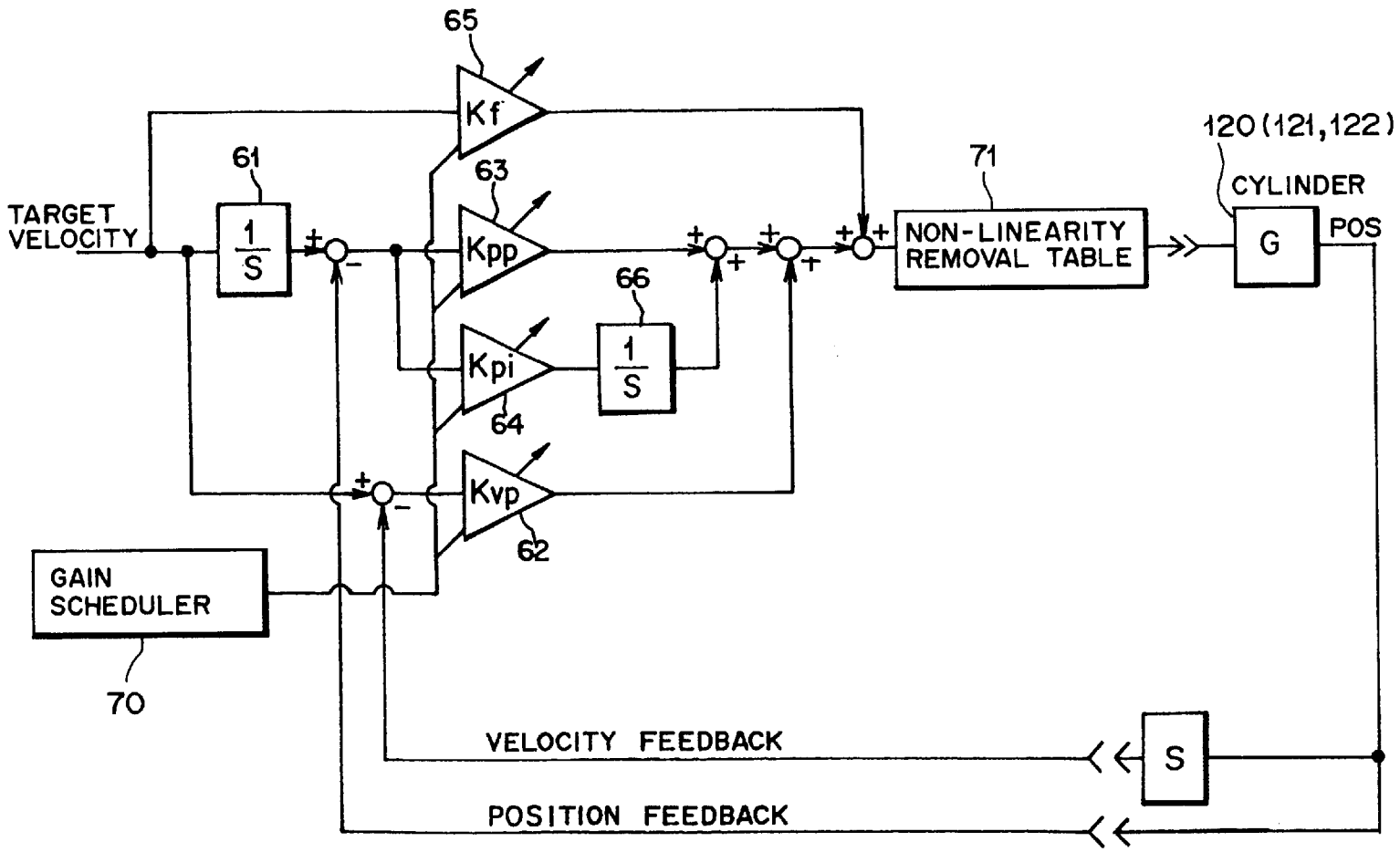
FIG. 5 is a block chart of the control apparatus according to the first embodiment of the present invention.

Further, the compensation construction in the closed loop controls (refer to FIG. 4) has, in each of the control sections 1A, 1B and 1C, a multiple freedom degree construction including a feedback loop and a feedforward loop with regard to the displacement and the velocity as shown in FIG. 5.

In particular, if a target velocity is given, then as regards feedback loop processing, processes according to a route wherein a deviation between the target velocity and feedback information of the cylinder velocity (time differentiation of the cylinder position) is multiplied by a predetermined gain Kvp (refer to reference numeral 62), another route wherein the target velocity is integrated once (refer to an integration element 61 of FIG. 5) and a deviation between the target velocity integration information and displacement feedback information is multiplied by a predetermined gain Kpp (refer to reference numeral 63) and a further route wherein the deviation between the target velocity integration information and the displacement feedback information is multiplied by a predetermined gain Kpi (refer to reference numeral 64) and further integrated (refer to reference numeral 66) are performed while, as regards the feedforward loop processing, a process by a route wherein the target velocity is multiplied by a predetermined gain Kf (refer to reference numeral 65) is performed.

It is to be noted that the values of the gains Kvp, Kpp, Kpi and Kf can be changed by a gain scheduler 70.

Further, while a non-linearity removal table 71 is provided to remove non-linear properties of the solenoid proportional valves 3A to 3C, the main control valves 13 to 15 and so forth, a process in which the non-linearity removal table 71 is used is performed at a high speed by a computer using a table lookup technique.

Figure 6:
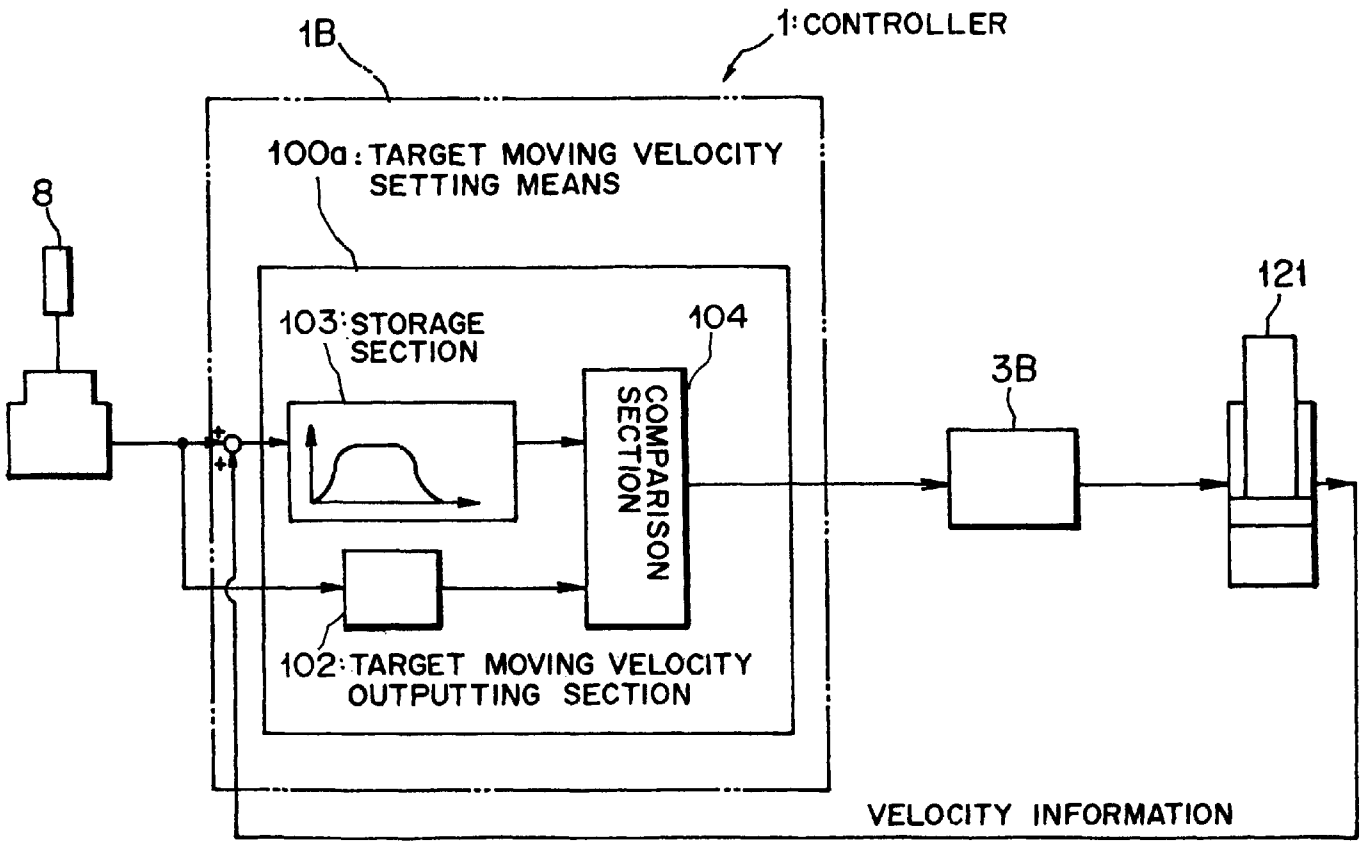
FIG. 6 is a schematic block diagram showing essential part of the control apparatus according to the first embodiment of the present invention.

By the way, while the control section 1A for the boom cylinder 120, the control section 1B for the stick cylinder 121 and the control section 1C for the bucket cylinder 122 are provided independently of each other in the controller 1 as shown in FIGS. 3 and 4, each of the control section 1A for the boom cylinder 120 and the control section 1B for the stick cylinder 121 includes such target moving velocity setting means 100*a* as shown in FIG. 6. It is to be noted that, while FIG. 6 is a block diagram wherein attention is paid to the control section 1B, also the control section 1A of the boom cylinder 120 has a construction similar to that of FIG. 6.

Here, the target moving velocity setting means 100*a* as essential part of the present invention is described. The target moving velocity setting means 100*a* is provided in order to prevent instruction values to the control valves 3A and 3B for the hydraulic cylinders 120 and 121 from varying instantly even if an operator operates the operation lever 6 or 8 suddenly upon starting of an operation or upon ending of an operation by a semiautomatic control mode.

In particular, where such target moving velocity setting means 100*a* as described above is not provided, if an operator operates the operation lever 6 or 8 suddenly upon starting of an operation or the like of a semiautomatic control mode, then control signals to the solenoid valves 3A to 3C suddenly vary instantly. In this instance, the operations of the main control valves (main control valves) 13, 14 and 15 fail to follow up the pilot pressures sent out from the solenoid valves 3A to 3C, and the operations of the hydraulic cylinders 120 to 122 accompany vibrations, an impact or the like and cannot be started or ended smoothly.

This is because, in a semiautomatic control mode, the operation velocities of the stick 300 and the boom 200 are determined in response to the operation amounts of the operation levers 6 and 8, and in order to eliminate such a situation as described above, it is a possible idea to set the moving velocity of the bucket tip 112 so as to gradually increase (ramp up) even if the operation lever 6 or 8 is operated suddenly or to provide a smooth velocity variation through a low-pass filter.

However, since the control signals to the main control valves 13 to 15 of the cylinders 120 to 122 are fed-back information (cylinder velocity information) obtained by time differentiation of the cylinder positions as described with reference to FIG. 5, even if the ramp up process described above or the like is performed, when the operation lever 6 or 8 is operated suddenly, the control signal (instruction value) to the boom cylinder 120 or the stick cylinder 121 still varies instantly and the operations of the boom 200, stick 300 and bucket 400 cannot be started smoothly.

Therefore, in the present invention, the target moving velocity setting means 100*a* is provided in each of the control sections 1A and 1B in the controller 1 so that, even if the operation lever 6 or 8 is operated suddenly upon starting of an operation or upon ending of an operation in such a semiautomatic control mode as described above, the hydraulic cylinders 120 to 122 and the boom 200 and/or the stick 300 may operate smoothly.

Here, the target moving velocity setting means 100*a* includes, as shown in FIG. 6, a target moving velocity outputting section 102, a storage section (memory) 103 and a comparison section 104.

The target moving velocity outputting section 102 outputs target moving velocity data (first target moving velocity data) of the hydraulic cylinders 120 to 122 in accordance with the positions of the operation levers 6 and 8. In particular, in the target moving velocity outputting section 102, a relationship between the operation position of the operation lever 6 or 8 and the target moving velocity of the hydraulic cylinder 120 or 121 is set linearly so that the operation position of the operation lever 6 or 8 may be reflected directly as a target moving velocity of the hydraulic cylinder 120 or 121.

The storage section 103 stores target moving velocity data (second target moving velocity data) with which time differentiation of the target moving velocity characteristic by the operation lever 6 or 8 results in a characteristic of a similar type upon starting of an operation or upon ending of an operation in a semiautomatic control mode.

Figure 7:
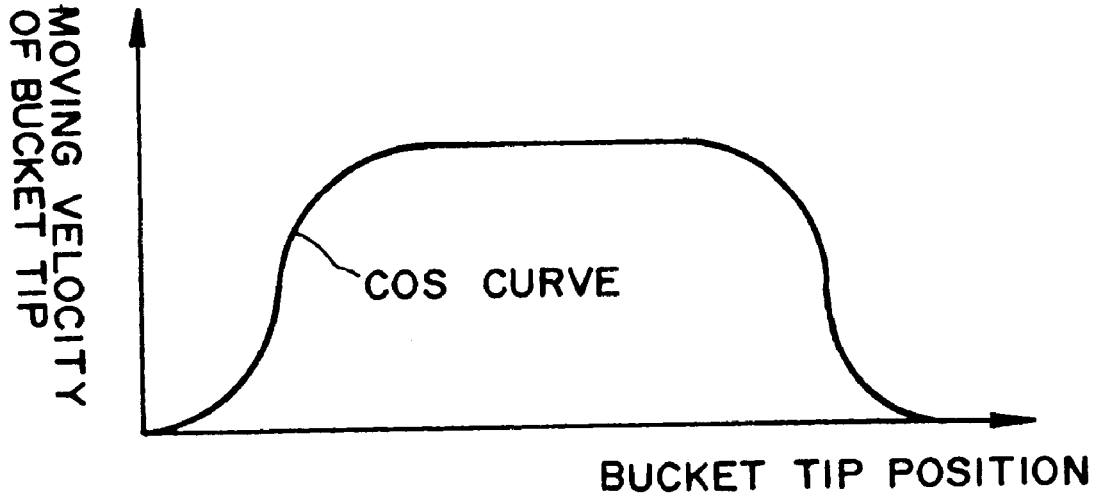
FIG. 7 is a view illustrating a control characteristic of the control apparatus according to the first embodiment of the present invention.

Here, as seen in FIG. 7, in the present embodiment, such target moving velocity data with which the moving velocity of the bucket tip 112 exhibits a cosine wave characteristic (cos curve) upon starting of an operation or upon ending of an operation in a semiautomatic control mode are stored in the storage section 103.

The reason why the target moving velocity characteristic is set so that time differentiation thereof results in a characteristic of a similar type upon starting of an operation or upon ending of an operation in a semiautomatic control mode is that the control valves 13 and 14 which drive the cylinders 120 and 121 feed back cylinder velocity information (that is, differentiation information of the cylinder positions) as seen in FIGS. 4 and 5.

In particular, due to such setting, also velocity information fed back from a target moving velocity can be provided with a characteristic (sin curve) similar to the characteristic (for example, a cos curve) of the target moving velocity information, and control signals produced taking the feedback information into consideration do not vary discontinuously (instantly) and can operate the solenoid valves 3A to 3C continuously and consequently can operate the hydraulic cylinders 120 to 122 smoothly.

Accordingly, even if an operator operates the operation lever 6 or 8 suddenly, for example, upon starting of an operation in a semiautomatic control mode, the instruction values (control signals) to the control valves 13 and 14 can be provided with continuous characteristics.

It is to be noted that the target moving velocity data (second target moving velocity data) stored in the storage section 103 are not limited to such a cosine wave characteristic as shown in FIG. 7, but any data (for example, a sin curve or a natural logarithm curve) may be used if a characteristic of a similar type is obtained by differentiation of the data. However, where a response in operation or the like is taken into consideration, preferably the target moving velocity data are set to a cosine wave characteristic.

The comparison section 104 compares data outputted from the storage section 103 described above and data outputted from the target moving velocity outputting section 102 with each other and outputs a lower one of the data as target moving velocity information.

It is to be noted that such comparison section 104 and target moving velocity outputting section 102 as described above are provided by the following reason.

In particular, the present apparatus is provided to allow the boom 200, stick 300 and bucket 400 and the hydraulic cylinders 120 to 122 to operate smoothly when the operation lever 6 or 8 is operated suddenly upon starting of an operation or the like in a semiautomatic mode, and from such a point of view as just described, only the storage section 103 should be provided, but such target moving velocity outputting section 102 and comparison section 104 as described above need not necessarily be provided. However, for example, where a skilled operator operates, the operator may possibly operate the operation lever 6 or 8 in a condition more appropriate than by such control of the hydraulic cylinders by the storage section 103.

In such a case, the operability is better if the operation of the operator takes precedence to operate the hydraulic cylinders 120 to 122. Further, in this instance, there is little necessity to effect control of the hydraulic cylinders 120 to 122 using data outputted from the storage section 103.

Therefore, such a comparator 104 as described above is provided so that, of data obtained by the target moving velocity outputting section 102 (that is, an operation condition of the operation lever 6 or 8) and data outputted from the storage section 103, lower data, that is, that data which exhibits a smaller variation in target moving velocity, is outputted as target moving velocity information.

Figure 13:
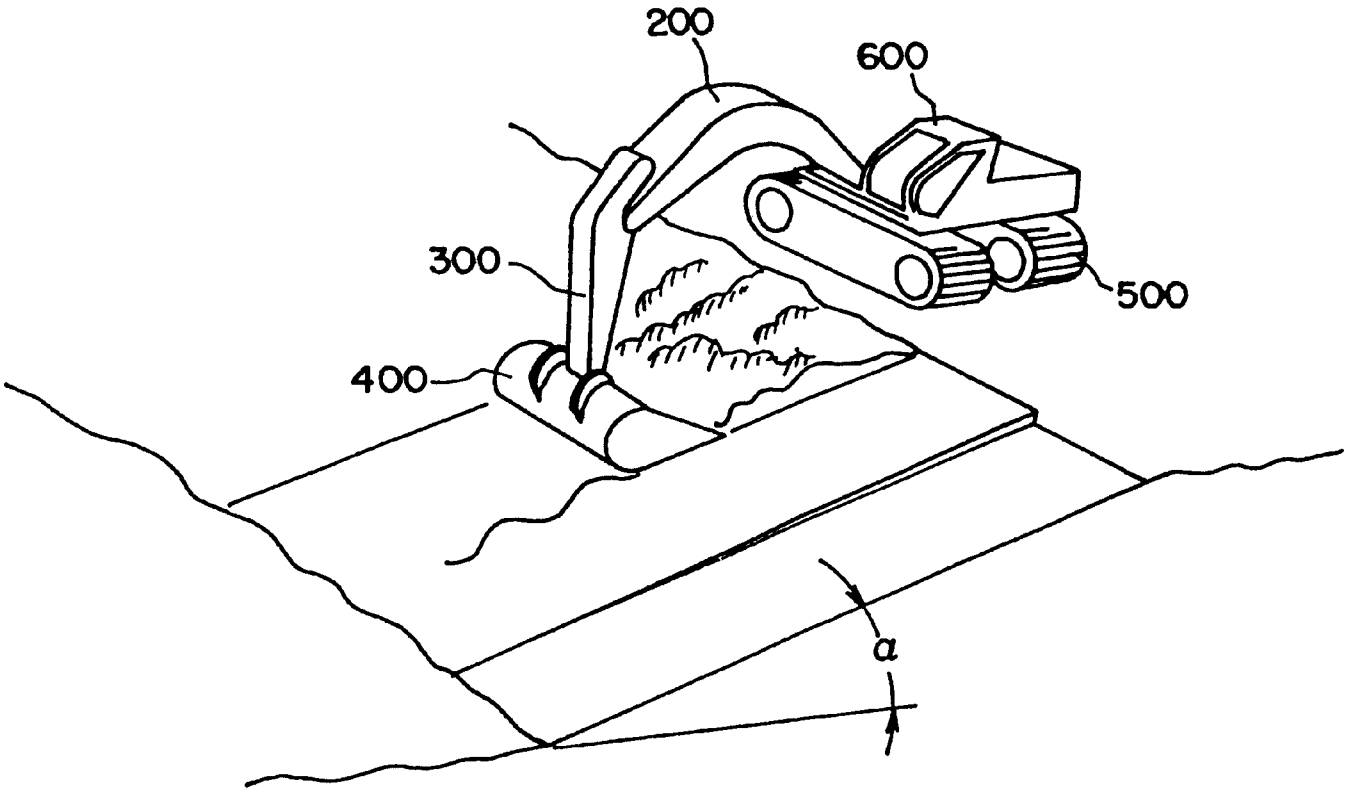
FIG. 13 is a schematic view illustrating an operation of the hydraulic excavator to which the first embodiment of the present invention is applied.
Figure 14:
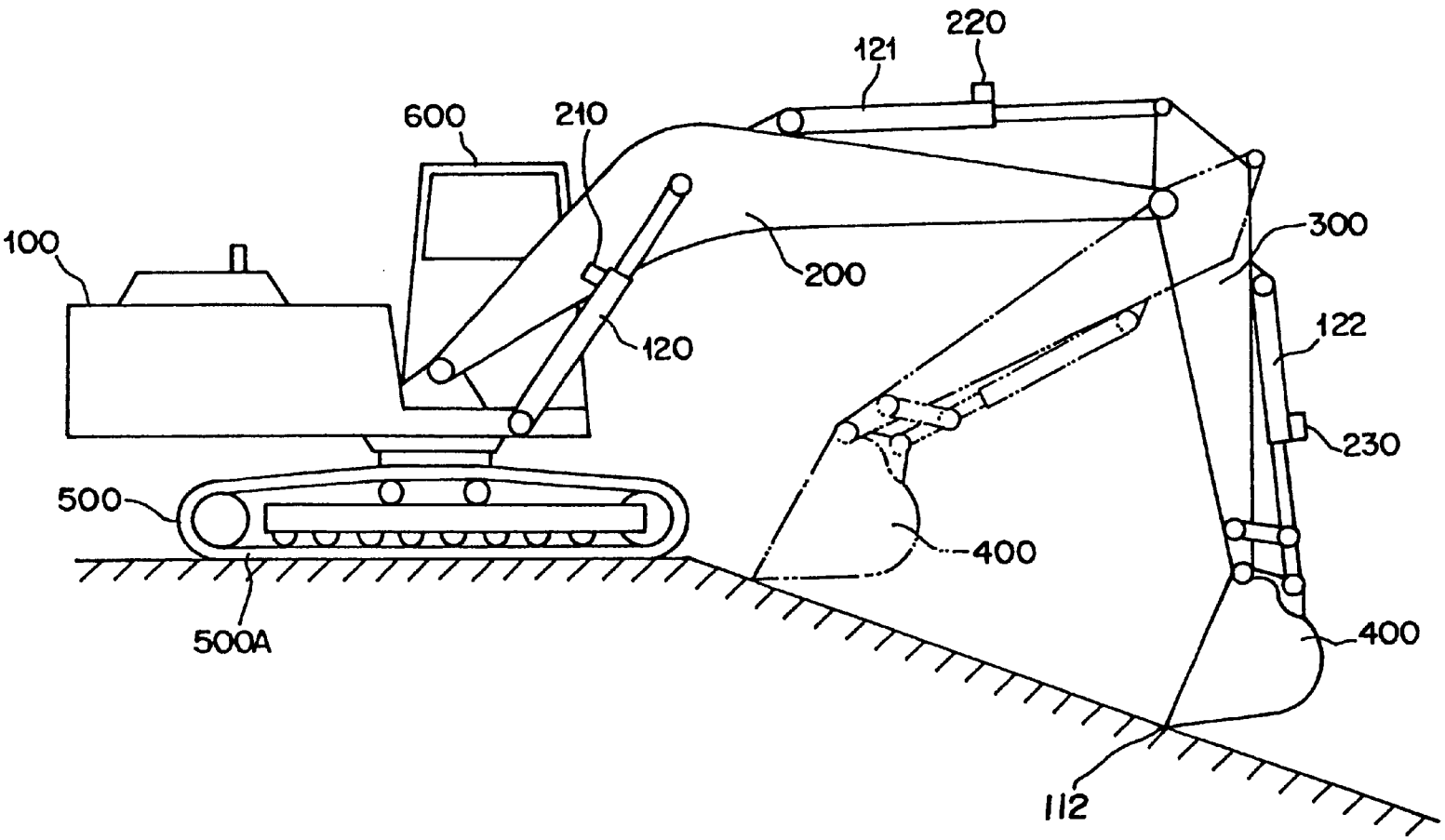
FIG. 14 is a view showing a general construction of a conventional popular hydraulic excavator.

Since the control apparatus for a construction machine according to the first embodiment of the present invention is constructed in such a manner as described above, when such a slope face excavating operation of a target slope face angle $\alpha$ as shown in FIG. 13 is performed by semiautomatic control using the hydraulic excavator, such semiautomatic control functions as described above can be realized.

In particular, when detection signals (including setting information of a target slope face angle $\alpha$) from the various sensors are inputted to the controller 1 mounted on the hydraulic excavator, the controller 1 sets control signals for the solenoid proportional valves 3A, 3B and 3C based on the detection signals from the sensors (including detection signals of the resolvers 20 to 22 received via the signal converter 26) and operation conditions of the operation levers 6 and 8.

Then, the main control valves 13, 14 and 15 operate in response to pilot hydraulic pressures from the solenoid proportional valves 3A, 3B and 3C to control the boom 200, stick 300 and bucket 400 so that they may exhibit desired extension/contraction displacements thereby to effect such semiautomatic control as described above.

Meanwhile, upon the semiautomatic control, the moving velocity and direction of the bucket tip 112 are first calculated from information of the target slope face set angle, the pilot hydraulic pressures which are set based on the operation conditions of the operation levers 6 and 8 and control the stick cylinder 121 and the boom cylinder 120, the vehicle inclination angle, the engine rotational speed and so forth, and target velocities of the cylinders 120, 121 and 122 are calculated based on the information. In this instance, the information of the engine rotational speed is required when an upper limit to the cylinder velocities is determined. Further, since such controls are constructed as the feedback loops independent of each other for the cylinders 120, 121 and 122, they do not interfere with each other.

Particularly, in the present apparatus, since such target moving velocity setting means 100*a* as seen in FIG. 5 are provided in the controller 1, even if an operator operates the operation lever 6 or 8 suddenly upon starting of an operation or upon ending of an operation in a semiautomatic control mode, the boom 200, stick 300 and bucket 400 operate smoothly.

In particular, while information obtained by time differentiation of the positions of the hydraulic cylinders 120 to 122 is fed back into the controller 1 as seen in FIGS. 4 and 5, since, in the present invention, the characteristic of the target moving velocity is set by the storage section 103 so that the differentiation information to be fed back and the target moving velocity characteristic upon starting of an operation or upon ending of an operation set by the operation levers 6 and 8 may have characteristics of a similar type as seen in FIGS. 6 and 7, control signals outputted to the solenoid valves 3A to 3C become continuous control signals, and the control signals are suppressed from varying instantly suddenly.

Accordingly, such a situation that, upon starting of an operation or upon ending of an operation by semiautomatic control, the operations of the main control valves 13, 14 and 15 fail to follow up pilot pressures sent out from the solenoid valves 3A to 3C can be eliminated, and the boom 200, stick 300 and bucket 400 can operate smoothly.

Further, in the present apparatus, since the target moving velocity outputting section 102 which outputs target moving velocity data (first target moving velocity data) of the hydraulic cylinders 120 to 122 in accordance with the positions of the operation levers 6 and 8 and the comparison section 104 which compares data outputted from the storage section 103 and the data (second target moving velocity data) outputted from the target moving velocity outputting section 102 with each other and outputs a lower one of the data as target moving velocity information are provided, for example, if a skilled operator operates the operation lever 6 or 8 in a condition more appropriate than by control of the hydraulic cylinders by the storage section 103, the operation by the operator takes precedence to control the operations of the hydraulic cylinders 120 to 122, and consequently, the operability is not deteriorated.

It is to be noted that the setting of the target slope face angle $\alpha$ in the semiautomatic system can be performed by a method which is based on inputting of a numerical value by switches on the monitor panel 10, a two point coordinate inputting method, or an inputting method by a bucket angle, and similarly, for the setting of the bucket return angle in the semiautomatic system, a method which is based on inputting of a numerical value by the switches on the monitor panel 10 or a method which is based on bucket movement is performed. For all of them, known techniques are used.

Further, the semiautomatic control modes described above and the controlling methods therein are performed in the following manner based on cylinder extension/contraction displacement information obtained by conversion by the signal converter 26 of the angle information detected by the resolvers 20 to 22.

First, in the bucket angle control mode (refer to FIG. 9), the length of the bucket cylinder 122 is controlled so that the angle (bucket angle) $\phi$ defined between the bucket 400 and the x axis may be fixed at each arbitrary position. In this instance, the bucket cylinder length $\lambda bk$ can be calculated using the boom cylinder length $\lambda bm$, the stick cylinder length $\lambda st$ and the angle $\phi$ mentioned above as parameters.

In the smoothing mode (refer to FIG. 11), since the bucket angle $\phi$ is kept fixed, the bucket tip position 112 and a node 108 move in parallel. First, a case wherein the node 108 moves in parallel to the x axis (horizontal excavation) is described below.

In particular, in this instance, the coordinates of the node 108 in the linkage posture when excavation is started are represented by $(x_{108}, y_{108})$ , and the cylinder lengths of the boom cylinder 120 and the stick cylinder 121 in the linkage posture in this instance are calculated and the velocities of the boom 200 and the stick 300 are calculated so that $x_{108}$ may move horizontally. It is to be noted that the moving velocity of the node 108 depends upon the operation amount of the stick operation lever 8.

On the other hand, where parallel movement of the node 108 is considered, the coordinates of the node 108 after the very short time $\Delta t$ are represented by $(x_{108}+\Delta x, y_{108})$. $\Delta x$ is a very small displacement which depends upon the moving velocity. Accordingly, by taking $\Delta x$ into consideration of $x_{108}$, target lengths of the boom and stick cylinders after $\Delta t$ can be calculated.

In the slope face excavation mode (refer to FIG. 10), control is performed in a similar manner as in the smoothing mode. However, the point which moves is changed from the node 108 to the bucket tip position 112, and further, the control takes it into consideration that the bucket cylinder length $\lambda bk$ is fixed.

Figure 8:
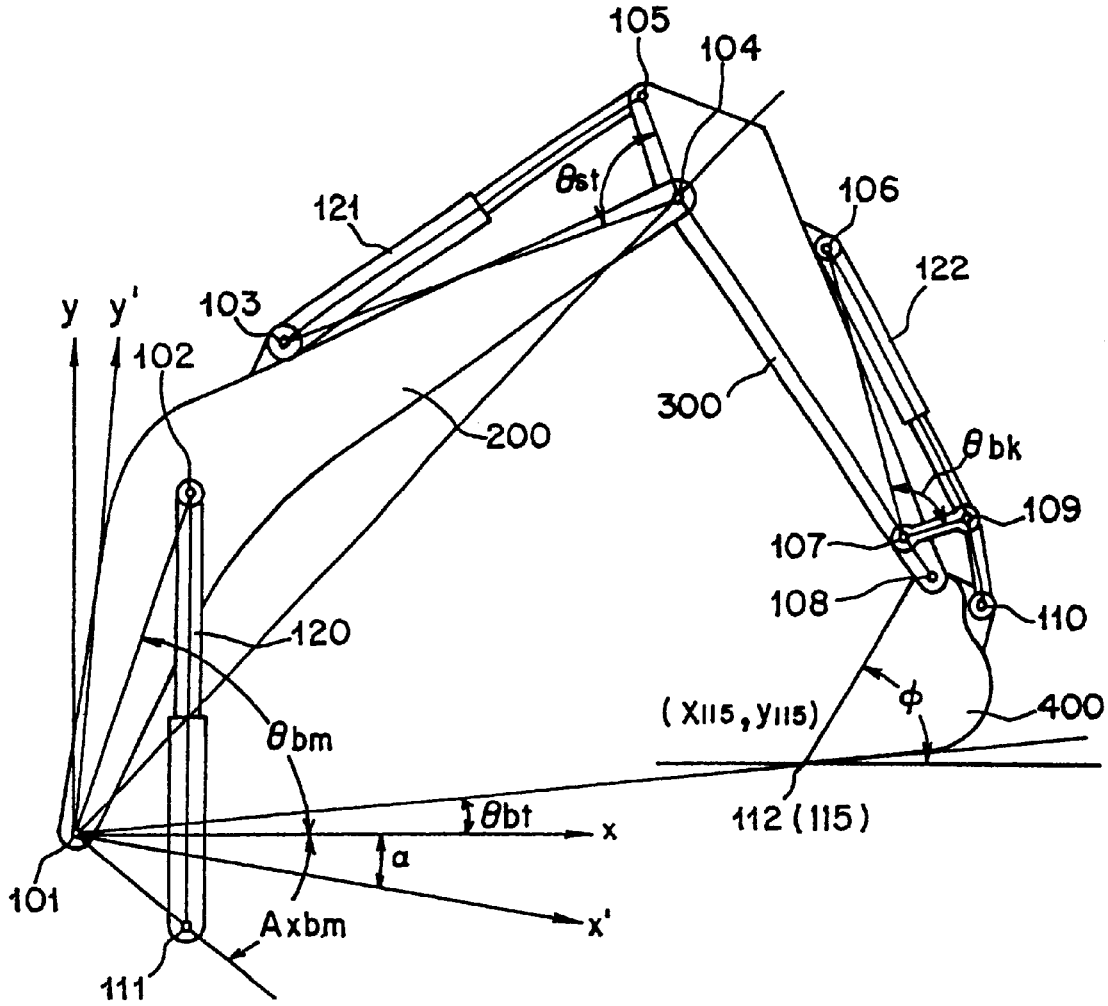
FIG. 8 is a schematic view of operating parts of the hydraulic excavator to which the first embodiment of the present invention is applied.

Further, in correction of a finish inclination angle by the vehicle inclination angle sensor 24, calculation of the front linkage position is performed on the xy coordinate system whose origin is a node 101 of FIG. 8. Accordingly, if the vehicle body is inclined with respect to the xy plane, then the xy coordinates are inclined with respect to the ground surface (horizontal plane), and the target inclination angle with respect to the ground surface is varied. In order to correct this, the inclination angle sensor 24 is mounted on the vehicle, and when it is detected by the inclination angle sensor 24 that the vehicle body is inclined by $\beta$ with respect to the xy plane, the target inclination angle is corrected by replacing it with a value obtained by adding $\beta$ to it.

Prevention of deterioration of the control accuracy by the engine rotational speed sensor 23 is such as follows. In particular, with regard to correction of the target bucket tip velocity, the target bucket tip velocity depends upon the operation positions of the stick and boom operation levers 6 and 8 and the engine rotational speed. Meanwhile, since the hydraulic pumps 51 and 52 are directly coupled to the engine 700, when the engine rotational speed is low, also the pump discharges are small and the cylinder velocities are low. Therefore, the engine rotational speed is detected, and the target bucket tip velocity is calculated so as to conform with the variation of the pump discharges.

Meanwhile, with regard to correction of the maximum values of the target cylinder velocities, correction is performed taking it into consideration that the target cylinder velocities are varied by the posture of the linkage and the target slope face inclination angle and that, when the pump discharges decrease as the engine rotational velocity decreases, also the maximum cylinder velocities must be decreased. It is to be noted that, if a target cylinder velocity exceeds its maximum cylinder velocity, then the target bucket tip velocity is decreased so that the target cylinder velocity may not exceed the maximum cylinder velocity.

While the various control modes and the controlling methods in the control modes are described above, they all employ a technique wherein they are performed based on cylinder extension/contraction displacement information, and control contents according to this technique are publicly known. In particular, in the system according to the present embodiment, since angle information is detected first by the resolvers 20 to 22 and then the angle information is converted into cylinder extension/contraction displacement information by the signal converter 26, the known controlling technique can be used for later processing.

While various controls are performed by the controller 1 in this manner, in the system according to the present invention, since angle information signals detected by the resolvers 20 to 22 are converted into cylinder displacement information by the signal converter 26 and then inputted to the controller 1, control in which cylinder extension/contraction displacements which are used in a conventional control system are used can be executed even if an expensive stroke sensor for detecting an extension/contraction displacement of each of the cylinders for the boom 200, stick 300 and bucket 400 as in the prior art is not used. Consequently, while the cost is suppressed low, a system which can control the position and the posture of the bucket 400 accurately and stably can be provided.

Further, since the feedback control loops are independent of each other for the cylinders 120, 121 and 122 and the control algorithm is multiple freedom control of the displacement, velocity and feedforward, the control system can be simplified. Further, since the non-linearity of a hydraulic apparatus can be converted into linearity at a high speed by a table lookup technique, the present system contributes also to augmentation of the control accuracy.

Furthermore, since deterioration of the control accuracy by the position of the engine throttle and the load variation is corrected by correcting the influence of the vehicle inclination by the vehicle inclination sensor 24 or reading in the engine rotational speed, the present system contributes to realization of more accurate control.

Further, since also maintenance such as gain adjustment can be performed using the external terminal 2, also an advantage that adjustment or the like is easy can be obtained.

Furthermore, since operation amounts of the operation levers 7 and 8 are calculated based on variations of the pilot pressures using the pressure sensors 19 and so forth and besides a conventional open center valve hydraulic system is utilized as it is, there is an advantage that addition of a pressure compensation valve or the like is not required, and also it is possible to display the bucket tip coordinates on the real time basis on the monitor panel 10 with a target slope face angle setting unit. Further, due to the construction which employs the safety valve 5, also an abnormal operation when the system is abnormal can be prevented.

Meanwhile, the target moving velocity data (second target moving velocity data, refer to FIG. 6) stored in the storage section 103 of the controller 1 are not limited to such a cosine wave characteristic as shown in FIG. 7, but any data (for example, a sin curve or a natural logarithm curve) may be used if a characteristic of a similar type is obtained by differentiation of the data. However, where a response in operation or the like is taken into consideration, preferably the target moving velocity data are set to a cosine wave characteristic.

Further, while, in the present first embodiment, a target moving velocity characteristic upon starting of an operation and a target moving velocity characteristic upon ending of an operation are set to the same characteristic (that is, a cosine wave characteristic), the target moving velocity characteristics upon starting of an operation and upon ending of an operation may be different from each other if a characteristic of a similar type is obtained by differentiation.

(2) Description of the Second Embodiment

In the following, a control apparatus for a construction machine according to a second embodiment is described principally with reference to FIGS. 15 to 19. It is to be noted that the general construction of a construction machine to which the present second embodiment is applied is similar to the contents described hereinabove with reference to FIG. 1 and so forth in connection with the first embodiment described above, and the general construction of controlling systems of the construction machine is similar to the contents described hereinabove with reference to FIGS. 2 to 4 in connection with the first embodiment described above. Further, the forms of representative semiautomatic modes of the construction machine are similar to the contents described hereinabove with reference to FIGS. 9 to 14 in connection with the first embodiment described above. Therefore, description of portions corresponding to them is omitted, and in the following, description principally of differences from the first embodiment is given.

Now, the present second embodiment is constructed such that stabilized control can be performed against load variations to the hydraulic cylinders or a temperature variation of the operating oil.

In particular, it is supposed that, in an operation (such as a horizontal leveling operation) of moving the bucket tip position linearly by the slope face excavation mode in semiconductor control, the loads to the hydraulic cylinders 120 to 122 during an excavation operation are varied by the shape of the ground, the excavation amount or the like. In such a case, where conventional PID control is employed, there is the possibility that the degrees of positioning accuracy of the hydraulic cylinders 120 to 122 or the degree of accuracy of the locus of the bucket tip position may be deteriorated.

Further, where feedback control is performed for the hydraulic cylinders 120 to 122, also it is supposed that variations of the dynamic characteristics of control objects (for example, the hydraulic cylinders 120 to 122 or the solenoid valves provided in the hydraulic circuits) arising from a temperature variation of the operating oil have an influence on the control performances of the closed loops, resulting in deterioration of the stability of the controlling systems.

In order to eliminate such a situation as described above, the control gains of the closed loops should be reduced to increase the gain margins or the phase margins. However, it is supposed that this may result in deterioration of the degrees of positioning accuracy of the hydraulic cylinders 120 to 122 or of the degree of accuracy of the locus of the bucket tip position.

The control apparatus for a construction machine according to the second embodiment of the present invention is constructed so as to solve such subjects as described above and allows stable control against load variations to the hydraulic cylinders or a temperature variation of the operating oil.

First, a control algorithm of the semiautomatic control mode (except the bucket automatic return mode) which is performed by the controller 1 in the present second embodiment is described with reference to FIG. 15. Target value setting means 80 is provided in the controller 1, and target velocities (target operation information) of the boom 200, the bucket 400 and so forth are set in accordance with the positions of operation levers 6 and 8.

In particular, the moving velocity and direction of the bucket tip 112 are first calculated from information of a target slope face set angle, pilot hydraulic pressures which control the stick cylinder 121 and the boom cylinder 120, a vehicle inclination angle and an engine rotational speed. Then, target velocities of the cylinders 120, 121 and 122 are calculated based on the information. In this instance, the information of the engine rotational speed is used as a parameter for determining an upper limit to the cylinder velocities.

Meanwhile, the controller 1 includes control sections 1A, 1B and 1C independent of each other for the cylinders 120, 121 and 122, and the individual controls are formed as independent control feedback loops and do not interfere with each other (refer to FIGS. 3 and 4).

Here, essential part of the control apparatus for a constriction machine of the present embodiment is described. The compensation construction in the closed loop controls (refer to FIG. 4) has, in each of the control sections 1A, 1B and 1C, a multiple freedom degree construction including a feedback loop and a feedforward loop with regard to the displacement and the velocity as shown in FIG. 15, and includes feedback loop type compensation means 72 having a variable control gain (control parameter), and feedforward type compensation means 73 having a variable control gain (control parameter).

In particular, if a target velocity is given, then feedback loop processes according to a route wherein a deviation between the target velocity and velocity feedback information is multiplied by a predetermined gain Kvp (refer to reference numeral 62), another route wherein the target velocity is integrated once (refer to an integration element 61 of FIG. 15) and a deviation between the target velocity integration information and displacement feedback information is multiplied by a predetermined gain Kpp (refer to reference numeral 63) and a further route wherein the deviation between the target velocity integration information and the displacement feedback information is multiplied by an I gain coefficient (refer to reference symbol 64*a*) and a predetermined gain Kpi (refer to reference numeral 64) and further integrated (refer to reference numeral 66) are performed by the feedback loop type compensation means 72 while, by the feedforward type compensation means 73, a feedforward loop process by a route wherein the target velocity is multiplied by a predetermined gain Kf (refer to reference numeral 65) is performed.

Of the processes mentioned, the feedback loop processes are described in more detail. The present apparatus includes, as shown in FIG. 15, operation information detection means 91 for detecting operation information of the cylinders 120 to 122, and the controller 1 receives the detection information from the operation information detection means 91 and target operation information (for example, target moving velocities) set by the target value setting means 80 as input information and sets control signals so that the arms such as the boom 200 and the working member (bucket) 400 may exhibit target operation conditions.

Further, the operation information detection means 91 particularly is cylinder position detection means 83 which can detect positions of the hydraulic cylinders 120 to 122, and in the present embodiment, the cylinder position detection means 83 is composed of the resolvers resolvers 20 to 22 and the signal converter 26 described hereinabove. The cylinder position detection means 83 also has a function as operation condition detection means 90 which will be hereinafter described, and detection means 93 is composed of such operation information detection means 91 as described above and the operation condition detection means 90 which will be hereinafter described.

Meanwhile, the values of the gains Kvp, Kpp, Kpi and Kf mentioned above can individually be varied by the gain scheduler (control parameter scheduler) 70, and the boom 200, the bucket 400 and so forth can be controlled to target operation conditions by varying or correcting the values of the gains Kvp, Kpp, Kpi and Kf in this manner.

Figure 15:
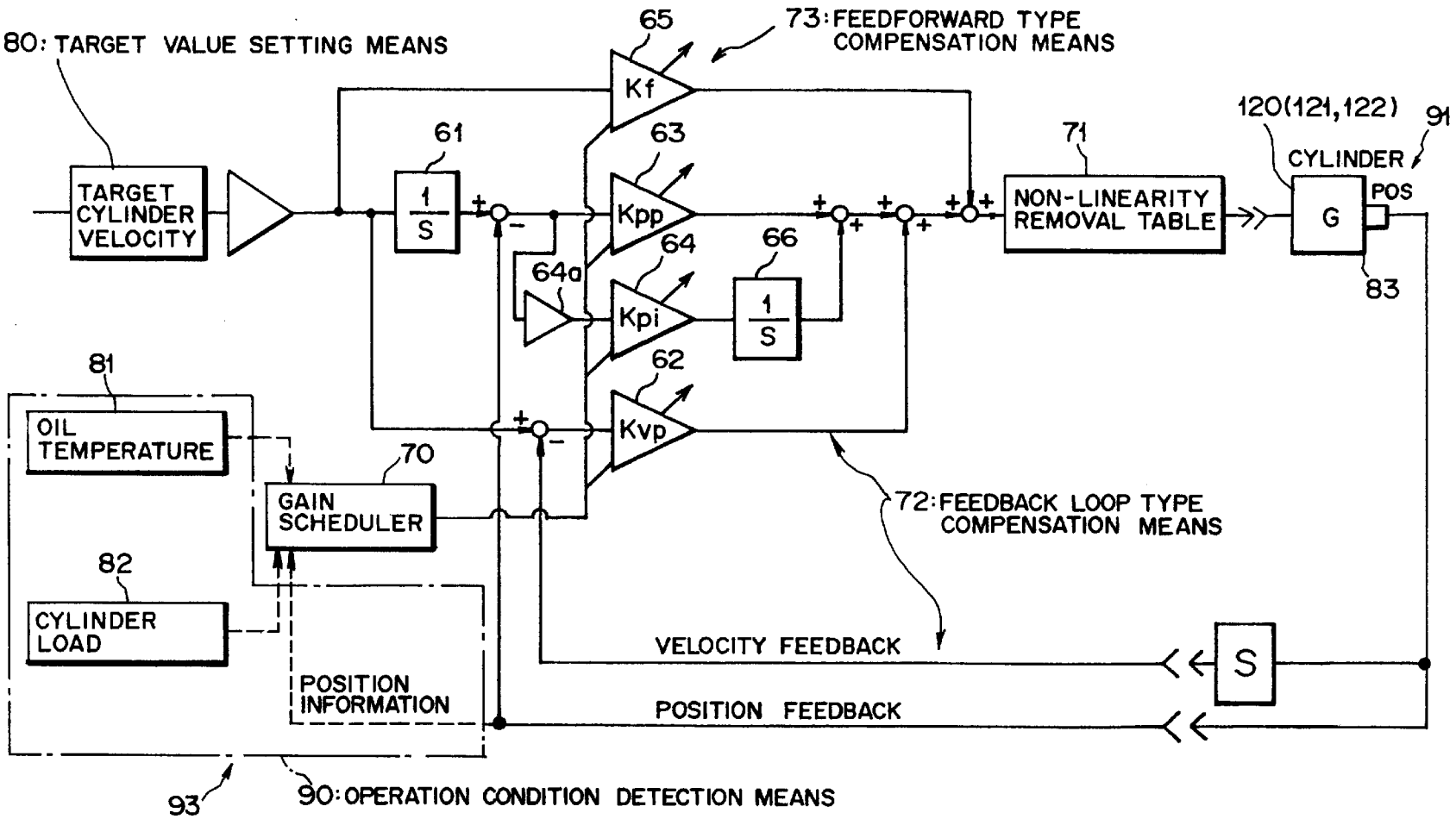
FIG. 15 is a control block diagram of essential part according to a second embodiment of the present invention.

In particular, the present apparatus includes, as shown in FIG. 15, operation condition detection means 90 which in turn includes oil temperature detection means 81 for detecting the oil temperature of the operating oil, cylinder load detection means 82 for detecting the loads to the cylinders 120 to 122, and cylinder position detection means 83 for detecting position information of the cylinders. The gain scheduler 70 varies the gains Kvp, Kpp, Kpi and Kf based on the detection information from the operation condition detection means 90 (that is, operation information of the construction machine).

The oil temperature detection means 81 is a temperature sensor provided in the proximity of the solenoid proportional valve 3A, 3B or 3C, and the gain scheduler 70 corrects the gains in response to the temperature relating to the cylinders 120 to 122.

Here, the temperature relating to the hydraulic cylinders 120 to 122 is, for example, the temperature of controlling oil (pilot oil), and here, the temperature of the pilot oil is detected as a representative oil temperature which represents the temperature of the operating oil.

Figure 16:
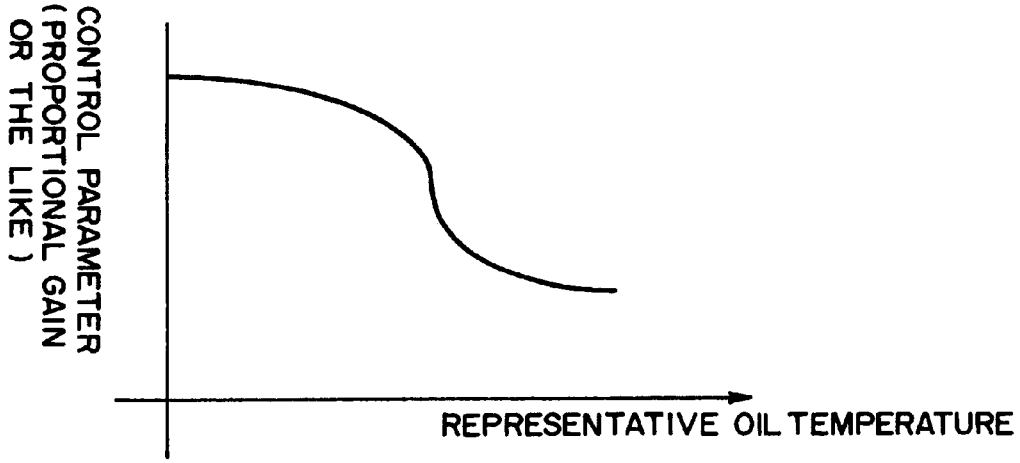
FIG. 16 is a view for explaining a characteristic of correction of a control gain of the control apparatus according to the second embodiment of the present invention.

Meanwhile, a map having such a characteristic as illustrated in FIG. 16 is stored in the gain scheduler 70, and the gains Kvp, Kpp, Kpi and Kf are corrected using representative oil temperature information detected by the oil temperature detection means 81.

Here, a characteristic of the gain correction illustrated in FIG. 16 is described briefly. The gain correction characteristic is basically set to such a characteristic that the gains are lowered as the oil temperature of the pilot oil rises. This is because it is intended to prevent the control performances of the closed loops from being deteriorated by variations of the dynamic characteristics of control objects such as the hydraulic cylinders 120 to 122, the solenoid valves 3A to 3C or the like caused by temperature variations of the operating oil and it is intended to keep the stability of the controlling systems.

It is to be noted that such a representative oil temperature as described above is not limited to the temperature of the pilot oil described above, but the temperature of the main operating oil used for control (operating oil supplied to or discharged from oil chambers of the cylinders 120 to 122) may be used as a representative oil temperature. In this instance, preferably a temperature sensor is provided in an operating oil tank.

Further, the gains Kvp, Kpp, Kpi and Kf may be corrected using both of the temperature of the pilot oil and the temperature of the main operating oil for control (in the following description, such main operating oil temperature is referred to as tank oil temperature). In this instance, a representative oil temperature is calculated, for example, in accordance with the following expression:

$$\text{Representative oil temperature} = \text{tank oil temperature} \times W + \text{pilot oil temperature} \times (1-W)$$

In the expression above, W is a coefficient to be used for weighting representing which one of the tank oil temperature and a pilot oil temperature should be taken into consideration preferentially as a representative oil temperature, and is set within a range of $0 \leqq W \leqq 1$. As W approaches 1, the representative oil temperature takes the tank oil temperature into consideration with a higher degree of preference, but as W approaches 0, the representative oil temperature takes the pilot oil temperature into consideration with a higher degree of preference.

Figure 17:
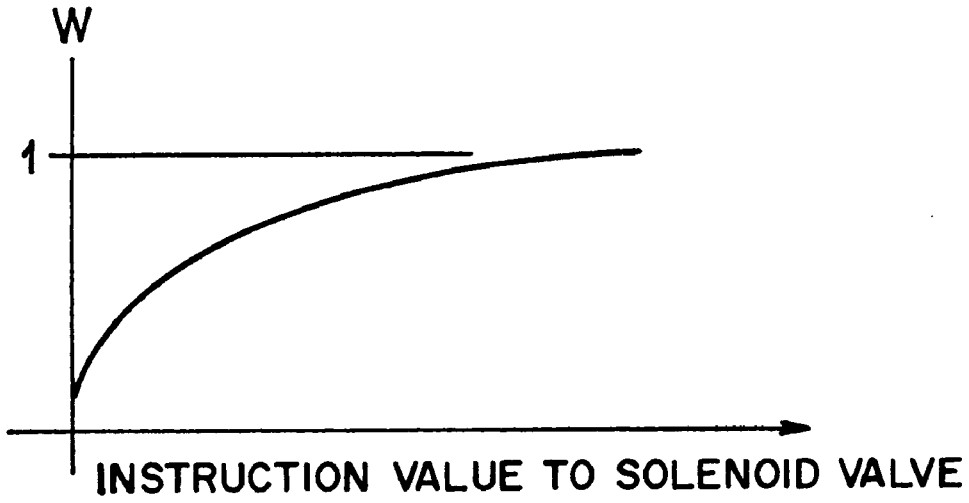
FIG. 17 is a view for explaining a characteristic of correction of a control gain of the control apparatus according to the second embodiment of the present invention.

Further, the weight coefficient W is set to such a characteristic as illustrated in FIG. 17, and is set such that, as the instruction values (solenoid valve driving currents) for the solenoid valves 3A to 3C decreases, W approaches 0, but as the instruction value increases, W approaches 1.

This is because, when the instruction values to the solenoid valves 3A to 3C are small, that is, when it is intended to cause the solenoid valves 3A to 3C and the cylinders 120 to 122 to operate comparatively slowly, a variation of the pilot oil temperature has a significant influence on the dynamic characteristics of the controlling systems. Also there is another reason that, when the openings of the solenoid valves 3A to 3C are very small, the influence of the pilot oil temperature is significant.

It is to be noted that, where the gains Kvp, Kpp, Kpi and Kf are corrected using both of the pilot oil temperature and the tank oil temperature as described above, such a map as shown in FIG. 17 is provided in the oil temperature detection means 81, and only information of a representative oil temperature calculated in the oil temperature detection means 81 is inputted to the gain scheduler 70.

Subsequently, the cylinder load detection means 82 which composes the operation condition detection means 90 is described. The cylinder load detection means 82 detects loads to the cylinders 120 and 121, and the gain scheduler 70 fetches the load information of the cylinders 120 and 121 and corrects the proportional gains Kpp and Kf.

It is to be noted that the cylinder load detection means 82 is composed particularly of the pressure sensors 28A and 28B shown in FIG. 2 and so forth, and detects loads to the cylinders 120 to 122 based on information from the pressure sensors 28A and 28B and so forth.

Figure 18:
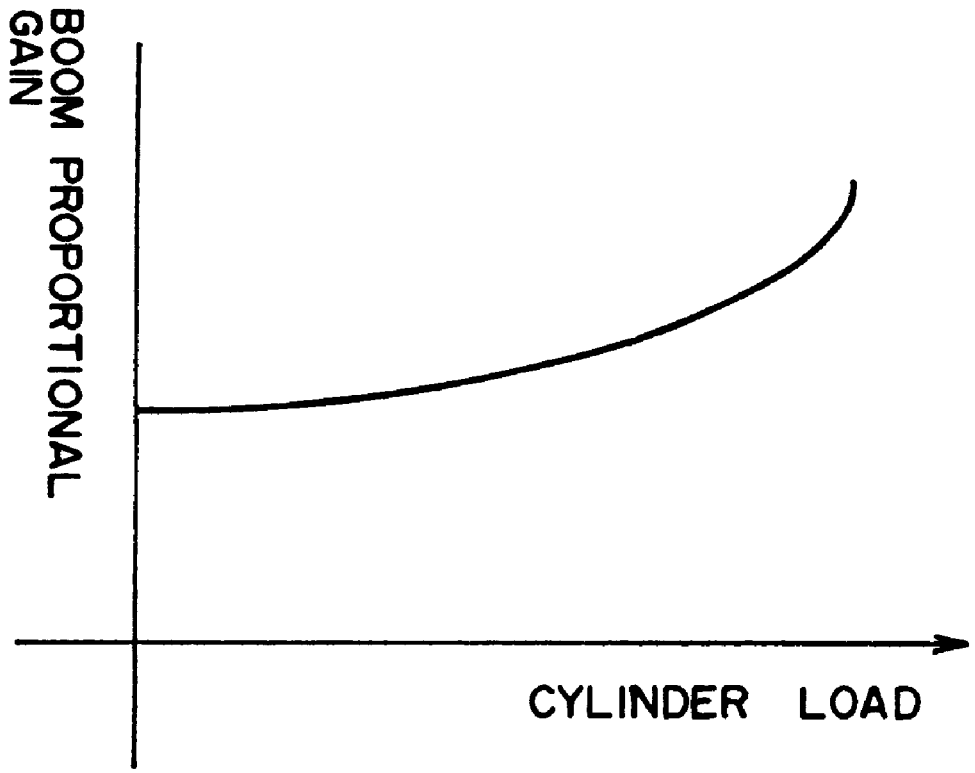
FIG. 18 is a view for explaining a characteristic of correction of a control gain of the control apparatus according to the second embodiment of the present invention.

Meanwhile, a map having such a characteristic as illustrated in FIG. 18 is stored in the gain scheduler 70, and the gain scheduler 70 corrects the gains Kpp and Kf using load information of the cylinders 120 to 122 detected by the cylinder load detection means 82 and the map illustrated in FIG. 18.

It is to be noted that, since generation of noise or the like is supposed if correction of the gains Kvp and Kpi is performed, in the present embodiment, correction of the gains Kvp and Kpi based on the cylinder loads is not performed.

Here, a characteristic of the map illustrated in FIG. 18 is described briefly. In this correction map for the proportional gains Kpp and Kf, the proportional gains Kpp and Kf are gradually increased as the cylinder load increases. In other words, where the loads acting upon the hydraulic cylinders 120 and 121 are high in this manner, the gains are increased because damping increases.

Then, control deviations can be reduced by correcting (scheduling) the control gains Kpp and Kf of the PID feedback type compensation means 72 and the feedforward type compensation means 73 in response the cylinder loads to the boom 200, stick 300 and bucket 400 in this manner, and accurate control of the boom 200, stick 300 and bucket 400 can be realized.

Subsequently, the cylinder position detection means 83 which composes the operation condition detection means 90 is described. The cylinder position detection means 83 detects actual cylinder positions of the boom cylinder 120 and the stick cylinder 121 and is composed of the resolvers 20 to 22 and the signal converter 26.

Here, in the present embodiment, the cylinder positions are detected by fetching angle information detected by the resolvers 20 to 22 into the signal converter 26 and converting the angle information into cylinder displacement information in the signal converter 26.

Then, the gain scheduler 70 fetches also the position information of the hydraulic cylinders 120 and 121 and corrects the proportional gains Kpp and Kf of the boom 200 and the stick 300.

It is to be noted that, while such correction of the proportional gains Kpp and Kf based on the cylinder positions is performed principally for the boom cylinder 120 and the stick cylinder 121, this is because the loads applied upon working in such semiautomatic control modes as described above almost act upon the boom cylinder 120 and the stick cylinder 121.

Further, the gain scheduler 70 includes a map (refer to FIG. 19) for varying the gains Kpp and Kf based on detection information from the cylinder position detection means 83.

Figure 19:
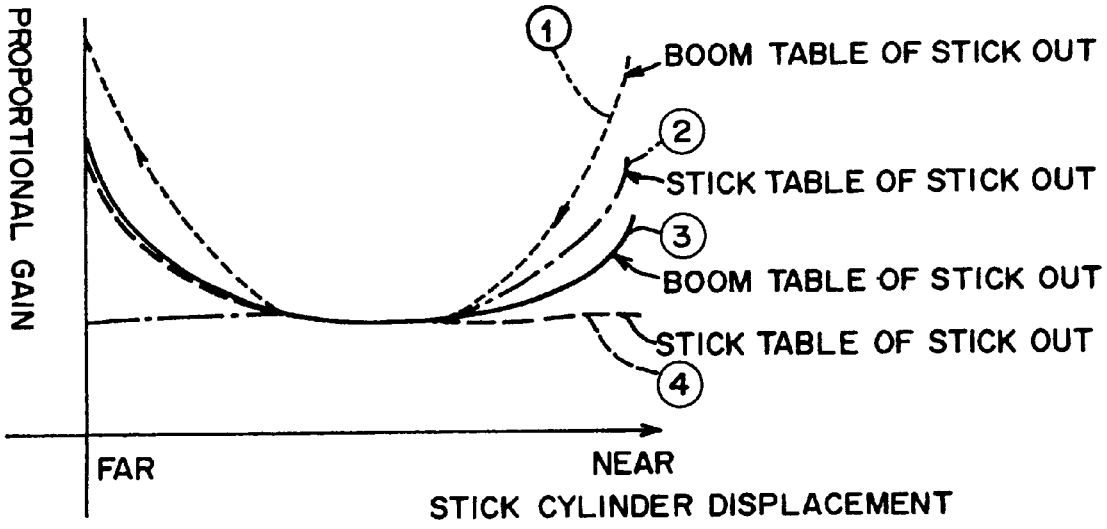
FIG. 19 is a view for explaining a characteristic of correction of a control gain of the control apparatus according to the second embodiment of the present invention.

As shown in FIG. 19, in the map, characteristics independent of each other are set individually for the gains Kpp and Kf of the boom 200 and the stick 300, and the gains for the boom 200 and the stick 300 are individually corrected in different manners upon stick-in and stick-out.

Here, the stick-in signifies a movement when the stick 300 is moved to the nearer side, and the stick-out signifies a movement when the stick 300 is moved to the farther side.

The axis of abscissa of the map shown in FIG. 19 is the displacement of the stick cylinder 121, and when the displacement of the stick cylinder 121 is small, this is when the tip 112 of the bucket 400 is positioned far away, but when the displacement of the stick cylinder 121 is large, the tip 112 of the bucket 400 is positioned on the nearer side.

First, the correction characteristics of the proportional gains Kpp and Kf of the boom 200 upon stick-out are described. The correction characteristics are each set such that, upon stick-out, when the displacement of the stick cylinder 121 comes to an intermediate position, the correction value of the gain exhibits a minimum value, and when the stick cylinder 121 is expanded or the contracted from the intermediate position, the gain correction value increases while drawing a curve like a substantially quadratic curve as indicated by a curve ①.

Meanwhile, the proportional gains Kpp and Kf of the stick 300 are set to such characteristics that, as indicated by another curve ②, when the displacement of the stick cylinder 121 is smaller than a predetermined displacement, they are set to a substantially fixed value, but when the displacement becomes larger than the predetermined displacement, they increase gradually.

Further, the proportional gains Kpp and Kf of the boom 200 upon stick-in are set, as indicated by a curve ③, to a characteristic similar to the characteristic upon stick-out (the curve ①), that is, to such a characteristic that, when the displacement of the stick cylinder 121 comes to a substantially intermediate position, the gain correction value exhibits a minimum value, but when the displacement of the stick cylinder 121 is expanded or contracted from the intermediate position, the gain correction value increases while drawing a curve like a substantially quadratic curve.

This is because, when the displacement of the stick cylinder 121 is small, since the stick 300 is expanded and the tip 112 of the bucket 400 is positioned far away, the load applied to the stick cylinder 121 or the stick cylinder 122 is high, and consequently, the gains must be made high. However, if the gain correction amount is made excessively large, then it is supposed that the entire controlling system becomes unstable, and taking it into consideration that the control accuracy (accuracy of the tip position) is deteriorated, correction by such a large amount that it exceeds that in correction upon stick-out of the boom 200 indicated by the curve ① is not performed.

On the other hand, when the displacement of the stick cylinder 121 comes close to the intermediate position, the stability of the control accuracy is secured by decreasing the gains.

Further, when the displacement of the stick cylinder 121 is large, since the tip 112 of the bucket 400 is positioned on the nearer side and both of the boom 200 and the stick 300 take comparatively upright postures, the components of force in the parallel direction are likely to become short with respect to the directions in which the hydraulic cylinders 120 and 121 operate. Therefore, when the displacement of the stick cylinder 121 is large, such correction as to increase the gains is performed. It is to be noted that, also in this instance, similarly as in the case wherein the cylinder displacement is small described above, since it is considered that, if the gain correction amount is set excessively large, then the entire controlling system becomes unstable, correction by an amount larger than a predetermined amount is not performed taking deterioration of the control accuracy (accuracy of the tip position) into consideration.

In contrast, the correction characteristics of the proportional gains Kpp and Kf of the stick 300 upon stick-in are set such that, as indicated by a curve ④, when the displacement of the stick cylinder 121 is small, the gains are set to high values, but when the stick cylinder 121 is expanded exceeding the predetermined displacement, the gains become substantially fixed. This is because the operation upon stick-in is an operation wherein the tip 112 of the bucket 400 moves to the nearer side and, upon movement in such a direction, since the bucket tip 112 side becomes an advancing direction, when the position of the tip 112 of the bucket 400 is in the neighborhood on the nearer side, the stick cylinder 121 can perform an operation with a comparatively small force.

By the way, while the controller 1 of the present apparatus includes the operation condition detection means 90 which is composed of the oil temperature detection means 81, cylinder load detection means 82 and cylinder position detection means 83 as described above and the gain scheduler 70 corrects control gains based on information detected by the detection means 81 to 83, if detection information from the detection means 81 to 83 is inputted simultaneously to the gain scheduler 70 and a plurality of correction values are set for one gain (for example, for the proportional gain Kpp) based on the detection information, then the gain scheduler 70 outputs a sum total of the correction values as a final correction gain.

In this instance, taking the stability of the controlling systems into consideration, upper limit values and lower limit values to the gain correction amounts are set in the gain scheduler 70, and if a correction amount exceeding an upper limit value or another correction value smaller than a lower limit value is set, then correction is performed using the upper limit value or the lower limit value as a limit.

The control apparatus for a construction machine according to the second embodiment of the present invention is advantageous in that, since the controller 1 includes a gain controller capable of varying control parameters (control gains) in response to an operation condition of the construction machine detected by the operation condition detection means 90 and is constructed in such a manner as to vary and correct the gains based on maps having such characteristics as illustrated in FIGS. 16 to 19, there is an advantage that the control gains are corrected in response to an operation condition of the construction machine upon working and working can be performed always by a stabilized operation.

Further, while it is supposed that, conventionally, when feedback control is performed for the cylinders 120 to 122, variations of the dynamic characteristics of control objects (for example, the cylinders 120 to 122 and the solenoid valves 3A to 3C) by a temperature variation of operating oil have an influence on the controlling performances of the closed loops and the stability of the controlling systems is deteriorated, with the control apparatus for a construction machine of the present second embodiment, deterioration of the degrees of positioning accuracy of the cylinders 120 to 122 and the degree of accuracy of the locus of the bucket tip position can be prevented.

Further, since an oil temperature variation of the operating oil is compensated for by the oil temperature detection means 81 and load variations to the cylinders 120 to 122 are compensated for by the cylinder load detection means 82 and besides the position deviations of the hydraulic cylinders 120 to 122 are compensated for by the cylinder position detection means 83, accurate tip position control can be executed.

It is to be noted that, while the present embodiment is constructed such that correction of the control gains by the gain scheduler 70 is performed by correction based on the oil temperature variations of the operating oil, correction based on the loads to the cylinders 120 to 122 and correction based on the positions and the directions of operations of the hydraulic cylinders 120 to 122, the control apparatus for a construction machine of the present embodiment is not limited to such a form as just described, but, for example, only one of the three corrections (for example, the correction based on the oil temperature variations of the operating oil) may be performed, or any two of the three corrections may be performed in combination.

(3) Description of the Third Embodiment

Figure 20:
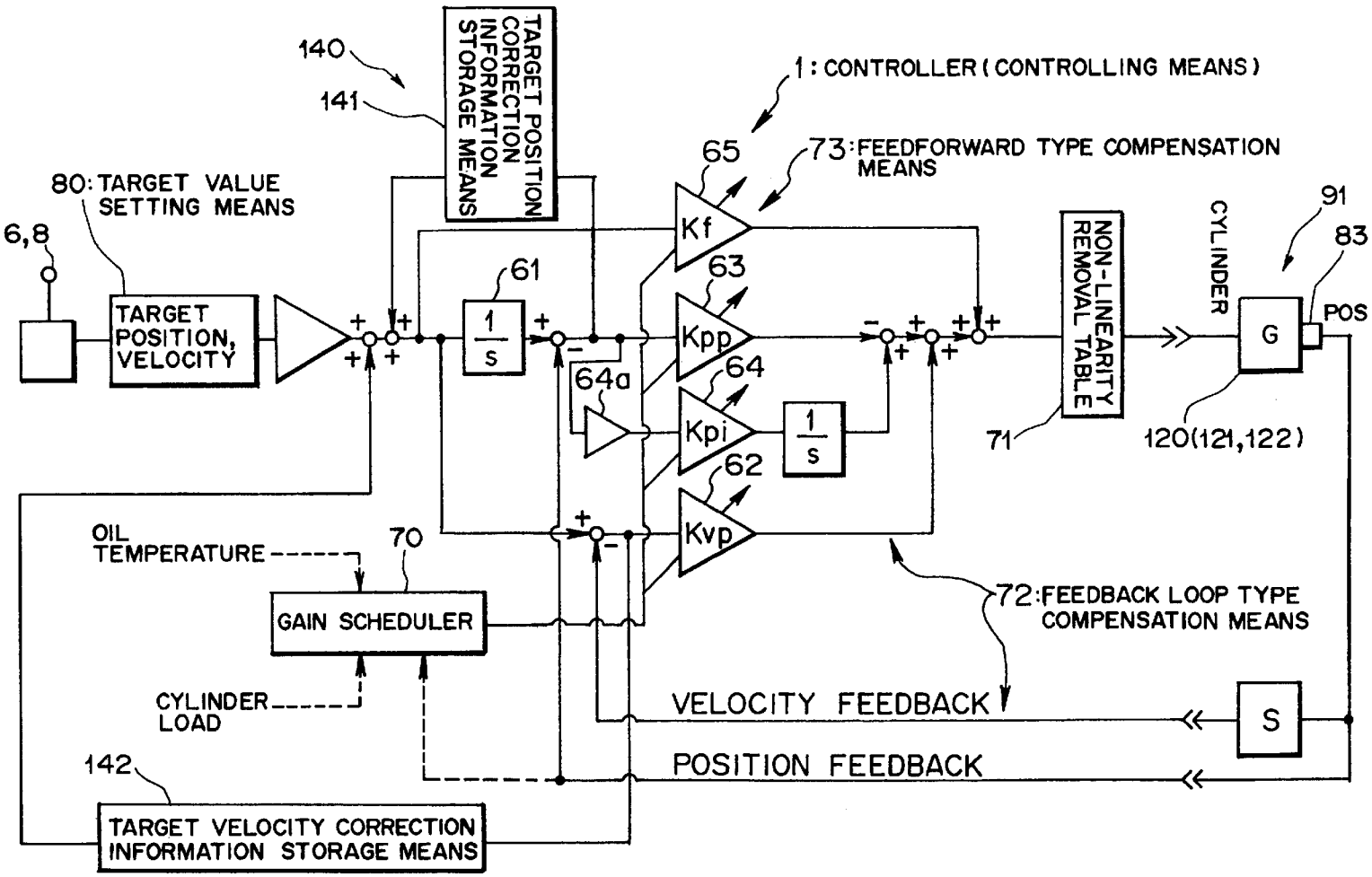
FIG. 20 is a control block diagram of essential part according to a third embodiment of the present invention.
Figure 21:
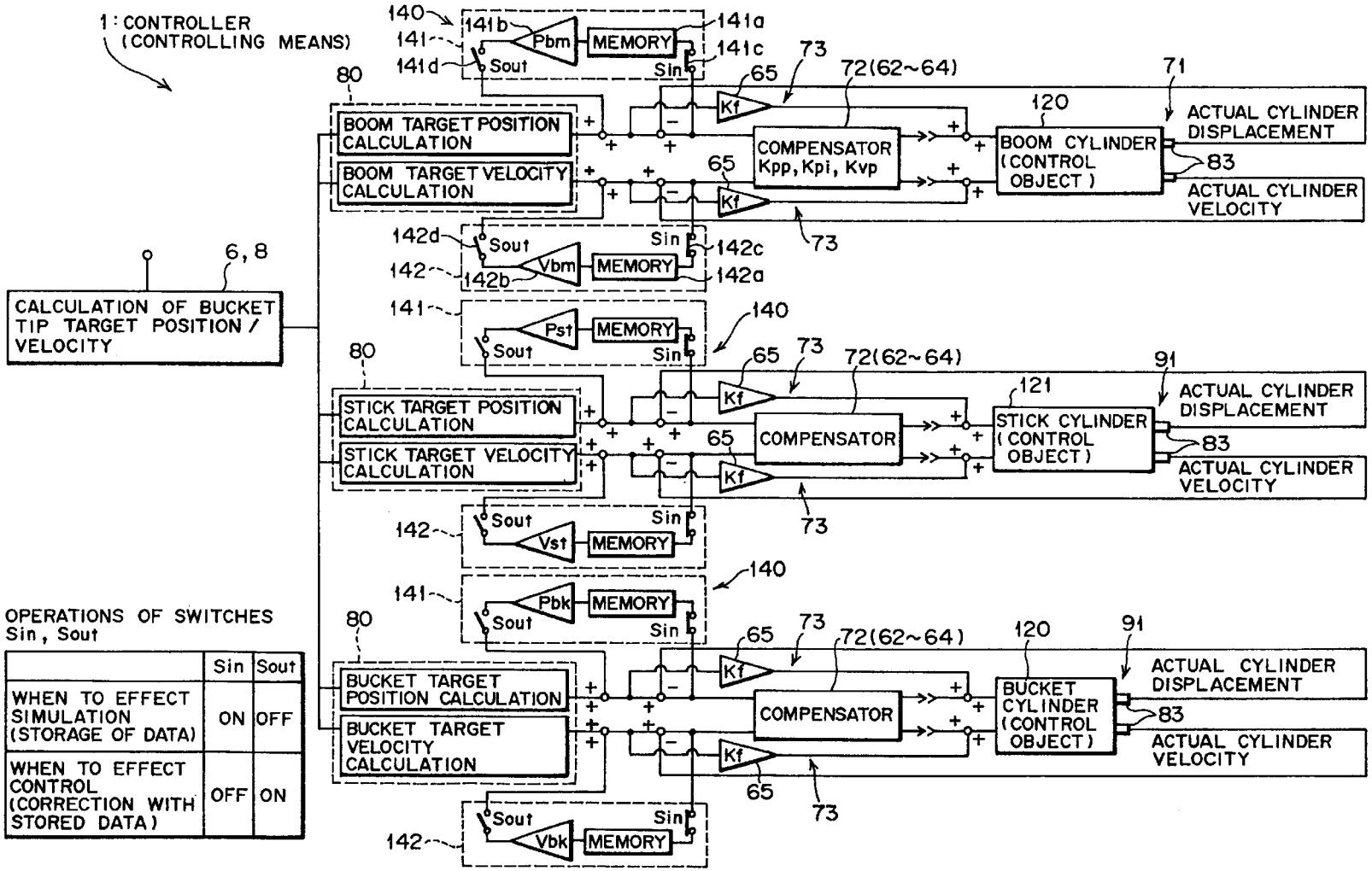
FIG. 21 is a control block diagram wherein attention is paid to functions of essential part according to the third embodiment of the present invention.
Figure 22A:
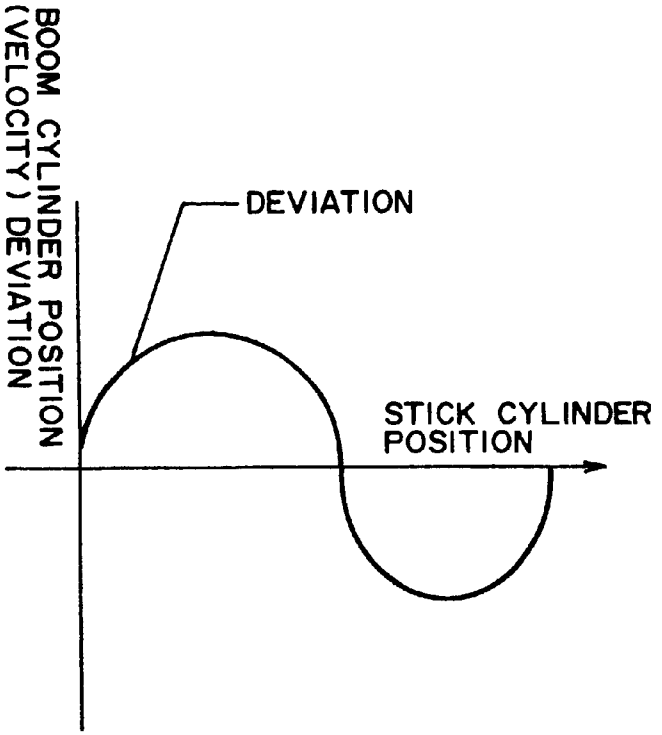
FIG. 22(*a*) is a view for explaining an operation according to the third embodiment of the present invention and is a view illustrating an example of a deviation between a target cylinder position and an actual cylinder position.
Figure 22B:
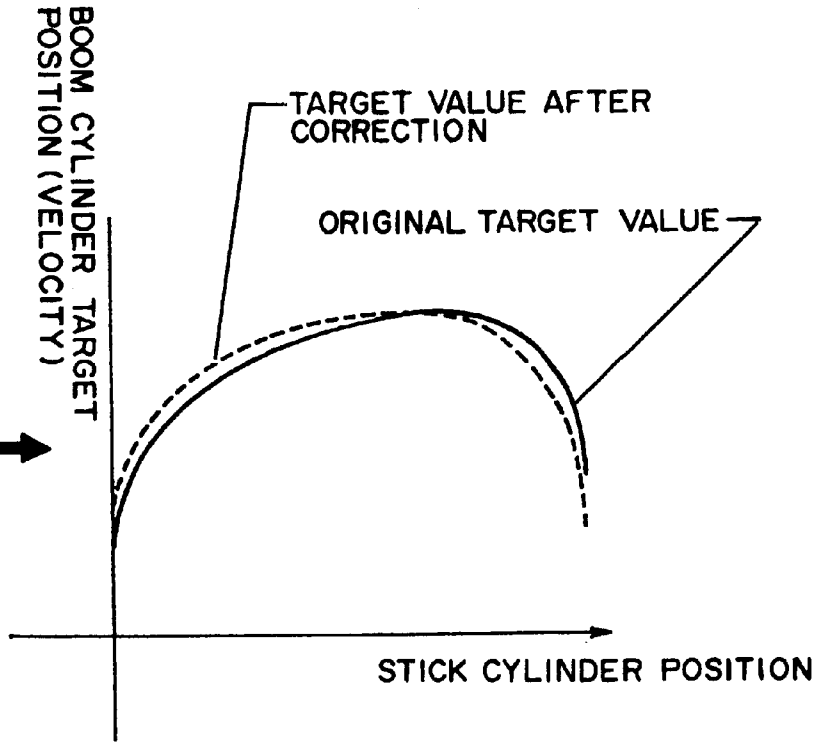

Now, a control apparatus for a construction machine according to a third embodiment is described principally with reference to FIGS. 20 to 22(*a*) and 22(*b*). It is to be noted that the general construction of a construction machine to which the present third embodiment is applied is similar to the contents described above with reference to FIG. 1 and so forth in connection with the first embodiment described above, and the general construction of a controlling system of the construction machine is similar to the contents described above with reference to FIGS. 2 to 4 in connection with the first embodiment described above. Further, the forms of the representative semiautomatic modes of the construction machine are similar to the contents described above with reference to FIGS. 9 to 14 in connection with the first embodiment described above. Therefore, description of portions corresponding to them is omitted, and in the following, description principally of differences from the first embodiment is given.

Now, the present third embodiment is constructed such that, when the arms 120 to 122 of the construction machine are automatically controlled, a deviation between target operation information and actual operation information is eliminated to the utmost to achieve augmentation of the control accuracy.

In particular, when locus control (tracking control) of the boom 200, stick 300 and bucket 400 is performed by feedback control in a semiautomatic control mode, since instruction values to the cylinders 120 to 122 are calculated based on deviations of the feedback (that is, control errors between input information and output information), it is difficult to reduce the deviations during operation of the cylinders to zero, and as a result, the bucket tip position sometimes exhibits an error from a target value.

In particular, in such feedback control, since actual cylinder positions and cylinder velocities are detected and compared with target cylinder positions and target cylinder velocities and control is performed so that the deviations may approach zero, it is difficult to eliminate the deviations completely during control, resulting in production of a control error.

The control apparatus for a construction machine according to the third embodiment of the present invention is constructed so as to solve such a problem as described above and eliminates, when the boom 200, the stick 300 and the bucket 400 are automatically controlled, deviations between target operation information and actual operation information to the utmost.

First, a control algorithm of the semiautomatic control modes (except the packet automatic return mode) performed by the controller 1 in the present third embodiment is described. Target value setting means 80 is provided in the controller 1 so that target velocities (target operation information) of the boom 200, the bucket 400 and so forth are set in response to the positions of the operation levers 6 and 8.

In particular, the moving velocity and direction of the bucket tip 112 are first calculated from information of a target slope face set angle, pilot hydraulic pressures which control the stick cylinder 121 and the boom cylinder 120, a vehicle inclination angle and an engine rotational speed. Then, based on the information, target velocities of the cylinders 120, 121 and 122 are calculated. In this instance, the information of the engine rotational speed is used as a parameter for determining an upper limit to the cylinder velocities.

Meanwhile, the controller 1 includes control sections 1A, 1B and 1C independent of each other for the boom cylinder cylinders 120, 121 and 122, and the individual controls are formed as independent control feedback loops and do not interfere with each other (refer to FIGS. 3 and 4).

The compensation construction in the closed loop controls (refer to FIG. 4) has, in each of the control sections 1A, 1B and 1C, a multiple freedom degree construction of a feedback loop and a feedforward loop with regard to the displacement and the velocity as shown in FIG. 20, and includes feedback loop type compensation means 72 having a variable control gain (control parameter), and feedforward type compensation means 73 having a variable control gain (control parameter).

In particular, if a target velocity is given, then feedback loop processes according to a route wherein a deviation between the target velocity and velocity feedback information is multiplied by a predetermined gain Kvp (refer to reference numeral 62), another route wherein the target velocity is integrated once (refer to an integration element 61 of FIG. 20) and a deviation between the target velocity integration information and displacement feedback information is multiplied by a predetermined gain Kpp (refer to reference numeral 63) and a further route wherein the deviation between the target velocity integration information and the displacement feedback information is multiplied by an I gain coefficient (refer to reference symbol 64*a*) and a predetermined gain Kpi (refer to reference numeral 64) and further integrated (refer to reference numeral 66) are performed by the feedback loop type compensation means 72 while, by the feedforward type compensation means 73, a feedforward loop process by a route wherein the target velocity is multiplied by a predetermined gain Kf (refer to reference numeral 65) is performed.

Here, in the present apparatus, cylinder position detection means 83 is provided as operation information detection means 91 for detecting operation information of the cylinders 120 to 122, and the controller 1 receives the detection information from the operation information detection means 91 and target operation information (for example, target moving velocities) set by the target value setting means 80 as input information and sets control signals so that the arms such as the boom 200 and the working member (bucket) 400 may exhibit target operation conditions.

Further, in the present embodiment, the cylinder position detection means 83 is composed of the resolvers 20 to 22 and the signal converter 26 described hereinabove. The cylinder position detection means 83 detects the cylinder positions by fetching angle information detected by the resolvers 20 to 22 into the signal converter 26 and converting the angle information into cylinder displacement information in the signal converter 26. Further, by time differentiating the detection information from the cylinder position detection means 83, not only position information of the cylinders but also cylinder velocity information is fed back.

It is to be noted that the values of the gains Kvp, Kpp, Kpi and Kf mentioned above can individually be varied by the gain scheduler 70, and the gain scheduler 70 corrects the values of the gains Kvp, Kpp, Kpi and Kf based on temperature information of the operating oil, load information of the cylinders 120 to 122 and so forth in a similar manner as in the second embodiment.

Further, while a non-linearity removal table 71 is provided to remove non-linear properties of the solenoid proportional valves 3A to 3C, the main control valves 13 to 15 and so forth, a process in which the non-linearity removal table 71 is used is performed at a high speed by a computer using a table lookup technique.

In the following, essential part of the control apparatus for a construction machine of the third embodiment is described.

In the present embodiment, actual cylinder position information and cylinder velocity information are fed back as input information by the feedback loop type compensation means 72, and the controller 1 controls operations of the cylinders 120 to 122 based on the information so that the boom 200, the bucket 400 and so forth may exhibit target operation conditions.

However, in such feedback control, since actual cylinder positions and cylinder velocities are detected and compared with target cylinder positions and target cylinder velocities and control is performed so that the deviations between them may approach zero, it is difficult to eliminate the deviations completely during control.

Thus, in the present invention, correction information storage means 140 for storing correction information for correcting target operation information set by the target value setting means 80 is provided as shown in FIGS. 20 and 21, and the hydraulic cylinders 120 to 122 are controlled based on correction target operation information from the correction information storage means 140 so that the boom 200 and the bucket 400 may exhibit target operation conditions.

In particular, upon working by a semiautomatic control mode, a simulation operation is performed a predetermined number of times (or once) prior to starting of the working in accordance with control signals set by the target value setting means 80, and deviations (correction information) between target position information of the hydraulic cylinders 120 to 122 and actual cylinder position information obtained from the operation information detection means 91 (particularly the cylinder position detection means 83) are stored into the correction information storage means 140.

Then, upon starting of the working, error information corresponding to the deviations stored in the correction information storage means 140 is added to the control signals set by the target value setting means 80 so that signals in which the deviations are included in advance are outputted to the hydraulic cylinders 120 to 122.

Then, by performing such control as described above, accurate bucket position control can be executed in a semiautomatic control mode.

Now, the correction information storage means 140 is described in a little more detail here. The correction information storage means 140 is composed of, as shown in FIG. 21, target position correction information storage means 141 for storing correction information for correcting target position information of the cylinders set by the target value setting means 80, and target velocity correction information storage means 142 for storing correction information for correcting target velocity information of the cylinders set by the target value setting means 80. Further, as shown in FIG. 21, the correction information storage means 140 is provided for each of the controlling systems for the boom cylinder 120, the stick cylinder 121 and the stick cylinder 122.

It is to be noted that the target position correction information storage means 141 and the target velocity correction information storage means 142 which compose the correction information storage means 140 are constructed in a similar manner to each other, and the following description is given using the target position correction information storage means 141 representing the storage means 141 and 142.

The target position correction information storage means 141 includes, as shown in FIG. 21, a storage section (memory) 141*a*, an amplifier 141*b*, an input switch (Sin) 141*c* and an output switch (Sout) 141*d*, and if the input switch 141*c* is closed, then a deviation (correction information) between cylinder target position information set by the target value setting means 80 and an actual cylinder position detected by the cylinder position detection means 83 is inputted to the storage section 141*a* so that the deviation is stored into the storage section 141*a*. It is to be noted that such a collection operation of a deviation (correction information) as just described is executed each time an operation mode is changed in a semiautomatic control mode.

Further, if the input switch 141*c* is opened and the output switch 141*d* is closed, then deviation information from the storage section 141*a* is outputted through the amplifier 141*b* and added to cylinder target position information set by the target value setting means 80.

Consequently, since signals produced taking errors into consideration are inputted as position and velocity control signals to be outputted to the cylinders 120 to 122, deviations between actual hydraulic cylinder positions and target cylinder positions can be eliminated, and accurate and reliable tip position control can be performed.

For example, if deviations between target cylinder positions and actual cylinder positions are obtained as such characteristic data as illustrated in FIG. 22(*a*) upon simulation operation, then information corresponding to the deviations illustrated in FIG. 22(*a*) are added to the target cylinder position information [indicated by a solid line in FIG. 22(*b*)] set by the target value setting means 80. Consequently, control signals of such a characteristic as indicated by a broken line in FIG. 22(*b*) are actually inputted to the hydraulic cylinders 120 to 122.

It is to be noted that reference symbols 142*a* to 142*d* in the target velocity correction information storage means 142 shown in FIG. 21 correspond to the storage section 141*a*, amplifier 141*b*, input switch 141*c* and output switch 141*d* described above, respectively, and individually have functions similar to those of the storage section 141*a*, amplifier 141*b*, input switch 141*c* and output switch 141*d*, respectively.

Further, while the axis of abscissa in FIGS. 22(*a*) and 22(*b*) is set as the stick cylinder position, the axis of abscissa in FIGS. 22(*a*) and 22(*b*) may be set as the time.

Meanwhile, where deviation information between target cylinder positions and actual cylinder positions is obtained using the correction information storage means 140 having such a construction as described above, since the deviations between the actual cylinder positions and the target cylinder positions can be reduced to 0, in this instance, the contribution of PID control by the feedback loop type compensation means 73 becomes low. However, it is supposed that the loads to the cylinders 120 to 122 during operation in a semiautomatic control mode may vary, and when such a disturbance as just mentioned acts, such control that the deviations between the target cylinder positions and the actual cylinder positions are eliminated is performed by the feedback loop type compensation means 73.

In the control apparatus for a construction machine as the third embodiment of the present invention, since the correction information storage means 140 for storing correction information for correcting target operation information set by the target value setting means 80 is provided in the controller 1 and the hydraulic cylinders 120 to 122 are controlled based on the correction target operation information from the correction information storage means 140 so that the operations of the boom 200 and so forth may exhibit target operation conditions, the accuracy of the tip position control of the bucket 400 can be augmented.

Here, collection and outputting of correction information by the correction information storage means 140 are described. First, if an operator switches the control to semiautomatic control and sets one of operation modes such as the slope face excavation mode, then target cylinder positions and target cylinder velocities corresponding to the operation mode are set by the target value setting means 80.

Further, in the correction information storage means 140, the input switch 141*c* is closed (switched ON) in synchronism with the changing over operation to the semiautomatic control, and the output switch 141*d* is opened (switched OFF).

Further, based on control signals of the target cylinder positions and the target cylinder velocities set by the target value setting means 80, a simulation operation (predetermined operation) of the cylinders 120 to 122 for the boom 200 and so forth is executed.

In this instance, while actual cylinder positions and actual cylinder velocities of the hydraulic cylinders 120 to 122 of the boom 200 and so forth are detected by the cylinder position detection means 83, the detection signals are returned to the input side through the feedback loop type compensation means 72, and deviations of them from the target cylinder positions and the target cylinder velocities [refer to FIG. 22(*a*)] are calculated.

Further, since, upon such a simulation operation as described above, the input switch 141*c* is ON and the output switch 141*d* is OFF, the deviation information is stored into the storage section 141*b* of the correction information storage means 140 through the input switch 141*c*. It is to be noted that the deviations described above are control errors which appear between the target cylinder positions (velocities) and the actual cylinder positions (velocities) by feedback control and feedforward control.

Then, if such a simulation operation as described above is executed a predetermined number of times (for example, once), then the input switch 141*c* is now switched OFF while the output switch 141*d* is switched ON, and an operation by an actual semiautomatic control mode is started.

In this instance, the deviation information stored in the storage section 141*b* is outputted through the amplifier 141*c* and the output switch 141*d* and added to the information from the target value setting means 80.

Accordingly, upon actual control, control signals [indicated by a broken line in FIG. 22(*b*)) produced from the information from the target value setting means 80 taking the deviation information into consideration are outputted to the hydraulic cylinders 120 to 122, and deviations between the target cylinder positions (velocities) and the actual cylinder positions (velocities) in actual control can be eliminated to the utmost.

In particular, prior to starting of an operation by a semiautomatic control mode, a simulation mode according to the control mode is performed, whereupon deviation information between target cylinder positions (velocities) and actual cylinder positions (velocities) is stored, and upon starting of actual control, the deviation information is added to the target cylinder position information to correct control signals to the hydraulic cylinders 120 to 122.

Accordingly, the control signals corrected taking the deviations into consideration are inputted to the hydraulic cylinders 120 to 122, and the accuracy in position control and velocity control of the hydraulic cylinders 120 to 122 can be augmented remarkably. Consequently, also the control accuracy of the tip position can be augmented remarkably.

Furthermore, with the control apparatus for a construction machine of the present invention, also there is an advantage that the increase in cost and the increase in weight are little due to the simple construction that the simple circuit of the correction information storage means 140 is provided.

(4) Description of the Fourth Embodiment

In the following, a control apparatus for a construction machine according to a fourth embodiment is described principally with reference to FIGS. 24 to 26. It is to be noted that the general construction of a construction machine to which the present fourth embodiment is applied is similar to the contents described above with reference to FIG. 1 and so forth in connection with the first embodiment described above, and the general construction of a controlling system of the construction machine is similar to the contents described above with reference to FIGS. 2 to 4 in connection with the first embodiment described above. Further, the forms of the representative semiautomatic modes of the construction machine are similar to the contents described above with reference to FIGS. 9 to 14 in connection with the first embodiment described above. Therefore, description of portions corresponding to them is omitted, and in the following, description principally of differences from the first embodiment is given.

As described above, the hydraulic excavator is constructed such that at least the boom 200 (boom cylinder 120) and the stick 300 (stick cylinder 121) are controlled by electric controlling systems (feedback loop controlling systems) independent of each other using solenoid valves or the like.

By the way, usually with a hydraulic excavator, where such an operation as to, for example, level the ground flat (slope face formation) is to be performed, an operation of linearly moving the tip of the bucket 400 (that is, the stick 300) is required. However, in such a hydraulic excavator as mentioned above, since the boom 200 and the stick 300 are controlled independently of each other by the hydraulic cylinders 120 and 121, respectively, it is very difficult to finish a slope face with a high degree of accuracy.

In particular, where the boom 200 and the stick 300 are electrically feedback controlled using solenoid valves or the like as described above, if the corresponding hydraulic cylinders 120 and 121 are controlled independently of each other, respectively, then even if the respective feedback control deviations are small, the control deviations cannot be ignored depending upon the positions (postures) of the boom 200 and the stick 300, and an error from a target tip position (control target value) of the bucket 400 sometimes becomes very large.

For example, if control of the boom 200 is delayed with respect to the stick 300 due to the control deviations described above when the bucket 400 is at a position at which a slope face is to be formed subsequently, then the tip of the bucket 400 will bite into the ground, but on the contrary if control of the stick 300 is delayed with respect to the boom 200, then the bucket 400 will operate while it remains floating in the air.

In this manner, if the boom 200 and the stick 300 are individually controlled fully independently of each other, then it is very difficult to operate the boom 200 and the stick 300 while maintaining control target values.

Thus, the control apparatus for a construction machine of the fourth embodiment of the present invention is constructed such that the arm members such as the boom 200 and the stick 300 are controlled taking the control deviations upon feedback control into consideration to cause the arm members to always operate in an ideal condition wherein the feedback deviation information is reduced to zero so that a predetermined operation may be performed with a high degree of accuracy.

In particular, in the present embodiment, the boom 200 and the stick 300 are not controlled by feedback controlling systems fully independent of each other as in the prior art, but are controlled in a mutually associated condition so that the stick 300 and the tip 112 of the bucket 400 may be moved linearly with a high degree of accuracy in the slope face excavation mode.

It is to be noted that, in the present embodiment, the stick operation lever 8 is used to determine the bucket tip moving velocity in a parallel direction to a set excavation inclined face, and the boom/bucket operation lever 6 is used to determine the bucket tip moving velocity in a perpendicular direction to the set inclined face. Accordingly, when the stick operation lever 8 and the boom/bucket operation lever 6 are operated at the same time, the moving direction and the moving velocity of the bucket tip are determined by a composite vector in the parallel and perpendicular directions to the set inclined face.

Further, in the present embodiment, boom hydraulic cylinder extension/contraction displacement detection means for detecting extension/contraction displacement information of the boom cylinder 120 is formed from the signal converter 26 and the resolver 20 which serves as boom posture detection means, and stick hydraulic cylinder extension/contraction displacement detection means for detecting extension/contraction detection means of the stick cylinder 121 is formed from the signal converter 26 and the resolver 21 which serves as stick posture detection means.

Subsequently, a control algorithm of the semiautomatic system performed by the controller 1 is described. A control algorithm of the semiautomatic control modes (except the packet automatic return mode) performed by the controller 1 is generally such as illustrated in FIG. 23, and a construction of essential part of the controller 1 is such as shown in FIG. 24.

Figure 23:
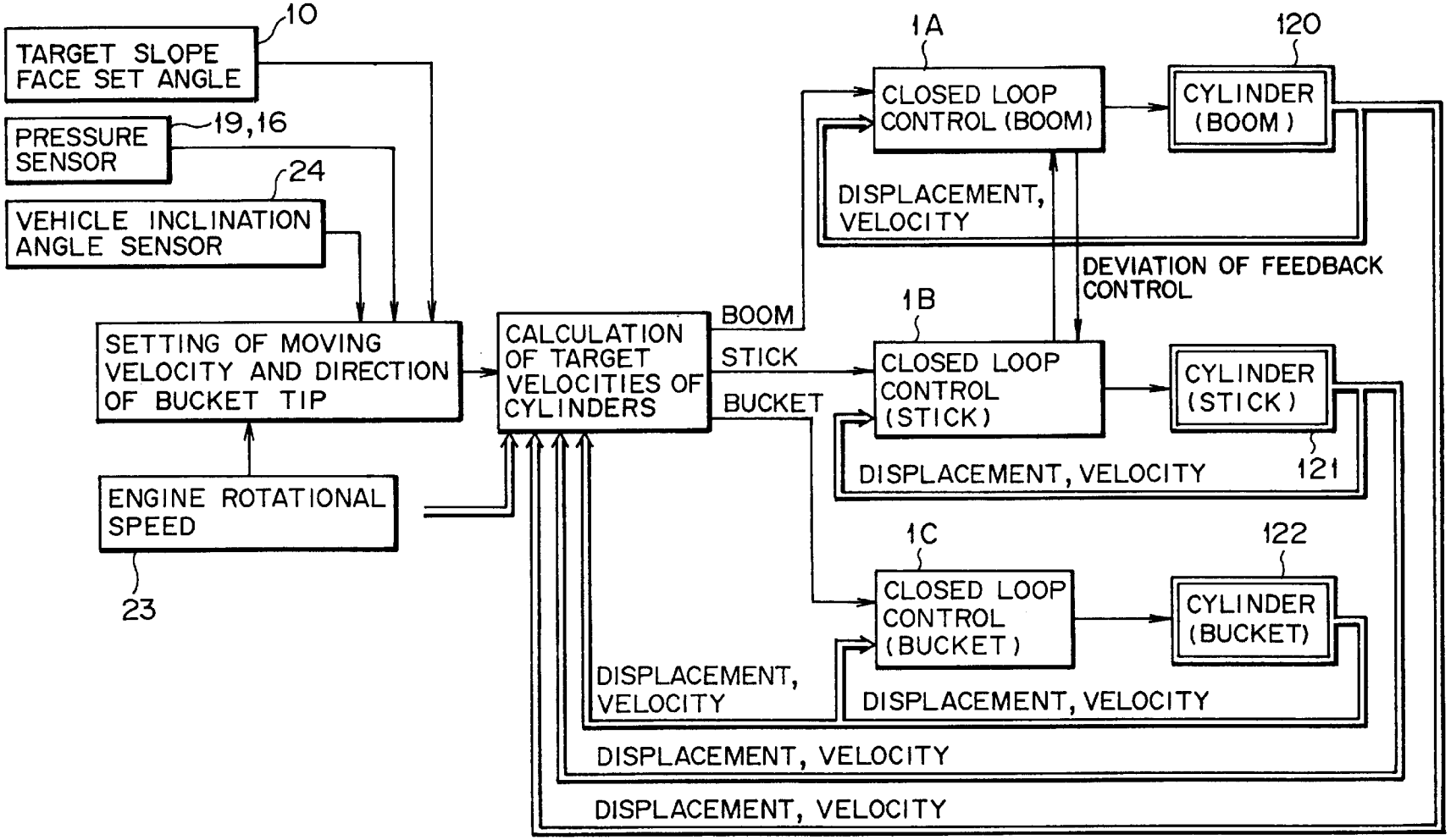
FIG. 23 is a view showing a construction of an entire control system according to a fourth embodiment of the present invention.
Figure 24:
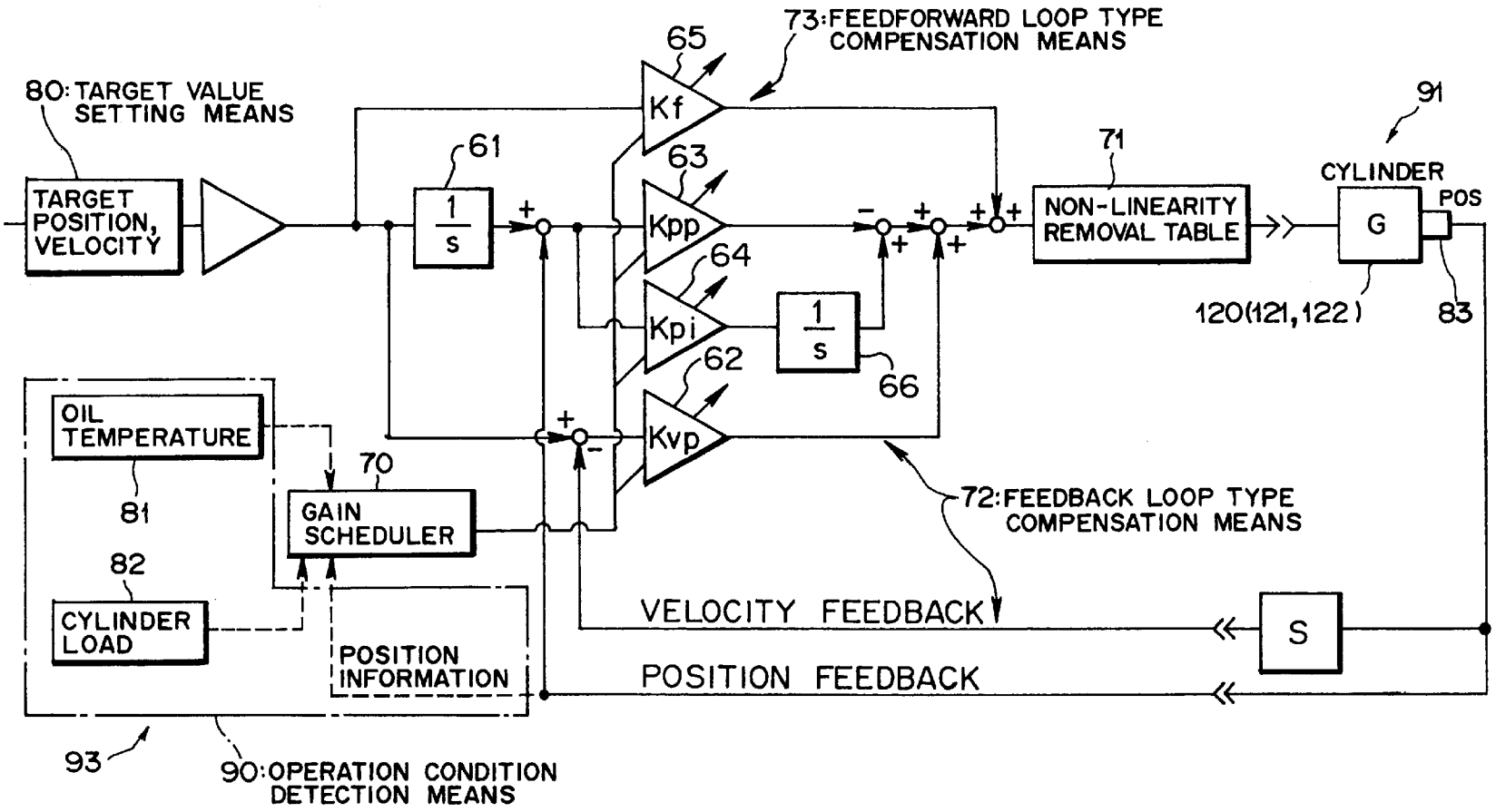
FIG. 24 is a control block diagram of essential part according to the fourth embodiment of the present invention.

It is to be noted that the control algorithm illustrated in FIG. 23 and the block diagram shown in FIG. 24 are almost same as those described hereinabove with reference to FIGS.

4 and 5 in the first embodiment, but have some differences. Therefore, they are described again with reference to FIGS. 23 and 24.

First, the control algorithm illustrated in FIG. 23 is described. First, the moving velocity and direction of the bucket tip 112 are calculated from information of a target slope face set angle, pilot hydraulic pressures which control the stick cylinder 121 and the boom cylinder 120, a vehicle inclination angle and an engine rotational speed. Then, target velocities of the cylinders 120, 121 and 122 are calculated based on the information. In this instance, the information of the engine rotational speed is required to determine an upper limit to the cylinder velocities.

Meanwhile, the controller 1 includes control sections 1A, 1B and 1C for the cylinders 120, 121 and 122, and the individual controls are formed as control feedback loops as shown in FIG. 23.

The compensation construction in the closed loop controls shown in FIG. 23 has, in each of the control sections 1A, 1B and 1C, a multiple freedom degree construction of a feedback loop and a feedforward loop with regard to the displacement and the velocity as shown in FIG. 24, and includes feedback loop type compensation means 72 having a variable control gain (control parameter), and feedforward type compensation means 73 having a variable control gain (control parameter).

In particular, if a target velocity is given, then with regard to the feedback loop process, feedback loop processes according to a route wherein a deviation between the target velocity and velocity feedback information is multiplied by a predetermined gain Kvp (refer to reference numeral 62), another route wherein the target velocity is integrated once (refer to an integration element 61 of FIG. 24) and a deviation between the target velocity integration information and displacement feedback information is multiplied by a predetermined gain Kpp (refer to reference numeral 63) and a further route wherein the deviation between the target velocity integration information and the displacement feedback information is multiplied by a predetermined gain Kpi (refer to reference numeral 64) and further integrated (refer to reference numeral 66) are performed while, with regard to the feedforward loop process, a process by a route wherein the target velocity is multiplied by a predetermined gain Kf (refer to reference numeral 65) is performed.

Of the processes, the feedback loop processes are described in a little more detail. In the present apparatus, operation information detection means 91 for detecting operation information of the cylinders 120 to 122 is provided, and the controller 1 receives the detection information from the operation information detection means 91 and target operation information (for example, target moving velocities) set by the target value setting means 80 as input information and sets control signals so that the arm members such as the boom 200 and the working member (bucket) 400 may exhibit target operation conditions.

It is to be noted that, while the operation information detection means 91 particularly is posture information detection means 83 for detecting the postures of the boom 200 and the stick 300, the posture information detection means 83 also has a function as operation condition detection means 90, which will be hereinafter described, and detection means 93 is composed of the operation information detection means 91 and the operation condition detection means 90 which is hereinafter described.

Meanwhile, the values of the gains Kvp, Kpp, Kpi and Kf mentioned above can individually be varied by the gain scheduler (control parameter scheduler) 70, and the values of the gains Kvp, Kpp, Kpi and Kf are varied or corrected in this manner to control the boom 200, the bucket 400 and so forth to target operation conditions.

In particular, the present apparatus includes, as shown in FIG. 24, operation condition detection means 90 which in turn includes oil temperature detection means 81 for detecting an oil temperature of the operating oil, cylinder load detection means 82 for detecting the loads to the cylinders 120 to 122, and cylinder position detection means 83 for detecting position information of the cylinders. The gain scheduler 70 varies the gains Kvp, Kpp, Kpi and Kf based on detection information from the operation condition detection means 90 (that is, operation information of the construction machine).

Of the means, the oil temperature detection means 81 is temperature sensors provided in the proximity of the solenoid proportional valves 3A, 3B and 3C, and the gain scheduler 70 corrects the gains in response to a temperature relating to the cylinders 120 to 122. It is to be noted that the temperature relating to the cylinders 120 to 122 signifies, for example, the temperature of controlling oil (pilot oil), and here, the temperature of the pilot oil is detected as the representative oil temperature which represents the temperature of the operating oil.

Further, while, as shown in FIG. 24, a non-linearity removal table 71 is provided to remove non-linear properties of the solenoid proportional valves 3A to 3C, the main control valves 13 to 15 and so forth, a process in which the non-linearity removal table 71 is used is performed at a high speed by a computer using a table lookup technique.

Figure 25:
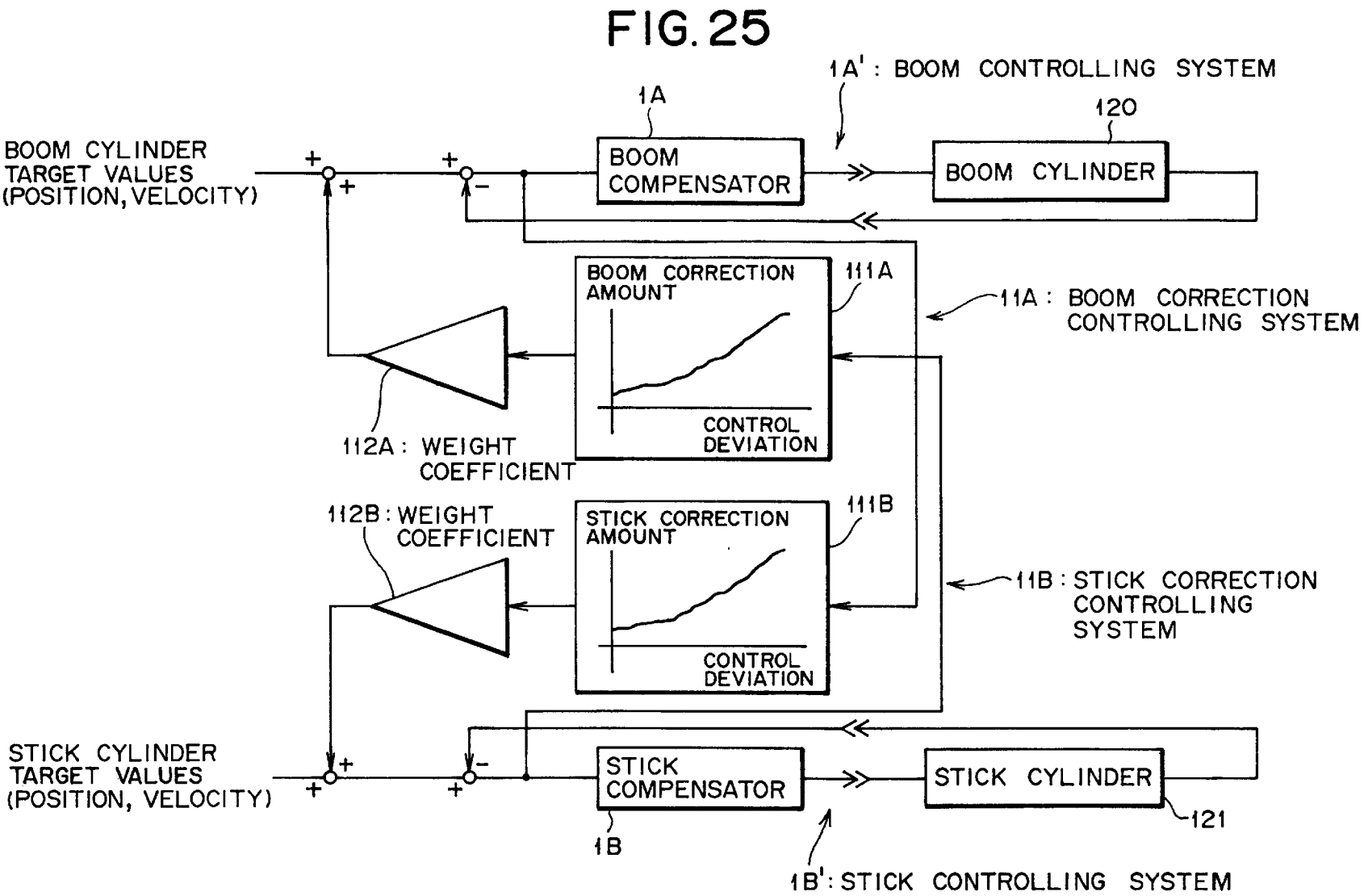
FIG. 25 is a control block diagram of essential part according to the fourth embodiment of the present invention.
Figure 26:
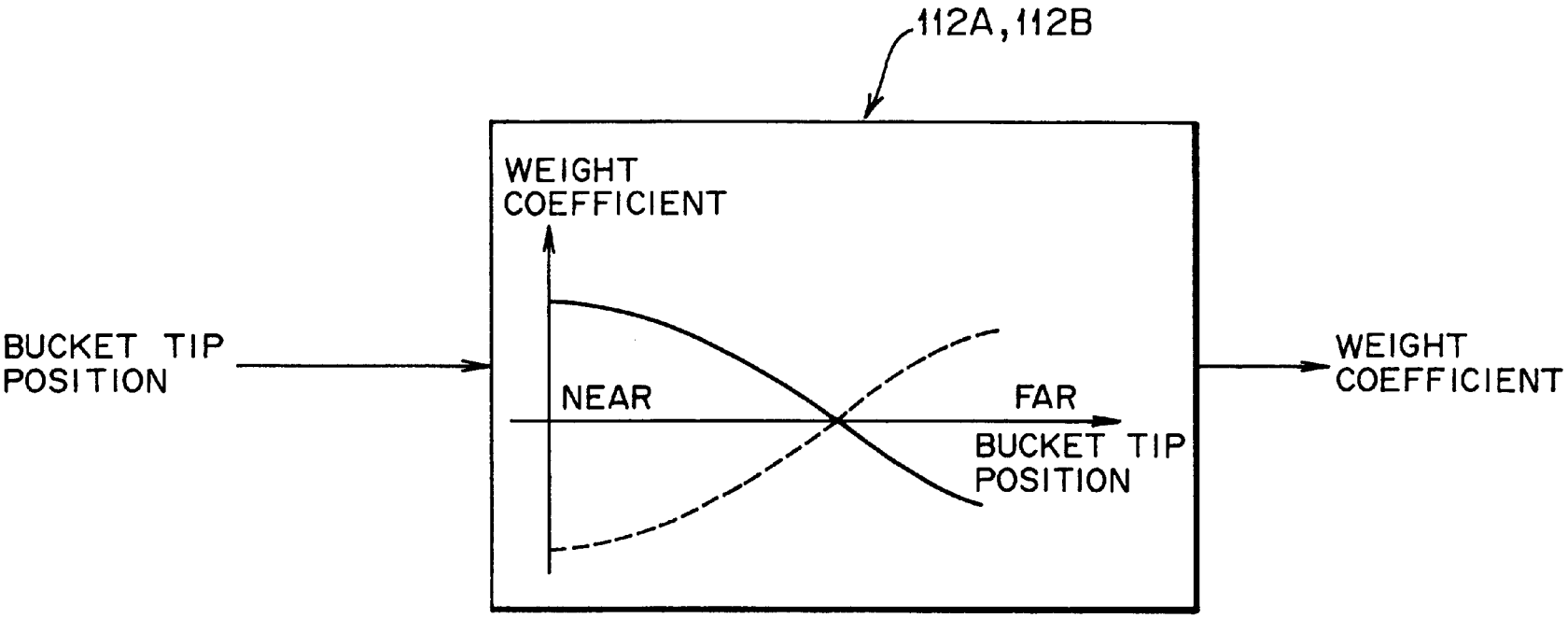
FIG. 26 is a view for explaining a characteristic of a weight coefficient addition section according to the fourth embodiment of the present invention.

By the way, as shown in FIG. 25, in the present embodiment, a feedback control deviation (feedback deviation information) of a stick controlling system (second controlling system) 1B' is supplied to a boom controlling system (first controlling system) 1A' while a feedback control deviation of the boom controlling system 1A' is supplied to the stick controlling system 1B', and the controlling systems 1A' and 1B' perform correction of control target values (positions and velocities) of the boom/cylinder based on the feedback control deviations.

To this end, the controller 1 includes, as shown in FIG. 25, in addition to the boom controlling system 1A' and the stick controlling system 1B' described above, a boom (first) correction value generation section 111A and a boom (first) weight coefficient addition section 112A as a boom (first) correction controlling system 11A for correcting control target values of the boom controlling system 1A' based on the feedback control deviations of the stick controlling system 1B', and a stick (second) correction value generation section 111B and a boom (second) weight coefficient addition section 112B as a stick (second) correction controlling system 11B for correcting control target values of the stick controlling system 1B' based on the feedback control deviations of the boom controlling system 1A'.

Here, the boom correction value generation section 111A generates boom correction values (boom modification amounts) for correcting control target values of the boom cylinder 120 of the boom controlling system 1A' from the feedback control deviations (which may be hereinafter referred to merely as control deviations) of the stick controlling system 1B'. Here, the boom correction value generation section 111A is set such that it increases its boom correction values substantially in proportion to the magnitudes of the control deviations from the stick controlling system 1B', which is the other controlling system), as shown in FIG. 25.

Meanwhile, the stick correction value generation section 111B generates boom correction values for correcting the control target values of the stick cylinder 121 of the stick controlling system 1B' from the control deviations of the boom controlling system 1A'. The stick correction value generation section 111B is set such that, similarly to the boom correction value generation section 111A described above, it increases its boom correction values substantially in proportion to the magnitudes of the control deviations from the boom controlling system 1A' which is the other controlling system.

Further, the bucket tip boom weight coefficient addition section 112A and the stick weight coefficient addition section 112B add weight coefficients to the boom correction values and the stick correction values generated by the corresponding boom correction value generation section 111A and stick correction value generation section 111B, respectively. Here, for example, as shown in FIG. 26, the boom correction values are multiplied by a boom weight coefficient having such a characteristic as indicated by a solid line (a characteristic wherein the positive or negative polarity of a coefficient to be added is reversed in response to the distance between the tip position of the bucket 400 and the construction machine body 100) by the boom weight coefficient addition section 112A while the stick correction values are multiplied by a stick weight coefficient having such a characteristic as indicated by a broken line (a characteristic substantially opposite to that of the boom weight coefficient) by the stick weight coefficient addition section 112B.

Consequently, the correction controlling systems 11A and 11B can vary correction values for correcting control target values of the controlling systems 1A' and 1B' and can effect correction of control target values flexibly. It is to be noted that, while such a weight coefficient addition section 112A (112B) as described above may be provided only one of the correction controlling systems 11A and 11B, here it is provided for both of the correction controlling systems 11A and 11B so that cancellation of control deviations which will be hereinafter described can be performed at a high speed.

In the following, correction processing of control target values by the controller 1 having the construction described above is described. For example, if, in the slope face excavation mode (bucket tip linear excavation mode), control of the boom 200 (boom cylinder 120) is delayed from control of the stick 300 (stick cylinder 121) when the tip position of the bucket 400 is positioned at a location near the construction machine body 100, then the operation velocity of the stick 300 relatively increases and a control deviation is produced with the stick controlling system 1B'.

The control deviation is inputted to the boom correction value generation section 111A of the boom correction controlling system 11A, and the boom correction value generation section 111A generates a boom correction value for raising the control target value of the boom cylinder 120. Now, since the tip position of the bucket 400 is positioned at a location near the construction machine body 100, the boom correction value is multiplied by the boom weight coefficient addition section 112A by such a positive weight coefficient which increases the value of the boom correction value (refer to a solid line in FIG. 26).

Then, the boom correction value multiplied by the weight coefficient in this manner is added to the target value of the boom cylinder 120. As a result, the operation speed of the boom cylinder 120 increases.

Meanwhile, in this instance, the control error produced with the boom controlling system 1A' is inputted to the stick correction value generation section 111B of the stick correction controlling system 11B. The stick correction value generation section 111B generates a stick correction value for decreasing the control target value of the stick cylinder 121 contrary to the boom correction value generation section 111A described above. Now, however, since the tip position of the bucket 400 described above is positioned at a location near the construction machine body 100, the stick correction value is multiplied by the stick weight coefficient addition section 112B by such a negative weight coefficient which decreases the value of the stick correction value (refer to a broken line in FIG. 26).

Then, the stick correction value multiplied by the weight coefficient in this manner is added to the target value of the stick cylinder 121. As a result, the operation velocity of the stick cylinder 121 decreases.

Consequently, the control error of the boom controlling system 1A' and the control error of the stick controlling system 1B' cancel each other, and the boom 200 and the stick 300 can perform a linear excavation operation in the slope face excavation mode (bucket tip linear excavation mode) stably with a high degree of accuracy.

It is to be noted that, if control of the boom 200 (boom cylinder 120) is delayed from control of the stick 300 (stick cylinder 121) when the tip position of the bucket 400 is positioned at a location far from the construction machine body 100, then also the operation velocity of the stick 300 is delayed. In this instance, however, since the boom correction value is multiplied by a negative weight coefficient by the boom weight coefficient addition section 112A and the boom correction value is multiplied by a positive weight coefficient by the stick weight coefficient addition section 112B, the operation velocity of the stick cylinder 121 relatively increases and the control deviations cancel each other.

In short, the controller 1 described above is constructed such that, when it controls the boom 200 and the stick 300 individually, while it corrects control target values of the self controlling systems 1A' and 1B' thereof based on control deviations of the controlling systems 1B' and 1A' other than the self controlling systems, it controls the boom 200 and the stick 300 in a mutually associated relationship so that the boom 200 and the stick 300 may operate always in an ideal condition wherein control deviations of the controlling systems 1A' and 1B' are eliminated.

Since the control apparatus for a construction machine as the fourth embodiment of the present invention is constructed in such a manner as described above, when such a slope face excavation operation of a target slope face angle $\alpha$ as shown in FIG. 13 is performed semiautomatically using the hydraulic excavator, such semiautomatic controlling functions as described above can be realized. In particular, detection signals (including setting information of a target slope face angle) from the various sensors are inputted to the controller 1, and the controller 1 controls the main control valves 13, 14 and 15 through the solenoid proportional valves 3A, 3B and 3C based on the detection signals from the sensors (including also detection signals of the resolvers 20 to 22 received through the signal converter 26) to effect such control that the boom 200, stick 300 and bucket 400 may exhibit desired extension/contraction displacements to execute such semiautomatic control as described above.

Then, upon the semiautomatic control, the moving velocity and direction of the bucket tip 112 are calculated from information of the target slope face set angle, pilot hydraulic pressures which control the stick cylinder 121 and the boom cylinder 120, a vehicle inclination angle and an engine rotational speed, and target velocities of the cylinders 120, 121 and 122 are calculated based on the information. The information of the engine rotational speed then is required to determine an upper limit to the cylinder velocities.

Further, the control in this instance is performed by a feedback loop for each of the cylinders 120, 121 and 122, and in the present embodiment, as described hereinabove, when the boom 200 (boom cylinder 120) and the stick 300 (stick cylinder 121) are to be individually controlled, while the control target values of the self controlling systems 1A' and 1B' of the boom 200 and the stick 300 are corrected by the correction controlling systems 11A and 11B, respectively, based on control deviations of the controlling systems 1B' and 1A' other than the self controlling systems, the boom 200 and the stick 300 are controlled in a mutually associated relationship so that the boom 200 and the stick 300 may operate always in an ideal condition wherein control deviations of the controlling systems 1A' and 1B' are eliminated.

As described in detail above, with the control apparatus for a construction machine as the present embodiment, since the boom 200 (boom cylinder 120) and the stick 300 (stick cylinder 121) are not controlled by feedback controlling systems fully independent of each other as in the prior art but, while control target values of the self controlling systems 1A' and 1B' are corrected by the correction controlling systems 11A and 11B based on control deviations of the controlling systems 1B' and 1A' other than the self controlling system, the boom 200 and the stick 300 are controlled in a mutually associated relationship so that the boom 200 and the stick 300 are operated always in an ideal condition wherein control deviations of the controlling systems 1A' and 1B' are eliminated, any construction operation (particularly an operation in the bucket tip linear excavation mode) can be performed with a very high degree of accuracy, and the finish accuracy in operation can be augmented remarkably.

Furthermore, in the present embodiment, since posture information of the boom 200 and the stick 300 can be detected simply by detecting extension/contraction displacement information of the hydraulic cylinders 120 and 121, respectively, using the resolvers 20 and 21 and the signal converter 26, the posture information of the boom 200 and the stick 300 can be obtained accurately with a simple construction.

Further, as described with reference to FIG. 25, since a boom correction value for correcting a control target value of the boom controlling system 1A' and a stick correction value for correcting a control target value of the stick controlling system 1B' can be generated to effect correction of the control target values of the boom cylinder 120 and the stick cylinder 121 with certainty with such a simple construction that the boom correction value generation section 111A is provided in the boom correction controlling system 11A and the stick correction value generation section 111B is provided in the stick correction controlling system 11B, also the reliability upon correction processing is augmented.

Furthermore, since the boom weight coefficient addition section 112A is provided in the boom correction controlling system 11A and the stick weight coefficient addition section 112B is provided in the stick correction controlling system 11B so that the correction values can be varied in accordance with the necessity, correction of control target values of the boom cylinder 120 and the stick cylinder 121 can be performed flexibly, and appropriate correction and control can always be performed at a high speed in whichever conditions (postures) the boom 200 and the stick 300 are. It is to be noted that such a weight coefficient addition section 112A (112B) as just described may be provided for only one of the correction controlling systems 11A and 11B.

(5) Description of the Fifth Embodiment

In the following, a control apparatus for a construction machine according to a fifth embodiment is described principally with reference to FIGS. 27 and 28. It is to be noted that the general construction of a construction machine to which the present fifth embodiment is applied is similar to the contents described hereinabove with reference to FIG. 1 and so forth in connection with the first embodiment described above, and the general construction of controlling systems of the construction machine is similar to the contents described hereinabove with reference to FIGS. 2 to 4 in connection with the first embodiment described above. Further, the forms of representative semiautomatic modes of the construction machine are similar to the contents described hereinabove with reference to FIGS. 9 to 14 in connection with the first embodiment described above. Therefore, description of portions corresponding to them is omitted, and in the following, description principally of differences from the first embodiment is given.

Generally, in a construction operation by a hydraulic excavator, an operation (called bucket tip linear excavation mode) of moving the tip of the bucket 400 linearly such as horizontal leveling (slope face formation) of the ground is sometimes required. In this instance, with a control apparatus for the hydraulic excavator, the operation described above is realized by feedback controlling the boom 200 (hydraulic cylinder 120) and the stick 300 (hydraulic cylinder 121) electrically independently of each other individually using solenoid valves or the like.

In particular, for example, target positions (control target values) of the hydraulic cylinders 120 and 121 are determined by a predetermined calculation based on a target bucket tip position obtained from operation positions of operation levers (hereinafter referred to as stick operation levers) for the stick 300, and the hydraulic cylinders 120 and 121 are individually feedback controlled independently of each other based on the obtained target values.

In a conventional control apparatus for a hydraulic shovel, since the hydraulic cylinders 120 and 121 are individually feedback controlled independently of each other based on control target values obtained from a target bucket tip position, for example, if it is tried to draw the stick 300 toward the construction machine body 100 side to linearly move the tip of the bucket 400 from a condition wherein the bucket 400 is positioned far from the construction machine body 100, then if the position deviation of the boom 200 is small (the delay is little) and the position deviation of the stick 300 is large (the delay is much), then a condition wherein the actual tip position of the bucket 400 is displaced upwardly from a target position (target slope face) is entered, and as a result, there is a subject that the finish accuracy of the slope face is deteriorated significantly.

Therefore, the control apparatus for a construction machine of the fifth embodiment of the present invention is constructed such that the operation of an arm member (boom or stick) is controlled while the actual position (posture) of the arm member is taken into consideration, thereby achieving augmentation of the accuracy in predetermined construction operation.

First, a general construction of the control apparatus for a construction machine of the present embodiment is described. The present control apparatus for a construction machine includes, similarly to the embodiments described above, hydraulic circuits for the cylinders 120 to 122, hydraulic motors and a revolving motor. In the hydraulic circuits, pumps 51 and 52 which are driven by an engine 700, main control valves (control valves) 13, 14 and 15 and so forth are interposed (refer to FIG. 2).

Further, in the present embodiment, for the hydraulic circuits, hydraulic circuits of the open center type wherein the extension/contraction displacement velocities of the cylinder 120 to 122 rely upon the loads acting upon the cylinder 120 to 122 (for example, the extension/contraction displacement velocities become lower in response to the force received from the ground upon an excavation operation) are applied.

Meanwhile, a stick operation lever 8 is used to determine the bucket tip moving velocity in a parallel direction with respect to a set excavation inclined face, and a boom/bucket operation lever 6 is used to determine the bucket tip moving velocity in a perpendicular direction to the set inclined face. Accordingly, when the stick operation lever 8 and the boom/bucket operation lever 6 are operated at the same time, the moving direction and the moving velocity of the bucket tip are determined by a composite vector in the parallel direction and the perpendicular direction with respect to the set inclined face.

Further, in the present embodiment, extension/contraction displacement detection means for detecting extension/contraction displacement information of the boom hydraulic cylinder 120 is composed of a signal converter 26 and a resolver 20 which serves as boom posture detection means (or arm member posture detection means), and extension/contraction displacement detection means for detecting extension/contract displacement information of the hydraulic cylinder 121 is composed of the signal converter 26 and a resolver 21 which serves as stick posture detection means (or arm member posture detection means).

In the following, a construction of essential part of the present embodiment is described. In the present embodiment, when the controller 1 calculates target velocities of the boom cylinder 120 and the stick cylinder 121, the target speed of the boom is determined taking actual postures of the boom 200 and the stick 300 into consideration so that a linear operation of the bucket tip 112 particularly in the slope face excavation mode may be performed with a high degree of accuracy.

Figure 27:
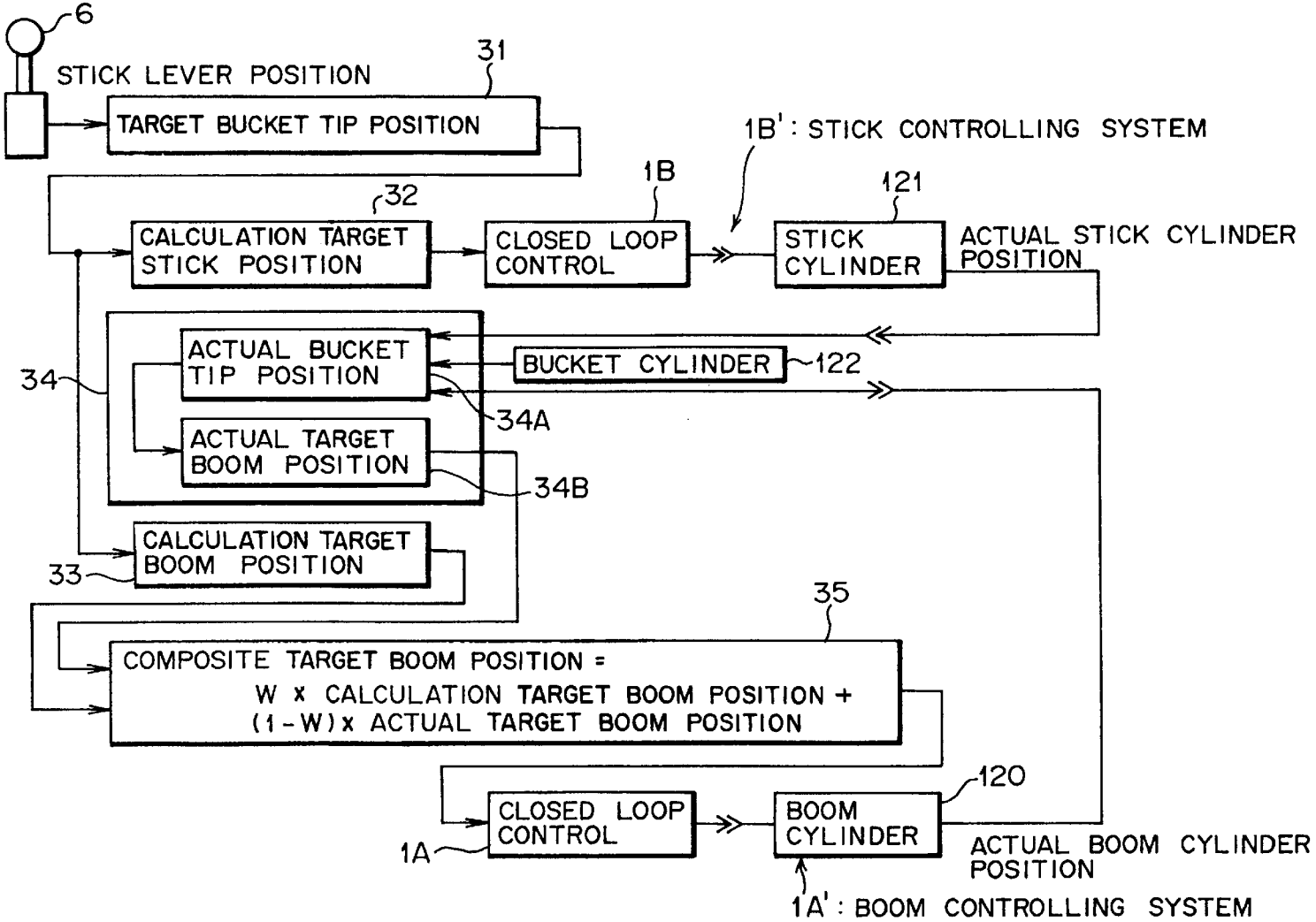
FIG. 27 is a control block diagram of essential part according to a fifth embodiment of the present invention.

To this end, the controller 1 of the present embodiment includes, for example, as shown in FIG. 27, a target bucket tip position detection section 31, a calculation target stick position setting section (stick control target value setting means) 32, a calculation target boom position setting section (boom control target value setting means) 33, an actual boom control target value calculation section (actual control target value calculation means) 34 and a composite target boom position calculation section (composite control target value calculation means or composite boom control target value calculation means) 35. It is to be noted that closed loop control sections 1A and 1B are constructed in a similar manner to those shown in FIGS. 3, 4 and 24.

Here, the target bucket tip position detection section 31 detects operation position information of the boom/bucket operation lever (arm mechanism operation member) 6, and the calculation target stick position setting section (stick control target value setting means) 32 determines a target stick position (stick control target value) for stick control by a predetermined calculation from the operation position information detected by the target bucket tip position detection section 31.

In particular, the calculation target stick position setting section 32 determines, by calculation processing described below, a calculation target stick position (stick cylinder length) $\lambda_{103/105}$ from a target bucket tip position $(x_{115}, y_{115})$ as operation position information of the operation lever 6 obtained by the target bucket tip position detection section 31 (refer to FIG. 8). It is to be noted that $L_{i/j}$ represents a fixed length, $\lambda_{i/j}$ a variable length, $A_{i/j/k}$ a fixed angle, and $\theta_{i/j/k}$ represents a variable angle, the suffix i/j to L represents the length between nodes i and j, the suffix i/j/k to A and θ represents to connect the nodes i, j and k in order of i→j→k. Accordingly, for example, $L_{101/102}$ represents the distance between the node 101 and the node 102, and $\theta_{103/104/105}$ represents the angle defined when the nodes 103 to 105 are connected in order of the node 103→node 104→node 105. Further, also here, the node 101 is assumed to be the origin of the xy coordinate system as shown in FIG. 8.

First, the calculation target stick position is represented by the following expression (2-1) in accordance with the cosine theorem.

$$\lambda_{103/105}=(L_{103/104}^2+L_{104/105}^2-2L_{103/104}\cdot L_{104/105}\cdot\cos\theta_{103/104/105})^{1/2} \quad (2\text{-}1)$$

Here, since $L_{103/104}$ and $L_{104/105}$ given above are individually known fixed values, if $\theta_{103/104/105}$ is determined, then the stick position $\lambda_{103/105}$ can be determined. From FIG. 8, $\theta_{103/104/105}$ can be represented as $$\theta_{103/104/105}=2\pi-A_{105/104/108}-A_{101/104/103}-\theta_{101/104/115}-\theta_{108/104/115} \quad (2\text{-}2)$$

Now, since $A_{105/104/108}$ and $A_{101/104/103}$ above are individually fixed angles, $\theta_{101/104/115}$ and $\theta_{108/104/115}$ should be determined.

First, $\theta_{101/104/105}$ can be represented, in accordance with the cosine theorem, as $$\theta_{101/104/115}=\cos^{-1}[(L_{101/104}^2+L_{104/115}^2-\lambda_{101/115}^2)/2L_{101/104}\cdot L_{104/115}] \quad (2\text{-}3)$$

Here, $\lambda_{101/115}=(x_{115}^2+y_{115}^2)^{1/2}$, and $x_{115}$ and $y_{115}$ are individually known values obtained by the target bucket tip position detection section 31.

Meanwhile, $\theta_{108/104/115}$ can be represented, in accordance with the cosine theorem, as $$\theta_{108/104/115}=\cos^{-1}[(L_{104/108}^2+\lambda_{104/115}^2-L_{108/115}^2)/2L_{104/108}\cdot\lambda_{104/115}] \quad (2\text{-}4)$$

Here, since $\lambda_{104/115}$ above can be represented as:

$$\lambda_{104/115}=(L_{104/108}^2+L_{108/115}^2-2L_{104/108}\cdot L_{108/115}\cdot\cos\theta_{104/108/115})^{1/2} \quad (2\text{-}5)$$

Further, $\theta_{104/108/115}$ in the present expression (2-5) is represented as $$\theta_{104/108/115}=2\pi-A_{110/108/115}-A_{104/108/107}-\theta_{107/108/110} \quad (2\text{-}6)$$

And $\theta_{107/108/110}$ in this expression (2-6) is represented as $$\theta_{107/108/110}=\theta_{107/108/109}+\theta_{109/108/110} \quad (2\text{-}7)$$

Then, $\theta_{107/108/109}$ and $\theta_{109/108/110}$ in the present expression (2-7) are represented, in accordance with the cosine theorem, as $$\theta_{107/108/109}=\cos^{-1}[(L_{107/108}^2+\lambda_{108/109}^2-L_{107/109}^2)/2L_{107/108}\cdot\lambda_{108/109}] \quad (2\text{-}8)$$

$$\theta_{109/108/110}=\cos^{-1}[(L_{108/110}^2+\lambda_{108/109}^2-L_{109/110}^2)/2L_{108/110}\cdot\lambda_{108/109}] \quad (2\text{-}9)$$

respectively. Here, $\lambda_{108/109}$ in the expressions (2-8) and (2-9) is represented, in accordance with the cosine theorem, as $$\lambda_{108/109}=(L_{107/109}^2+L_{107/108}^2-2L_{107/109}\cdot L_{107/108}\cdot\cos\theta_{108/107/109})^{1/2} \quad (2\text{-}10)$$

Since $\theta_{108/107/109}$ in the present expression (2-10) is the bucket angle as can be seen from FIG. 8, if it is assumed that the angle information detected by the resolver 22 described above which plays the function as a bucket angle sensor is this $\theta_{108/107/109}$, then the unknown values are successively settled in accordance with the expressions (2-4) to (2-10) given above, and consequently, $\theta_{108/104/115}$ in the expression (2-3) is settled.

Accordingly, $\theta_{103/104/105}$ represented by the expression (2-2) is settled, and finally, the calculation target stick position $\lambda_{103/105}$ represented by the expression (2-1) is settled. It is to be noted that, in the present embodiment, since the angle information detected by the resolver 22 is converted into extension/contraction displacement information of the hydraulic cylinder 122 by the signal converter 26, $\theta_{108/107/109}$ in the expression (2-10) above may be determined from the bucket cylinder length in place of the angle information.

In this instance, from FIG. 8, $\theta_{108/107/109}$ can be represented as $$\theta_{108/107/109}=2\pi-A_{105/107/108}-A_{105/107/106}-\theta_{106/107/109} \quad (2\text{-}11)$$

Here, $\theta_{106/107/109}$ in the present expression (2-11) can be represented, in accordance with the cosine theorem, as $$\theta_{106/107/109}=\cos^{-1}[(L_{106/107}^2+L_{107/109}^2-\lambda_{106/109}^2)/2L_{106/107}\cdot\lambda_{107/109}] \quad (2\text{-}12)$$

Since $\lambda_{106/109}$ is the bucket cylinder length obtained from extension/contraction displacement information of the hydraulic cylinder 122, $\theta_{108/107/109}$ represented by the expression (2-11) is settled, and thereafter, the calculation target stick position $\lambda_{103/105}$ is determined in accordance with the expressions (2-1) to (2-10) in a similar manner.

Subsequently, the calculation target boom position setting section (boom control target value setting means) 33 described above is described. The calculation target boom position setting section 33 determines a calculation target boom position (boom control target value) for boom control from operation position information detected by the target bucket tip position detection section 31 by a predetermined calculation, and calculation control target value setting means is composed of the target bucket tip position detection section 31 and the calculation target boom position setting section 33. Then, here, the calculation target boom position (boom cylinder length) $\lambda_{102/111}$ (refer to FIG. 8) is determined by such calculation processing as described below.

The calculation target boom position $\lambda_{102/111}$ can be represented as $$\lambda_{102/111}=(L_{101/102}^2+L_{101/111}^2-2L_{101/102}\cdot L_{101/111}\cdot\cos\theta_{102/101/111})^{1/2} \quad (2\text{-}13)$$

Here, $\theta_{102/101/111}$ in the present expression (2-13) can be represented as $$\theta_{102/101/111}=Axbm+\theta bm \quad (2\text{-}14)$$

$\theta bm$ in this expression (2-14) can be represented as $$\theta bm=A_{102/101/104}+\theta_{104/101/115}+\tan^{-1}(y_{115}/x_{115}) \quad (2\text{-}15)$$

Further, $\theta_{104/101/115}$ in the present expression (2-15) can be represented as $$\theta_{104/101/115}=\cos^{-1}[L_{101/104}^2+\lambda_{101/115}^2-\lambda_{104/115}^2)/2L_{101/104}\cdot\lambda_{101/115}] \quad (2\text{-}16)$$

Here, $\lambda_{101/115}$ in the present expression (2-16) can be represented as $$\lambda_{101/115}=(x_{115}^2+y_{115}^2)^{1/2} \quad (2\text{-}17)$$

If the target bucket tip position ($x_{115}$, $y_{115}$) as the operation position information detected by the target bucket tip position detection section 31 is substituted into $x_{115}$, $y_{115}$ of the present expression (2-17), then the calculation target boom position $\lambda_{102/111}$ can be determined in accordance with the expressions (2-13) to (2-16). It is to be noted that, for $\lambda_{104/115}$, the value calculated in accordance with the expression (2-5) is used.

Further, the actual boom control target value calculation section 34 described above calculates an actual target boom position (actual boom control target value) for boom control from actual posture information of the boom 200 and the stick 300. To this end, the actual boom control target value calculation section 34 includes an actual bucket tip position calculation section 34A and an actual target boom position calculation section (actual boom control target value calculation section) 34B.

Here, the actual bucket tip position calculation section 34A determines the actual tip position of the bucket 400 (actual bucket tip position) by calculation from the actual positions of the boom cylinder 120, stick cylinder 121 and bucket cylinder 122 (extension/contraction displacement information of the cylinder 120 to 122), that is, actual posture information of the boom 200 and the stick 300. Here, the actual bucket tip position calculation section 34A determines the actual bucket tip position ($x_{115}$, $y_{115}$: refer to FIG. 8) from the actual boom cylinder position ($\lambda_{102/111}$) and stick cylinder position ($\lambda_{103/105}$) by such calculation processing as described below.

First, since $x_{115}$ and $y_{115}$ can be represented as $$x_{115}=\lambda_{101/105}\cdot\cos\theta bt \quad (2\text{-}18)$$

$$y_{115}=\lambda_{101/105}\cdot\sin\theta bt \quad (2\text{-}19)$$

respectively, if $\theta bt$ in the expressions (2-18) and (2-19) is calculated, then the actual bucket tip position can be determined. Here, since this $\theta bt$ can be represented as $$\theta bt=\theta bm-\theta_{104/101/115} \quad (2\text{-}20)$$

θbm and $\theta_{104/101/115}$ should be determined. Therefor, $\theta_{104/101/115}$ is determined first. This $\theta_{104/101/115}$ can be represented, from FIG. 8, as $$\theta_{104/101/115}=\cos^{-1}[L_{101/104}^2+\lambda_{101/115}^2-\lambda_{104/115}^2)/2L_{101/104}\cdot\lambda_{101/115}] \quad (2\text{-}21)$$

Then, $\lambda_{101/115}$ in this expression (2-21) can be represented as $$\lambda_{101/115}=(L_{101/104}^2+L_{104/115}^2-2L_{104/115}\cdot\lambda_{104/115}\cdot\cos\theta_{101/104/115})^{1/2} \quad (2\text{-}22)$$

Further, $\theta_{101/104/115}$ in this expression (2-22) can be represented as $$\theta_{101/104/115}=2\pi-A_{101/104/103}-A_{105/104/108}-\theta_{108/104/115}-\theta_{103/104/105} \quad (2\text{-}23)$$

It is to be noted that $\lambda_{104/115}$ in the expression (2-22) above can be determined in accordance with the expression (2-5) given hereinabove, and $\theta_{108/104/115}$ in the expression (2-23) above can be determined in accordance with the expression (2-4) given hereinabove. Further, $\theta_{103/104/105}$ which is unknown in the expression (2-23) above can be calculated as $$\theta_{103/104/105}=\cos^{-1}[L_{103/104}^2+L_{104/105}^2-\lambda_{103/105}^2)/2L_{103/104}\cdot L_{104/105}] \quad (2\text{-}24)$$

Here, since it can be seen that $\lambda_{103/105}$ given above is the stick cylinder length (actual stick cylinder position) from FIG. 8, if this stick cylinder length is determined from extension/contraction displacement information obtained by conversion by the signal converter 26 of actual angle information of the stick 300 obtained by the resolver 21, then $\theta_{103/104/105}$ is settled in accordance with the expression (2-24), and as a result, the unknowns in the expressions (2-22) to (2-23) are settled successively and $\theta_{104/101/115}$ represented by the expression (2-21) is settled.

Meanwhile, θbm in the expression (2-20) given above can be represented, from FIG. 8, as $$\theta bm=\theta_{102/101/111}-A_{102/101/104}-Axbm \quad (2\text{-}25)$$

Further, $\theta_{102/101/111}$ in this expression (2-25) can be represented, in accordance with the cosine theorem, as $$\theta_{102/101/111}=\cos^{-1}[L_{101/102}^2+L_{101/111}^2-\lambda_{102/111}^2)/2L_{101/102}\cdot L_{101/111}] \quad (2\text{-}26)$$

Here, since $\lambda_{102/111}$ in this expression (2-26) is the boom cylinder length (actual boom cylinder position), if this boom cylinder length is determined from extension/contraction information obtained by conversion by the signal converter 26 of actual angle information of the boom 200 obtained by the resolver 20, then $\theta_{102/101/111}$ is settled in accordance with the expression (2-26), and as a result, θbm represented by the expression (2-25) is settled.

Consequently, θbm and $\theta_{104/101/115}$ in the expression (2-20) are settled, and finally, the actual bucket tip position ($x_{115}$, $y_{115}$) is determined from the expressions (2-18) and (2-19).

Further, the actual target boom position calculation section (actual boom control target value calculation section) 34B determines the actual target boom position mentioned hereinabove from tip position information of the bucket 400 obtained by the actual bucket tip position calculation section 34A. It is to be noted that the actual target boom position is determined by performing calculation processing [refer to the expressions (2-13) to (2-17)] similar to that of the calculation target boom position setting section 33 using the actual target boom position obtained by the actual bucket tip position calculation section 34A.

The composite target boom position calculation section (composite control target value calculation means or composite control target value calculation means) 35 determines a composite target boom position (composite boom control target value) from the actual target boom position obtained by the actual target boom position calculation section 34B and the calculation target boom position obtained by the calculation target boom position setting section 33.

Then, in the present embodiment, the boom cylinder 120 is feedback controlled based on the composite target boom position obtained by the composite target boom position calculation section 35 by a boom controlling system 1A' which is composed of the control section 1A and the boom cylinder 120 so that the boom 200 may assume a predetermined posture.

In particular, in the present embodiment, a stick controlling system 1B' feedback controls the hydraulic cylinder 121 based on a target stick position and extension/contraction displacement information (posture information) of the stick 300 detected by the resolver 21 which serves as stick posture detection means, and the boom controlling system 1A' feedback controls the boom cylinder 120 based on a composite target boom position and extension/contraction displacement information (posture information) of the boom 200 detected by the resolver 20 which serves as boom posture detection means so that the boom 200 may assume a predetermined posture.

However, since, in the feedback controls, velocity information is received as an input as shown in FIG. 24, position information such as the bucket tip position and the stick/boom positions described above is used after conversion into velocity information by performing differentiation processing or the like.

Consequently, the controller 1 can control the boom cylinder 120 based on a composite target boom position obtained by composing an ideal calculation target stick position and calculation target boom position (ideal target values for controlling the boom 200 and the stick 300 to respective target postures) obtained by calculation from operation position information of the boom/bucket operation lever 6 and an actual target boom position determined from actual postures of the boom 200 and the stick 300 and taking the actual postures into consideration, and can control the posture of the boom 200 simply and conveniently while always taking the actual postures of the boom 200 and the stick 300 into consideration automatically.

Here, more particularly, the composite target boom position calculation section 36 described above determines a composite target boom position by adding predetermined weight information to an actual target boom position obtained by the actual target boom position calculation section 34B and a boom control target value obtained by the calculation target boom position setting section 33. Here, as shown in FIG. 27, a weight coefficient "W" (first coefficient: where $0 \leqq W \leqq 1$) is added (multiplied) to the calculation target boom position while another weight coefficient "1−W" (second coefficient) is added (multiplied) to the actual target boom position to determine a composite target boom position.

In short, the weight coefficients mentioned above are set so as to have values equal to or larger than 0 but equal to or lower than 1 and besides exhibit a sum value of 1. Accordingly, it can be varied simply to which one of the calculation target boom position and the actual target boom position importance should be attached, and by setting only one "W" of the weight coefficients, it can be set to which one of the calculation target boom position and the actual target boom position importance should be attached.

Figure 28:
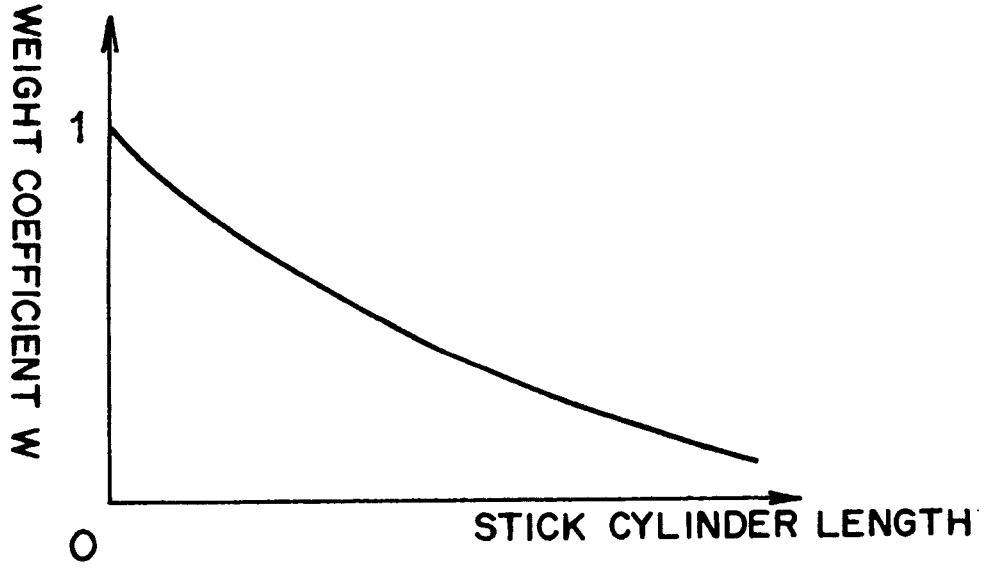
FIG. 28 is a view illustrating an example of setting of a weight coefficient according to the fifth embodiment of the present invention.

It is to be noted that the weight coefficient "W" described above is set in the present embodiment so that, for example, as schematically illustrated in FIG. 28, it decreases as the length of the hydraulic cylinder 121 increases (as the extension amount increases), that is, as the stick 300 approaches the construction machine body 100, and consequently, the composite target boom position calculation section 36 determines a composite target boom position attaching increasing importance to the actual target boom position as the distance of the stick 300 from the construction machine body 100 increases.

Accordingly, for example, when such an operation as to gradually move the boom 200 downwardly as the bucket 400 (stick 300) approaches the construction machine body 100 is performed in order to linearly move the bucket tip 112 of the bucket 400 in the slope face excavation mode, boom control is performed attaching importance to the actual target boom position obtained taking the actual tip position of the bucket 400 (actual postures of the boom 200 and stick 300) into consideration, and such a phenomenon that the boom 200 moves down rapidly from the calculation target boom position due to its weight and the movement of the tip position of the bucket 400 is disordered can be prevented with certainty.

Since the control apparatus for a construction machine as the fifth embodiment of the present invention is constructed in such a manner as described above, when such a slope face excavation operation of a target slope face angle $\alpha$ as shown in FIG. 13 is performed semiautomatically using the hydraulic excavator, such semiautomatic controlling functions as described above can be realized. In particular, detection signals (including setting information of the target slope face angle) from the various sensors are inputted to the controller 1 incorporated in the hydraulic excavator, and the controller 1 controls the main control valves 13, 14 and 15 through the solenoid proportional valves 3A, 3B and 3C based on the detection signals from the sensors (including also detection signals of the resolvers 20 to 22 received through the signal converter 26) to effect such control that the boom 200, stick 300 and bucket 400 may exhibit desired extension/contraction displacements to execute such semiautomatic control as described above. Then, upon the semiautomatic control, the moving velocity and direction of the bucket tip 112 are calculated from information of the target slope face set angle, pilot hydraulic pressures which control the stick cylinder 121 and the boom cylinder 120, a vehicle inclination angle and an engine rotational speed, and target velocities of the cylinders 120, 121 and 122 are calculated based on the information.

However, in the present embodiment, in this instance, a target velocity (target position) of the boom is determined taking the actual postures of the boom 200 and the stick 300 into consideration as described above with reference to FIG. 27. In particular, a target calculation target stick position and calculation target boom position are determined from operation position information of the operation lever 6 and an actual target boom position is determined taking the actual postures of the boom 200 and the stick 300 into consideration, and the position information is composed to determine a composite target boom position. Then, the controller 1 feedback controls the hydraulic cylinder 120 based on the composite target boom position.

As described above, in the system according to the present embodiment, since the boom cylinder 120 is controlled by the controller 1 based on a composite target boom position obtained by composition of ideal calculation target boom/stick positions and actual target boom positions obtained taking the actual postures of the boom 200 and the stick 300 into consideration, while the actual postures of the boom 200 and the stick 300 are automatically taken into consideration, the posture of the boom can be controlled simply and conveniently.

Accordingly, since it is required at least to control the hydraulic cylinder 120, any construction operation (particularly a slope face excavation operation) can be performed very easily and with a high degree of accuracy while constructing the controlling systems 1A' and 1B in a simple construction, and the finish accuracy of a slope face can be augmented remarkably.

Further, in the present embodiment, since the stick controlling system 1B' feedback controls the stick cylinder 121 based on a calculation target stick position and posture information of the stick (the stick cylinder length) and the boom controlling system 1A' feedback controls the hydraulic cylinder 120 based on a composite target boom position and posture information of the boom (the boom cylinder length) so that the boom 200 may assume a predetermined posture, the controls described above can be realized with a simple construction, and this also contributes to reduction in cost of the present apparatus.

Further, since, in this instance, the posture information of the stick 300 is detected from extension/contraction displacement information of the stick cylinder 121 and the posture information of the boom 200 is detected from extension/contraction displacement information of the boom cylinder 120, the actual postures of the stick 300 and the boom 200 can be detected simply and conveniently with certainty, and the accuracy of the posture detection of the boom 200 and the stick 300 can be augmented with a very simple construction.

Furthermore, since, in the actual boom control target value calculation section 34 described above, the actual bucket tip position calculation section 34A calculates the bucket tip position from the actual posture information of the boom 200 and the stick 300 and the actual target boom position calculation section 34B determines the actual target boom position from the bucket tip position obtained by the actual bucket tip position calculation section 34A, the boom cylinder 120 can be controlled so that the bucket tip position may assume a desired position accurately, and a slope face can be formed with a very high degree of accuracy upon slope face excavation or the like.

Further, since the composite target boom position calculation section 35 adds a weight coefficient "W ($0 \leqq W \leqq 1$)" (refer to FIG. 27) to the calculation target base position and adds another weight coefficient "1−W" to the actual target boom position to determine a composite target boom position, to which one of the calculation target boom position and the actual target boom position importance should be attached can be varied simply and conveniently, and only by setting the one weight coefficient "W", to which one of the calculation target boom position and the actual target boom position importance should be attached can be set and composition processing of the target values can be performed at a very high speed.

Furthermore, since the weight coefficient "W" described above is set so that it decreases as the extension amount of the stick cylinder 121 increases (refer to FIG. 28), control wherein increasing importance is attached to the actual target boom position as the extension amount of the hydraulic cylinder 121 increase is performed. Consequently, for example, an error from an ideal posture which arises from a high weight of the boom 200 as the extension amount of the stick cylinder 121 increases can be suppressed efficiently and the boom 200 can be controlled with a high degree of accuracy to a predetermined posture.

Further, in the present embodiment, while the hydraulic circuits for the boom cylinder 120 and the stick cylinder 121 are of the open center type and the extension/contraction displacement velocities of the cylinder type actuators are varied in response to the loads acting upon the hydraulic cylinders, it is very effective to control the cylinder 120 taking the actual postures of the boom 200 and the stick 300 into consideration as described above, and the construction operation accuracy can be augmented remarkably.

It is to be noted that, while, in the present embodiment, the boom 200 (hydraulic cylinder 120) of the boom 200 and the stick 300 as a pair of arm members is controlled based on a composite target boom position determined from an actual target boom position and a calculation target boom position, it is possible to conversely determine a composite target stick position from an actual target stick position and a calculation target stick position and control the stick 300 (hydraulic cylinder 121) based on the composite target stick position.

(6) Description of the Sixth Embodiment

In the following, a control apparatus for a construction machine according to a sixth embodiment is described principally with reference to FIGS. 29 to 30. It is to be noted that the general construction of a construction machine to which the present sixth embodiment is applied is similar to the contents described hereinabove with reference to FIG. 1 and so forth in connection with the first embodiment described above, and the general construction of controlling systems of the construction machine is similar to the contents described hereinabove with reference to FIGS. 2 to 4 in connection with the first embodiment described above. Further, the forms of representative semiautomatic modes of the construction machine are similar to the contents described hereinabove with reference to FIGS. 9 to 14 in connection with the first embodiment described above. Therefore, description of portions corresponding to them is omitted, and in the following, description principally of differences from the first embodiment is given.

By the way, in a common hydraulic excavator, for example, when an operation (raking) of automatically moving the tip of the bucket 400 linearly such as, for example, a horizontal leveling operation using a controller, solenoid valves (control valve mechanisms) in hydraulic circuits which effect supply and discharge of operating oil to and from the hydraulic cylinders 120, 121 and 122 electrically by PID feedback control to control extension/contraction operations of the hydraulic cylinders 120, 121 and 122 to control the postures of the boom 200, stick 300 and bucket 400.

In the hydraulic circuits which control the extension/contraction operations of the hydraulic cylinders 120, 121 and 122, a hydraulic oil pressure is normally produced by a pump which is driven by an engine (prime mover). In this instance, if the rotational speed of the engine is varied by an external load or the like, then the rotational speed of the pump is varied by the variation of the rotational speed of the engine, and also the discharge (delivery capacity) of the pump is varied. Consequently, even if the instruction values (electric currents) to the solenoid valves are same, the extension/contraction velocities of the hydraulic cylinders 120, 121 and 122 are varied. As a result, the posture control accuracy of the bucket 400 is deteriorated, and the finish accuracy of a horizontal leveled face or the like by the bucket 400 is deteriorated.

Therefore, it is a possible idea to use, in order to cope of such a variation of the rotational speed of the engine as described above, a pump of the variable discharge type (variable delivery pressure type, variable capacity type) for the pumps and adjust the tilt angles of the pumps to control so that, even if the rotational speed of the engine (that is, the rotational speeds of the pumps) is varied, the delivery capacity of the pumps may be fixed. However, since such tilt angle control is low in responsibility, target cylinder extension/contraction velocities cannot be secured, and deterioration of the finish accuracy cannot be avoided.

Therefore, the control apparatus for a construction machine as the sixth embodiment of the present invention solves such a subject as described above and is constructed such that, even if a delivery capacity variation factor of the pumps occurs with the engine (prime mover), the operation velocities of cylinder type actuators can be secured quickly against the variation to achieve augmentation of the finish accuracy.

First, a general construction of the control apparatus for a construction machine of the present embodiment is described. As described already with reference to FIG. 2, hydraulic circuits (fluid pressure circuits) for the hydraulic cylinder 120 to 122, the hydraulic motor and the revolving motor are provided, and in the hydraulic circuits, in addition to pumps 51 and 52 of the variable discharge type (variable delivery pressure type, variable capacity type) which are driven by an engine 700 (prime mover of the rotational output type such as a Diesel engine), a boom main control valve (control valve, control valve mechanism) 13, a stick main control valve (control valve, control valve mechanism) 14, a bucket main control valve (control valve, control valve mechanism) 15 and so forth are interposed. The pumps 51 and 52 of the variable discharge type can vary the discharges of operating oil to the hydraulic circuits by individually adjusting the tilt angles thereof by means of an engine pump controller 27 which will be hereinafter described. It is to be noted that, where a line which interconnects different components in FIG. 2 is a solid line, this indicates that the line is an electric circuit, but where a line which interconnects different components is a broken line, this indicates that the line is a hydraulic circuit.

The engine pump controller 27 receives engine rotational speed information from an engine rotational speed sensor 23 and controls the tilt angles of the engine 700 and the pumps 51 and 52 of the variable discharge type (variable delivery pressure type, variable capacity type), and can communicate coordination information with the controller 1.

Figure 29:
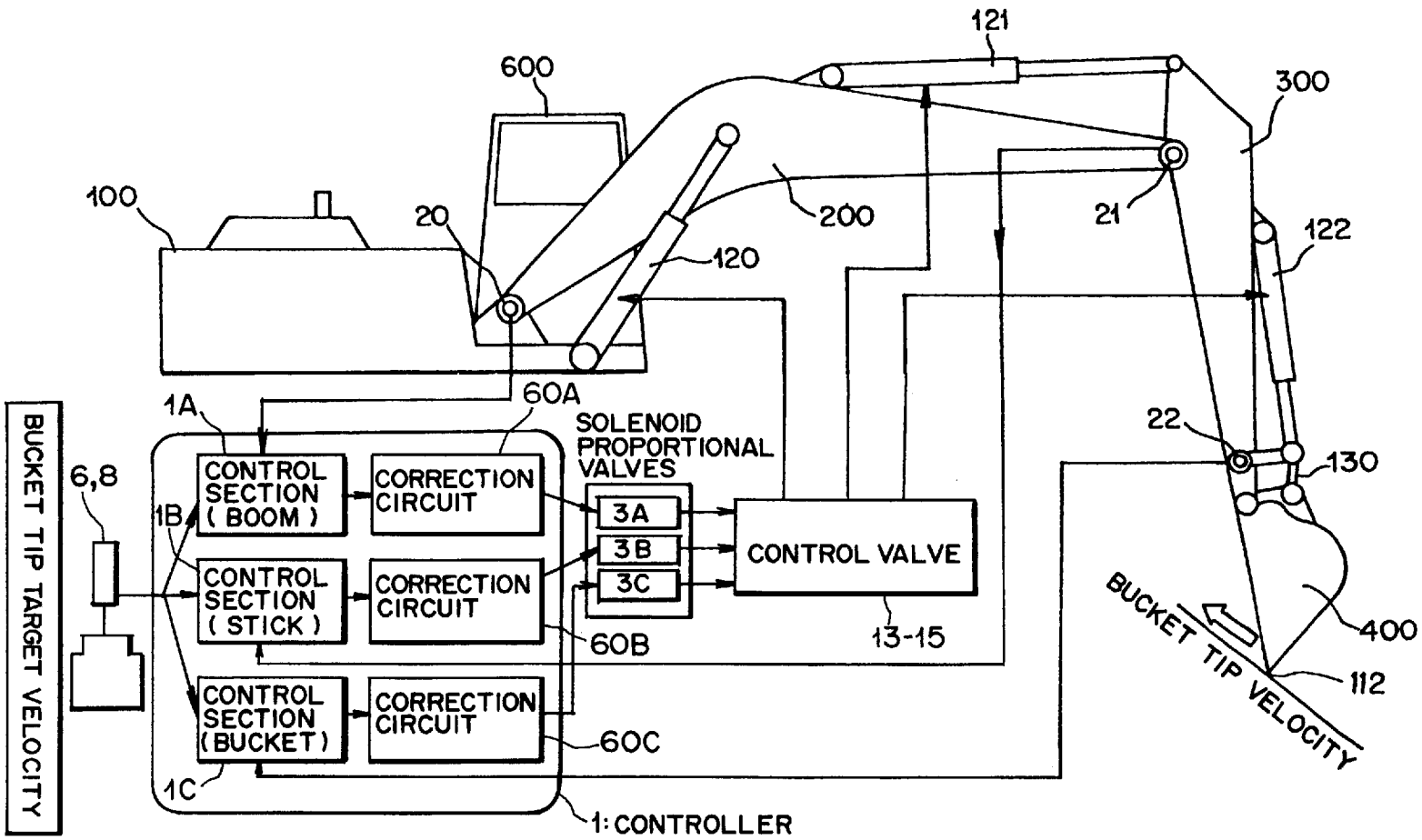
FIG. 29 is a block diagram schematically showing a construction of an entire control apparatus according to a sixth embodiment of the present invention.

In the control apparatus of the present embodiment, control sections 1A to 1C of the controller 1 shown in FIG. 29 serve as controlling means for supplying control signals (solenoid valve instruction valves) to solenoid proportional valves 3A to 3C based on detection results detected by the resolvers 20 to 22 (actually the results after conversion by the signal converter 26) so that the boom 200, stick 300 and bucket 400 may have predetermined postures to control the cylinders 120 to 122, respectively. Further, in the present embodiment, the prime mover for driving the pumps 51 and 52 is the engine (Diesel engine) 700 of the rotational output type, and the engine rotational speed sensor 23 functions as variation factor detection means for detecting the rotational speed of the engine 700 as a delivery capacity variation factor of the pumps 51 and 52.

Then, as shown in FIG. 29, correction circuits (correction means) 60A, 60B and 60C are provided in the stage following the control sections 1A, 1B and 1C in the controller 1, respectively. The correction circuits (correction means) 60A to 60C correct, if a delivery capacity variation factor of the pumps 51 and 52 is detected by the engine rotational speed sensor 23, then solenoid valve instruction values from the control sections 1A to 1C in response to the delivery capacity variation factor. More particularly, the correction circuits 60A to 60C correct solenoid valve instruction values from the control sections 1A to 1C in response to a detection result of the engine rotational speed sensor 23 and outputs modified solenoid valve instruction values obtained by the correction to the solenoid proportional valves 3A to 3C. A detailed construction of the correction circuits 60A to 60C is shown in FIG. 30.

Figure 30:
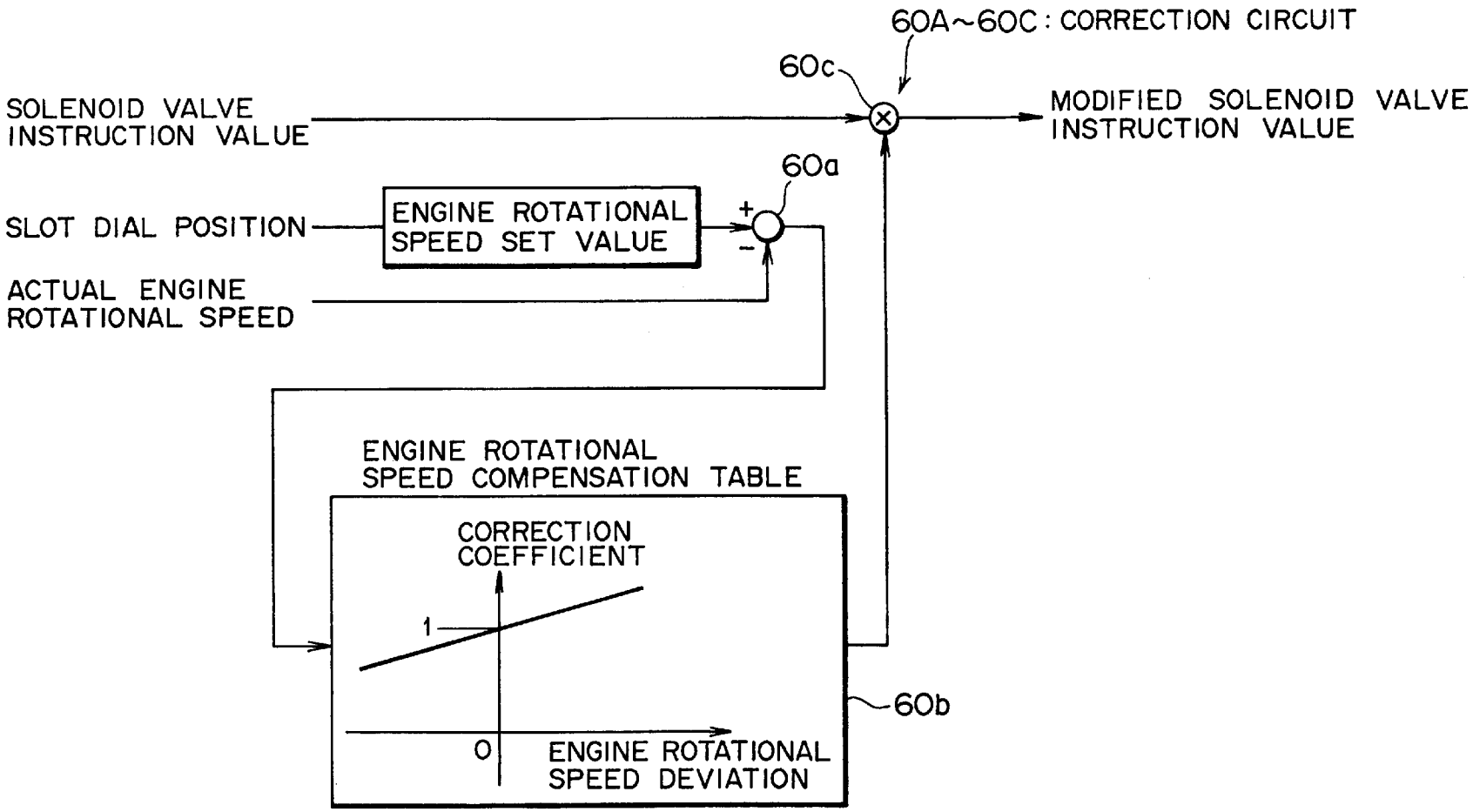
FIG. 30 is a block diagram showing a functional construction of a correction circuit of the control apparatus according to the sixth embodiment of the present invention.

As shown in FIG. 30, each of the correction circuits 60A to 60C includes a subtractor 60*a*, an engine rotation compensation table 60*b* and a multiplier 60*c*.

The subtractor (deviation calculation means) 60*a* calculates a deviation between an engine rotational speed set value (reference rotational speed information) and an actual engine rotational speed (actual rotational speed information) of the engine 700 detected by the engine rotational speed sensor 23, [engine rotational speed set value]–[actual engine rotational speed].

Here, the engine rotational speed set value is set by operator operating a throttle dial (not shown), and information corresponding to the position of the throttle dial is set as an engine rotational speed set value into a predetermined area on a memory (for example, a RAM) or a register which composes the controller 1. In short, in the present embodiment, the throttle dial not shown and the predetermined area on the memory or the register function as reference rotational speed setting means for setting reference rotational speed information of the engine 700.

Meanwhile, the engine rotational speed compensation table 60*b* and the multiplier 60*c* function as correction information calculation means for calculating correction information for correcting a solenoid valve instruction value (control signal) in response to a deviation obtained by the subtractor 60*a*.

The engine rotational speed compensation table 60*b* is provided to output a correction coefficient (correction information) for correcting a solenoid valve instruction value corresponding to a deviation from the subtractor 60*a* and is stored in advance in a memory (for example, a ROM or a RAM) which composes the controller 1 such that, by using a table lookup technique, a correction coefficient corresponding to a deviation from the subtractor 60*a* is read out.

The multiplier 60*c* multiplies a solenoid valve instruction value from each of the control section 1A to 1C and a correction coefficient read out from the engine rotational speed compensation table 60*b* and outputs the product as a modified solenoid valve instruction value to each of the solenoid proportional valves 3A to 3C.

In the engine rotational speed compensation table 60*b*, correction coefficients linear with respect to the engine rotational speed deviation calculated by the subtractor 60*a* are set, for example, as illustrated in FIG. 30.

Particularly, where the engine rotational speed set value and the actual engine rotational speed are equal (where the deviation is 0), 1 is set as the correction coefficient, and from the multiplier 60*c*, solenoid valve instruction values from the control sections 1A to 1C are outputted as they are without being varied, but when the actual engine rotational speed drops (when the deviation becomes a positive value), since the discharges of the pumps 51 and 52 are reduced, correction coefficients higher than 1 are set so that the instruction values (electric currents) to the solenoid proportional valves 3A to 3C may be increased by the reduced amounts, and the solenoid valve instruction values from the control sections 1A to 1C are outputted from the multiplier 60*c* after they are varied by great amounts with the correction coefficients.

On the contrary, when the actual engine rotational speed increases (when the deviation becomes a negative value), since the discharges of the pumps 51 and 52 increase, correction coefficients smaller than 1 are set so that the instruction values (electric currents) to the solenoid proportional valves 3A to 3C may be decreased by the increased amounts, and the solenoid valve instruction values from the control sections 1A to 1C are outputted from the multiplier 60*c* after they are varied by small amounts with the correction coefficients.

It is to be noted that the correction coefficients of the engine rotational speed compensation table 60*b* may be set linearly over the overall range of the engine rotational speed deviation or an upper limit value and a lower limit value may be provided.

Since the control apparatus for a construction machine as the sixth embodiment of the present invention is constructed in such a manner as described above, if a delivery capacity variation factor of the pumps 51 and 52 by the engine 700 (a variation of the rotational speed of the engine 700) is detected by the engine rotational speed sensor 23, then the instruction values from the control sections 1A to 1C to the solenoid proportional valves 3A to 3C are corrected in response to the variation, and consequently, even if a delivery capacity variation factor of the pumps 51 and 52 occurs, control of the solenoid proportional valves 3A to 3C and hence the main control valves 13 to 15 in accordance with the variation is performed, and the operation velocities of the cylinders 120 to 122 can be secured rapidly in response to the variation.

Describing more particularly, if the rotational speed of the engine 700 drops, then the solenoid valve instruction values from the control section 1A to 1C are multiplied by a correction coefficient larger than 1 corresponding to the rotational speed deviations by the correction circuits 60A to 60C so that they are modified so as to become higher than the initial values, and the modified solenoid valve instruction values are supplied to the solenoid proportional valves 3A to 3C. Accordingly, control of the solenoid proportional valves 3A to 3C (main control valves 13 to 15) corresponding to the reduced amounts of the discharges of the pumps 51 and 52 caused by the drop of the rotational speed of the engine 700 is performed, and the operation speeds of the cylinders 120 to 122 is secured.

On the contrary, if the rotational speed of the engine 700 increases, then the solenoid valve instruction values from the control sections 1A to 1C are multiplied by a correction coefficient smaller than 1 in accordance with the rotational speed deviations by the correction circuits 60A to 60C so that they are modified so as to become lower than the initial values, and the modified solenoid valve instruction values are supplied to the solenoid proportional valves 3A to 3C. Accordingly, control of the solenoid proportional valves 3A to 3C (main control valves 13 to 15) corresponding to the increased amounts of the discharges of the pumps 51 and 52 caused by the drop of the rotational speed of the engine 700 is performed, and the operation speeds of the cylinders 120 to 122 are secured.

Prevention of control accuracy deterioration by the engine rotational speed sensor 23 is such as follows. In particular, with regard to correction of a target bucket tip velocity, the target bucket tip velocity is determined by the positions of the operation levers 6 and 8 and the engine rotational speed. Further, since the hydraulic pumps 51 and 52 are directly coupled to the engine 700, when the engine rotational speed is low, also the pump discharges decrease and the cylinder velocities decrease. Therefore, the engine rotational speed is detected, and the target bucket tip velocity is calculated so that it may match with the variations of the pump discharges. Such an operation as just described is performed, in the present embodiment, in parallel to operations by the correction circuits 60A to 60C described above.

While various controls are performed by the controller 1 in this manner, in the system according to the present embodiment, if a rotational speed variation of the engine 700 is detected by the engine rotational speed sensor 23, then control signals (instruction values) to the solenoid proportional valves 3A to 3C are corrected in response to the rotational speed variation amount (deviation between the actual engine rotational speed and the engine rotational speed set value), even if a delivery capacity variation factor of the pumps 51 and 52, for example, a variation of the rotational speed of the engine 700, occurs, hydraulic circuit control (control of the solenoid proportional valves 3A to 3C and the main control valves 13 to 15) corresponding to the variation is performed. Accordingly, the cylinders 120 to 122 are controlled rapidly against the variation and the operation velocities thereof are secured, and the finish accuracy of a horizontally leveled face by the bucket 400 is augmented significantly.

Further, in the present embodiment, by adjusting the tilt angles of the pumps 51 and 52 in response to a detection result by the engine rotational speed sensor 23 by means of the engine pump controller 27, tilt angle control for controlling the delivery capacities of the pumps 51 and 52 so that they may be fixed even if the rotational speed of the engine 700 varies is performed in parallel, and by using both of this tilt angle control and the correction operation of the solenoid valve instruction values by the correction circuits 60A to 60C, a countermeasure against a delivery capacity variation factor of the pumps 51 and 52 can be taken further rapidly, which contributes to augmentation of the finish accuracy.

(7) Description of the Seventh Embodiment

In the following, a control apparatus for a construction machine according to a seventh embodiment is described principally with reference to FIGS. 31 to 33. It is to be noted that the general construction of a construction machine to which the present seventh embodiment is applied is similar to the contents described hereinabove with reference to FIG. 1 and so forth in connection with the first embodiment described above, and the general construction of controlling systems of the construction machine is similar to the contents described hereinabove with reference to FIGS. 2 to 4 in connection with the first embodiment described above. Further, the forms of representative semiautomatic modes of the construction machine are similar to the contents described hereinabove with reference to FIGS. 9 to 14 in connection with the first embodiment described above. Therefore, description of portions corresponding to them is omitted, and in the following, description principally of differences from the first embodiment is given.

Generally, the hydraulic excavator is constructed such that the boom 200 (hydraulic cylinder 120), stick 300 (hydraulic cylinder 121) and bucket 400 (hydraulic cylinder 122) are electrically PID feedback controlled individually using solenoid valves or the like, and can keep a desired target operation (posture) accurately while suitably correcting control of the position and the posture of the working member.

It is to be noted that it is assumed here that, for hydraulic circuits for at least the boom 200 (hydraulic cylinder 120) and the stick 300 (hydraulic cylinder 121), a so-called open center type circuit wherein the extension/contraction displacement velocities of the hydraulic cylinders 120 and 121 vary depending upon the loads applied to the hydraulic cylinders 120 and 121, respectively, is used.

By the way, in the hydraulic excavator described above, since an open center type circuit is used for the hydraulic circuits as described above, for example, where the excavation load is very heavy, as the load increases, the hydraulic pressures of the boom 200 (hydraulic cylinder 120) and the stick 300 (hydraulic cylinder 121) rise and the extension/contraction displacement velocities of the hydraulic cylinders 120 and 121 decrease, and the operations of the boom 200 and the stick 300 (that is, the operation of the bucket tip) are sometimes stopped finally.

In this instance, in a PID feedback controlling system, since the velocity information (P) of the bucket tip is reduced to zero and the position information (D) is fixed to a value equal to that upon stopping of the stick, the information (proportional operation factors) does not have an influence on target velocities for the extension/contraction displacement velocities of the hydraulic cylinders 120 and 121, but since I (integration factor) is involved in the controlling system, the target velocities of the hydraulic cylinders 120 and 121 continue to increase resultantly.

Accordingly, if, for example, a rock under excavation which has been caught by the bucket tip breaks in this condition and the load is removed suddenly from the boom 200 and the stick 300, then the hydraulic cylinders 121 and 122 will suddenly begin to move at velocities much higher than their target velocities. As a result, the finish accuracy in an excavation operation is deteriorated significantly.

Therefore, the control apparatus for a construction machine as the seventh embodiment of the present invention is constructed such that the extension/contraction displacement velocities of the cylinders 121 and 122 are reduced in response to an increase of the loads to the hydraulic cylinders 121 and 122 so that, even if the loads acting upon the hydraulic cylinders 121 and 122 are removed suddenly, the extension/contraction displacements of the cylinders 121 and 122 can be controlled smoothly.

First, a general construction of the present apparatus is described. The controller 1 of the present apparatus includes control section 1A, 1B and 1C for the cylinders 120, 121 and 122, and each of the controls is formed as a control feedback loop (refer to FIGS. 3 and 4).

The compensation construction in the closed loop controls shown in FIG. 4 has, in each of the boom control sections 1A, 1B and 1C, a multiple freedom degree construction of a feedback loop and a feedforward loop with regard to the displacement and the velocity as shown in FIG. 5, and includes feedback loop type compensation means 72 having a variable control gain (control parameter), and feedforward type compensation means 73 having a variable control gain (control parameter).

In particular, if a target velocity (control target value) is given from operation position information of the operation levers (arm mechanism operation members) 6 and 8 by a target cylinder velocity setting section (control target value setting means) 80, then as regards feedback loop processing, feedback loop processes according to a route wherein a deviation between the target velocity and velocity feedback information is multiplied by a predetermined gain Kvp (refer to reference numeral 62), another route wherein the target velocity is integrated once (refer to an integration element 61 of FIG. 5) and a deviation between the target velocity integration information and displacement feedback information is multiplied by a predetermined gain Kpp (refer to reference numeral 63) and a further route wherein the deviation between the target velocity integration information and the displacement feedback information is multiplied by a predetermined gain Kpi (refer to reference numeral 64) and further integrated (refer to reference numeral 66) are performed while, as regards the feedforward loop processing, a feedforward loop process by a route wherein the target velocity is multiplied by a predetermined gain Kf (refer to reference numeral 65) is performed.

In short, in the control sections 1A, 1B and 1C of the present embodiment, the hydraulic cylinders 120, 121 and 122 are controlled, respectively, by the feedback controlling systems each of which has at least a proportional operation factor and an integration operation factor so that the boom 200 and the stick 300 may assume predetermined postures (in the present embodiment, particularly so that the bucket 400 may move at a predetermined moving velocity).

It is to be noted that the values of the gains Kvp, Kpp, Kpi and Kf mentioned above can individually be varied by a gain scheduler (control parameter scheduler) 70, and the boom 200, the bucket 400 and so forth are controlled to target operation conditions by varying and correcting the values of the gains Kvp, Kpp, Kpi and Kf in this manner.

Further, while a non-linearity removal table 71 is provided as shown in FIG. 5 to remove non-linear properties of the solenoid proportional valves 3A to 3C, the main control valves 13 to 15 and so forth, a process in which the non-linearity removal table 71 is used is performed at a high speed by a computer using a table lookup technique.

In the following, a construction of essential part of the present embodiment is described. Of the control sections 1A, 1B and 1C, the control section 1B includes, as shown in FIG. 31, a cylinder load detection section (actuator load detection means) 181, switches 182 and 183, a low-pass filter 184, a differentiation processing section 185, a switch control section 186 and a target cylinder velocity correction section 187, and an I gain correction section 70*a* is provided in the gain scheduler 70.

Here, the cylinder load detection section 181 detects a load condition to the hydraulic cylinder 121, and the switches 182 and 183 effect switching between a route 188 along which load information of the hydraulic cylinder 121 detected by the cylinder load detection section 181 is outputted as it is to the target cylinder velocity correction section 187 and another route 189 along which the load information is outputted to the target cylinder velocity correction section 187 after an integration process is performed for it by the low-pass filter 184, and are switched simultaneously by the switch control section 186.

Figure 32:
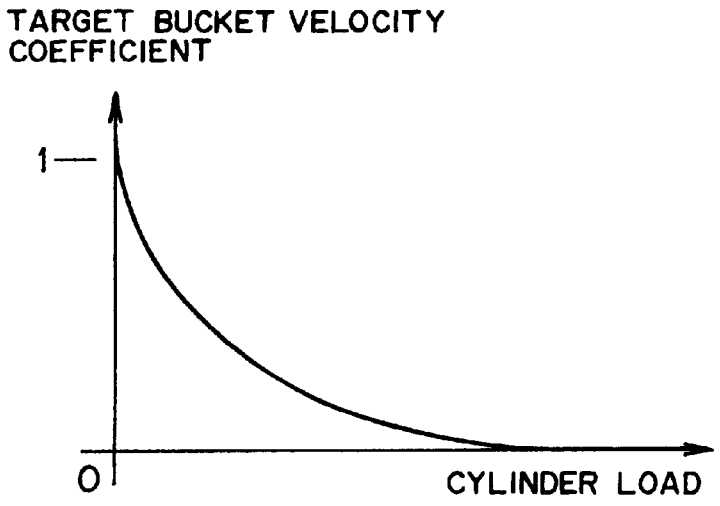
FIG. 32 is a view for explaining a characteristic of a target cylinder velocity correction section according to the seventh embodiment of the present invention.
Figure 33:
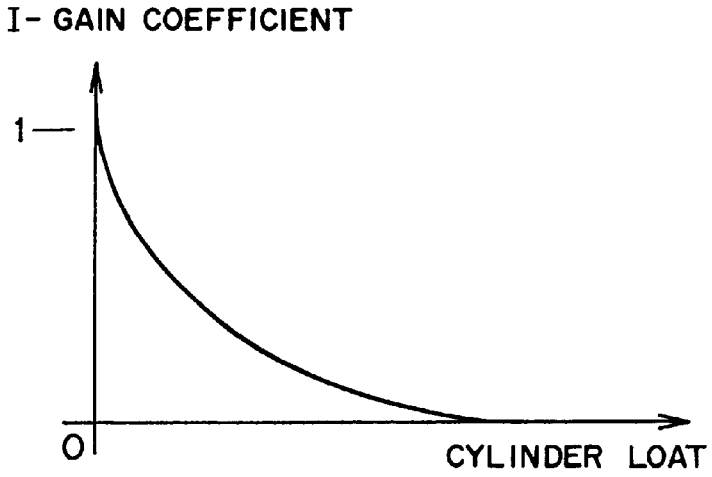
FIG. 33 is a view for explaining a characteristic of an I gain correction section according to the seventh embodiment of the present invention.

The target cylinder velocity correction section (first or fourth correction means) 187 reduces, when the cylinder load detected by the cylinder load detection section 181 is higher than a predetermined value, a target velocity set by the target cylinder velocity setting section 80 in response to the cylinder load condition then to reduce the moving velocity of the bucket 400 by the hydraulic cylinder 121, and is constructed such that it multiplies load information inputted thereto through the route 188 or 189 by a target bucket velocity coefficient having such a characteristic as illustrated, for example, in FIG. 32 to increase the reduction amount of the target velocity as the cylinder load increases to decrease the moving velocity of the bucket 400.

Consequently, even if the load to the cylinder 121 is removed suddenly, the control section 1B can control smoothly without varying the extension/contraction displacement of the cylinder 121 (the moving velocity of the bucket 400) suddenly.

Figure 31:
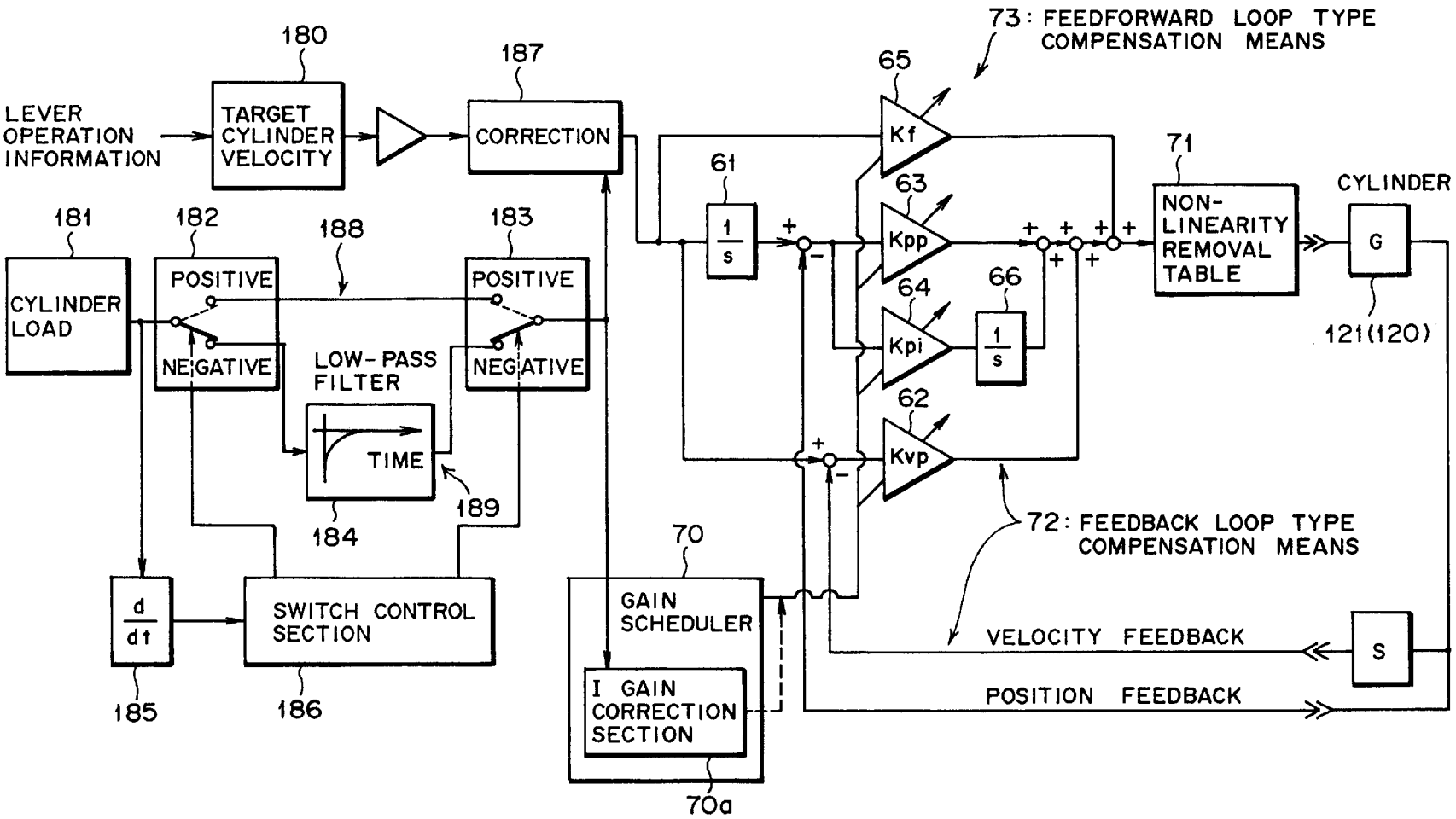
FIG. 31 is a control block diagram of essential part according to a seventh embodiment of the present invention.

By the way, the low-pass filter (integration means) 184 described above has, in the present embodiment, such an integration characteristic as illustrated in this FIG. 31, and is provided to integrate, when load information of the hydraulic cylinder 121 detected by the cylinder load detection section 181 is inputted, the load information to moderate the variation of the load information with respect to the time axis so that, if the switches 182 and 183 are switched to the present low-pass filter 184 (route 189) side, then the variation of input load information to the target cylinder velocity correction section 187 may be moderated. It is to be noted that an integrating circuit other than a low-pass filter may be used for this integration means.

Further, the differentiation processing section 185 performs differentiation processing for load information detected by the cylinder load detection section 181 to detect the rate of change of the load information with respect to time. The switch control section 186 switches the switches 182 and 183 in response to the rate of change of the load information obtained by the differentiation processing section 185. Here, the switch control section 186 switches the switches 182 and 183 to the route 188 side when the rate of change of the load information is positive, but switches the switches 182 and 183 to the route 189 side when the rate of change of the load information is negative.

In short, in the present control section 1B, in a transient condition wherein the rate of change of the load information is negative (when the load acting upon the hydraulic cylinder 121 decreases) and the cylinder load detected by the cylinder load detection section 181 changes from a condition wherein it is higher than a predetermined value to another condition wherein it is lower than the predetermined value, the switches 182 and 183 are switched to the low-pass filter 184 side so that the moving velocity of the bucket 400 by the hydraulic cylinder 121 is increased based on the load information obtained through the low-pass filter 184.

Consequently, since the control section 1B increases, when the load acting upon the cylinder 121 decreases, the moving velocity of the bucket 400 based on load information whose variation is moderated by the low-pass filter 184, even if the load acting upon the bucket 400 is removed suddenly, the bucket 400 can be moved slowly and smoothly.

It is to be noted that, in the present embodiment, this function (third or sixth correction means) is realized by the low-pass filter 184 and the target cylinder velocity correction section 187.

Meanwhile, the I gain correction section (second or fifth correction means) 70*a* provided in the gain scheduler 70 regulates, when cylinder load information detected by the cylinder load detection section 181 is higher than the predetermined value, the feedback control by the I gain Kpi, which is an integration operation factor, in response to the cylinder load condition. Here, the I gain correction section 70*a* multiplies the I gain Kpi by an I gain coefficient having such a characteristic as illustrated, for example, in FIG. 33 to increase the regulation amount of the feedback control by the I gain Kpi in response to the increase of the cylinder load so that the I gain Kpi may approach zero.

In short, the present I gain correction section 70*a* prevents the extension/contraction displacement velocity of the cylinder 121 from continuing to be increased by an integration operation factor even if the load to the cylinder 121 becomes extremely high and exceeds the predetermined value. It is to be noted that, in this instance, since no such regulation is performed for the other gains Kf, Kpp and Kvp (proportional operation elements), a minimum necessary excavation force (extension/contraction displacement velocity of the hydraulic cylinder 121) upon excavation by the bucket 400 is secured (maintained) by the gains Kf, Kpp and Kvp.

It is to be noted that, while, in the present embodiment, only the control section 1B has the construction shown in FIG. 31, also the control section 1A which is a boom controlling system may be constructed in a similar manner as that shown in FIG. 31.

Since the control apparatus for a construction machine as the seventh embodiment of the present invention is constructed in such a manner as described above, upon semi-automatic control, if the cylinder load detected by the cylinder load detection section 181 in the control section 1B is higher than the predetermined value, then the reduction amount of the target velocity is increased as the cylinder load increases to decrease the moving velocity of the bucket 400 while the regulation amount of the feedback control by the I gain Kpi is increased so that the I gain Kpi may approach zero.

Consequently, even if a rock under excavation which has been caught by the tip 112 breaks or the like and the load to the hydraulic cylinder 121 is removed suddenly, the bucket 400 is controlled smoothly without a sudden variation of the moving velocity thereof. Meanwhile, when the load acting upon the hydraulic cylinder 121 decreases, since the moving velocity of the bucket 400 is increased based on load information whose variation is moderated by the low-pass filter 184, even if the load acting upon the bucket 400 is removed suddenly as described above, the bucket 400 operates slowly and smoothly.

Therefore, in the system according to the present embodiment, since the control section 1B controls the stick cylinder 121 such that, when the load to the stick cylinder 121 is higher than the predetermined value, the target velocity is reduced to reduce the extension/contraction displacement velocity of the stick cylinder 121, even if the load to the cylinder 121 is removed suddenly, the bucket 400 can be controlled very smoothly without allowing the extension/contraction displacement of the cylinder 121 to vary suddenly. Accordingly, the finish accuracy in a desired construction operation such as formation of a slope face is augmented significantly.

Further, in this instance, since the control section 1B feedback controls the cylinder 121 based on a target velocity and posture information of the stick 300 so that the bucket 400 may move at a predetermined moving velocity, the moving velocity of the bucket 400 can be controlled further accurately, and the finish accuracy in a desired construction operation is further augmented.

Here, since the posture information of the stick 300 described above is detected, in the present embodiment, from extension/contraction displacement information of the cylinder 121, it can be acquired simply and conveniently with a very simple construction, and this contributes very much to simplification of the controller 1.

Further, since, where the load to the cylinder 121 is higher than the predetermined value, the feedback control of the cylinder 121 by the I gain Kpi is regulated in response to the load condition, it can be prevented with certainty that the extension/contraction displacement velocity of the cylinder 121 (the excavation force of the bucket 400) continues to be increased by an integration operation factor while a minimum necessary extension/contraction displacement velocity of the hydraulic cylinder 121 is secured (maintained). Accordingly, a desired construction operation can be performed with a high degree of accuracy and efficiently.

Further, in the present embodiment, since, as the load to the cylinder 121 increases, the reduction amount of the target velocity is increased (refer to FIG. 32) to reduce the moving speed of the bucket 400, the moving speed of the bucket 400 can be reduced (varied) very smoothly with simple and easy setting, and this contributes very much to simplification of the controller 1 and augmentation of the performance.

Further, in the present embodiment, since the regulation amount of the feedback control by the I gain Kpi is increased as the load to the cylinder 121 increases as described with reference to FIG. 33, an increase of the extension/contraction displacement velocity of the cylinder 121 (the moving speed of the bucket 400) by the I gain Kpi can be prevented to cope with a sudden load variation to the cylinder 121 very rapidly with simple and easy setting.

Furthermore, since, in a transition condition wherein the load to the cylinder 121 comes to a condition wherein it is lower than the predetermined value, the moving speed of the bucket 400 is increased based on the load information whose variation is moderated by the low-pass filter 184, even if the load to the cylinder 121 is removed suddenly, the moving speed of the bucket 400 can be increased slowly. Accordingly, even if the load is removed suddenly, the bucket 400 is controlled very smoothly, and consequently, the finish accuracy in a desired construction operation is further augmented significantly.

It is to be noted that, wile the control section 1B described above is effective particularly where the hydraulic circuit for the cylinder 121 is of the open center type, similar actions and effects to those described above can be anticipated even where it is applied to a hydraulic circuit of another type.

Further, while, in the present embodiment, the I gain correction section 70*a*, low-pass filter 184 and target cylinder velocity correction section 187 are provided in the control section 1B, a countermeasure against a sudden load variation to the cylinder 121 can be taken if at least the target cylinder velocity correction section 187 is provided.

(8) Description of the Eighth Embodiment

In the following, a control apparatus for a construction machine according to an eighth embodiment is described principally with reference to FIGS. 34 to 36. It is to be noted that the general construction of a construction machine to which the present eighth embodiment is applied is similar to the contents described hereinabove with reference to FIG. 1 and so forth in connection with the first embodiment described above, and the general construction of controlling systems of the construction machine is similar to the contents described hereinabove with reference to FIGS. 2 to 4 in connection with the first embodiment described above. Further, the forms of representative semiautomatic modes of the construction machine are similar to the contents described hereinabove with reference to FIGS. 9 to 14 in connection with the first embodiment described above. Therefore, description of portions corresponding to them is omitted, and in the following, description principally of differences from the first embodiment is given.

By the way, in a common hydraulic excavator, such control that the angle (bucket angle) of the bucket 400 with respect to a horizontal direction (vertical direction) is always kept fixed even if the boom 200 and the stick 300 are moved such as where excavated sand and earth or the like are conveyed while they are accommodated in the bucket 400 is sometimes required.

In this instance, with the PID feedback controlling system for the bucket 400 (hydraulic cylinder 122), if the deviation between the actual bucket angle and the target bucket angle becomes large during operation of the boom 200 and the stick 300, then the instruction value (control target value) to the hydraulic cylinder 122 is increased to decrease the deviation by an action of the I (integration factor) of the P (proportion factor), I (integration factor) and D (differentiation factor).

However, when the operation levers (operation members) 6 and 8 for the boom 200, stick 300 and bucket 400 are moved to their neutral positions (inoperative positions) to stop the bucket 400, in the controlling system described above, since the instruction value to the hydraulic cylinder 122 is not reduced to zero immediately due to an accumulation amount of the I (integration factor) till the stopping time, even if the operation levers 6 and 8 are moved to the inoperative positions, the bucket 400 does not stop immediately and an overshoot occurs, resulting in deterioration of the control accuracy.

The control apparatus for a construction machine as the eighth embodiment of the present invention is constructed so as to solve such a subject as just described, and prevents an overshoot of the bucket (working member) 400 when the operation levers 6 and 8 are positioned to their inoperative positions thereby to achieve augmentation of the control accuracy of the working member.

In the following, the present embodiment is described. First, in the present embodiment, boom hydraulic cylinder extension/contraction displacement detection means for detecting extension/contraction displacement information of the boom hydraulic cylinder 120 is composed of the signal converter 26 and the resolver 20 which serves as boom posture detection means, and stick hydraulic cylinder extension/contraction displacement detection means for detecting extension/contraction displacement information of the stick hydraulic cylinder 121 is composed of the signal converter 26 and the resolver 21 which serves as stick posture detection means, and furthermore, bucket hydraulic cylinder extension/contraction displacement detection means is composed of the signal converter 26 and the resolver 22 which serves as bucket posture detection means (refer to FIG. 1)

The boom control sections 1A, 1B and 1C of the controller 1 basically have a multiple freedom degree construction of a feedback loop and a feedforward loop with regard to the displacement and the velocity and includes feedback loop type compensation means 72 having a variable control gain (control parameter), feedforward type compensation means 73 having a variable control gain (control parameter), and target cylinder velocity setting means 80 for determining target velocities (control target values) of the cylinders 120, 121 and 122 from operation position information of the operation levers 6 and 8 (refer to FIG. 5).

In particular, if a target velocity (control target value) is given from operation position information of the operation levers (arm mechanism operation members) 6 and 8 by the target cylinder velocity setting section (control target value setting means) 80, then as regards feedback loop processing, feedback loop processes according to a route (differentiation operation factor D) wherein a deviation between the target velocity and velocity feedback information is multiplied by a predetermined gain Kvp (refer to reference numeral 62), another route (proportion operation factor P) wherein the target velocity is integrated once (refer to an integration element 61 of FIG. 5) and a deviation between the target velocity integration information and displacement feedback information is multiplied by a predetermined gain Kpp (refer to reference numeral 63) and a further route (integration operation factor I) wherein the deviation between the target velocity integration information and the displacement feedback information is multiplied by a predetermined gain Kpi (refer to reference numeral 64) and further integrated (refer to reference numeral 66) are performed while, as regards the feedforward loop processing, a process by a route wherein the target velocity is multiplied by a predetermined gain Kf (refer to reference numeral 65) is performed.

In short, in the control sections 1A, 1B and 1C of the present embodiment, the hydraulic cylinders 120, 121 and 122 are controlled, respectively, by the PID feedback controlling systems each of which has the proportional operation factor P, the integration operation factor I and the differentiation operation factor D, based on the given target velocity and posture information of the boom 200, stick 300 and bucket 400 detected by the resolvers 20 to 22 (here, extension/contraction displacement information of the cylinders 120, 121 and 122 detected by the respective resolvers 20, 21 and 22) so that the boom 200 and the stick 300 may assume predetermined postures.

It is to be noted that the values of the gains Kvp, Kpp, Kpi and Kf mentioned above can individually be varied by a gain scheduler (control parameter scheduler) 70, and the boom 200, the bucket 400 and so forth are controlled to target operation conditions by varying and correcting the values of the gains Kvp, Kpp, Kpi and Kf in this manner.

Further, while a non-linearity removal table 71 is provided in order to remove non-linear properties of the solenoid proportional valves 3A to 3C, the main control valves 13 to 15 and so forth, a process in which the non-linearity removal table 71 is used is performed at a high speed by a computer using a table lookup technique.

Figure 34:
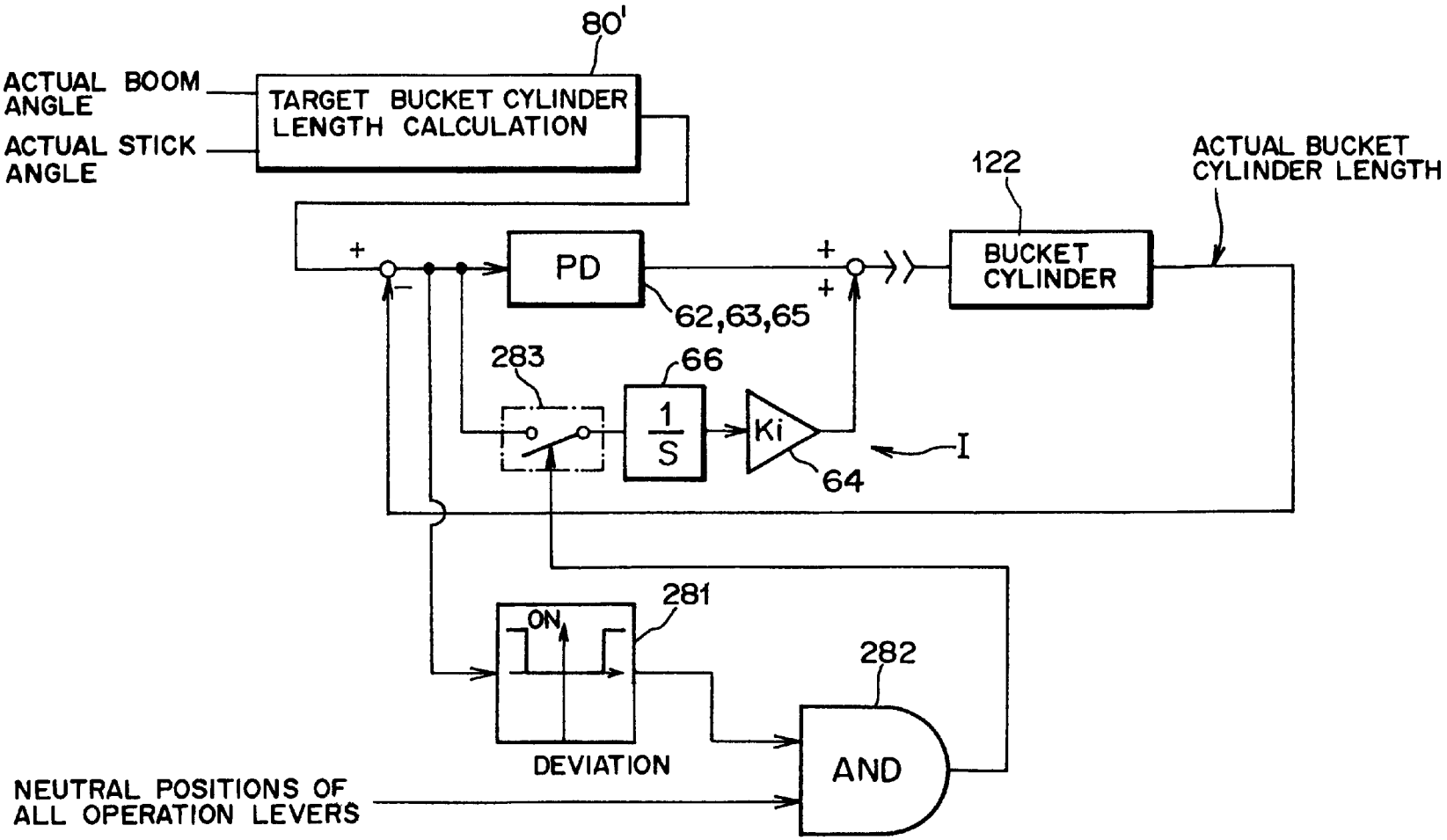
FIG. 34 is a control block diagram of essential part according to an eighth embodiment of the present invention.
Figure 35:
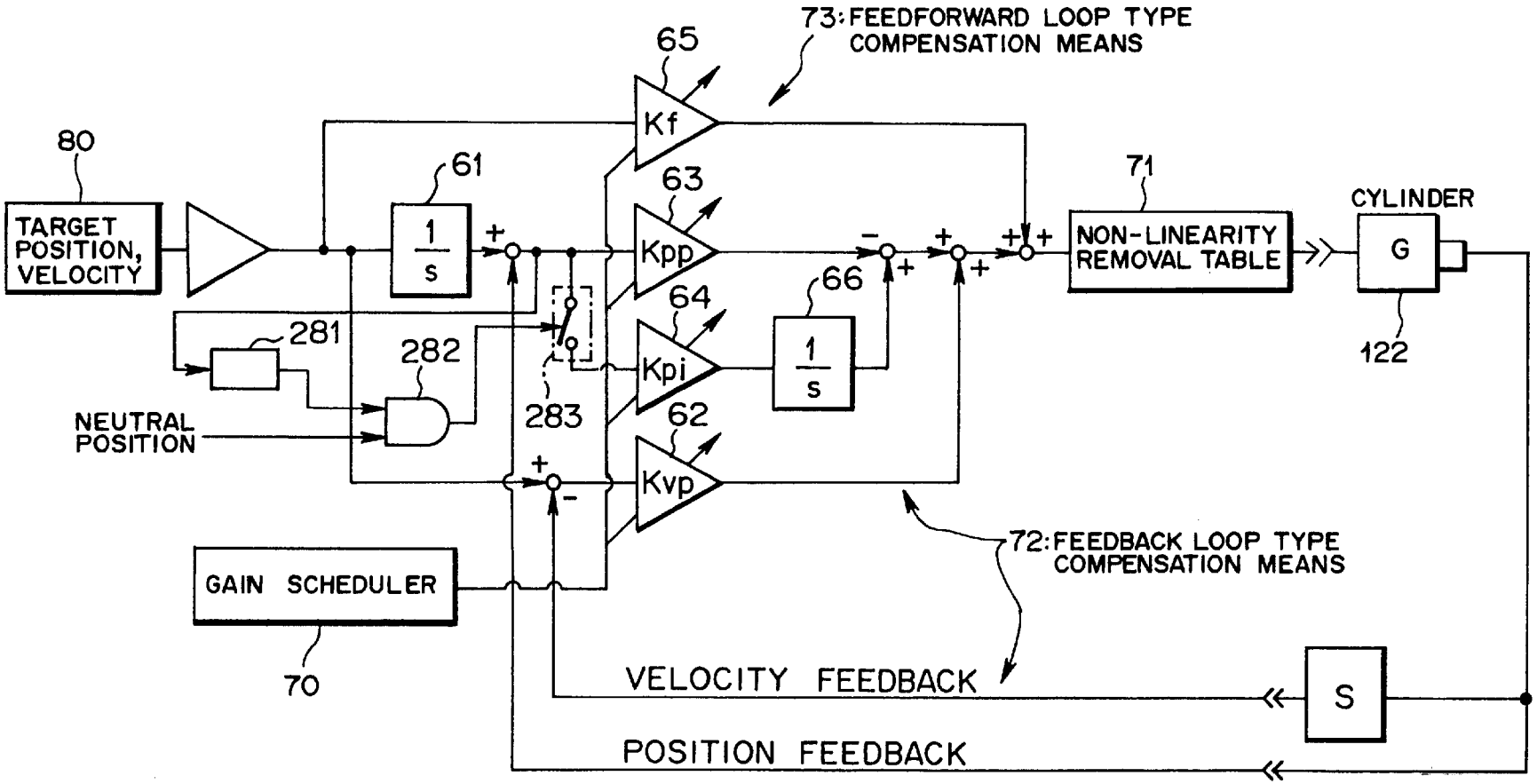
FIG. 35 is a control block diagram of essential part according to the eighth embodiment of the present invention.

However, in the present embodiment, in order to prevent an overshoot of the bucket 400 particularly in the bucket angle control mode, the control section 1C which is a bucket controlling system is constructed such that, as shown in FIGS. 34 and 35, the target cylinder velocity setting section 80 is formed as target bucket cylinder length calculation means 80' and the control section 1C includes control deviation detection means 281, an AND gate (logical AND circuit) 282 and a switch 283. It is to be noted that reference symbols in FIGS. 34 and 35 same as those shown in FIG. 5 are similar to those described hereinabove with reference to FIG. 5.

Here, the target bucket cylinder length calculation means 80' determines a target length (control target value) of the bucket cylinder 122 by predetermined calculation from an actual boom angle θbm' (refer to FIG. 36) and an actual stick angle θst' (refer to FIG. 36), and in the present control section 1C, PID feedback control is performed based on a value (velocity information) obtained by differentiation of a control target value obtained by the calculation means 80' by differentiation.

In particular, in the present target bucket cylinder length calculation means 80', a target bucket cylinder length is calculated using calculation expressions (3-1) to (3-7) given below. It is to be noted that, in the following description, $L_{i/j}$ represents a fixed length, $R_{i/j}$ a variable length, $A_{i/j/k}$ a fixed angle, and $\theta_{i/j/k}$ represents a variable angle, the suffix i/j to L represents the length between nodes i and j, the suffix i/j/k to A and θ represents to connect the nodes i, j and k in order of i→j→k. Accordingly, for example, $L_{101/102}$ represents the distance between the node 101 and the node 102, and $\theta_{103/104/105}$ represents the angle defined when the nodes 103 to 105 are connected in order of the node 103→node 104→node 105.

Figure 36:
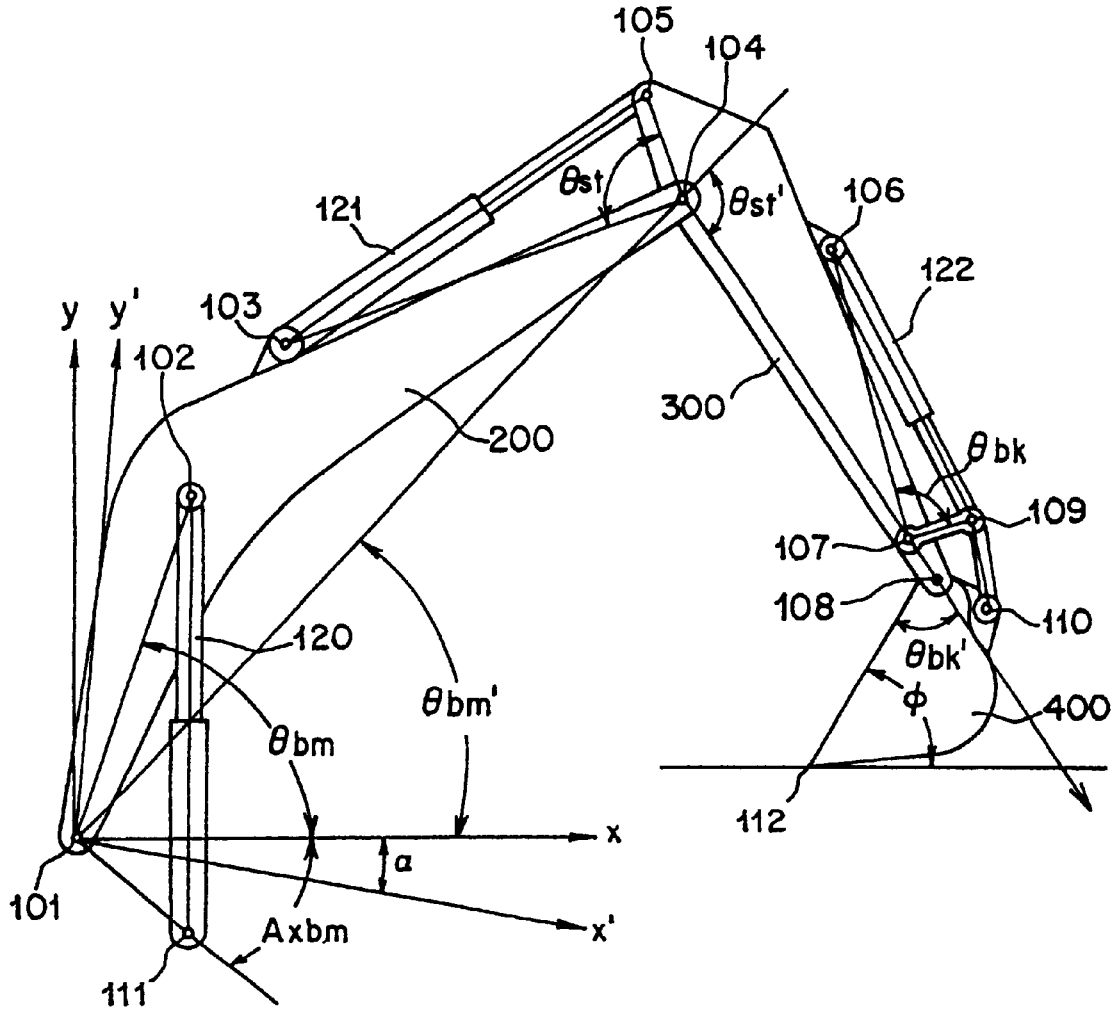
FIG. 36 is a schematic view of operating parts of a hydraulic excavator to which the eighth embodiment of the present invention is applied.

Further, here, the node 101 is assumed to be the origin of the xy coordinate system as shown in FIG. 36, and the angle (boom angle) defined by a straight line interconnecting the origin and the node 104 and the x axis is represented by θbm', the angle (stick angle) defined by the straight line interconnecting the origin and the node 104 and another straight line interconnecting the nodes 104 and 107 is represented by θst', and the angle defined by the straight line interconnecting the nodes 104 and 107 and the bucket 400 is represented by θbk'. However, the angles shown in FIG. 36 are represented as positive angles when taken in the counterclockwise direction, and therefore, both of the angles θst' and θbk' assume negative values.

First, the target bucket cylinder length ($R_{106/109}$) is represented in the following manner in accordance with the cosine theorem:

$$R_{106/109}=(L_{106/107}^2+L_{107/109}^2-2L_{106/107}\cdot L_{107/109}\cdot\cos 2\pi-A_{104/107/106}-A_{104/107/108}-\theta_{109/107/108})^{1/2} \quad (3\text{-}1)$$

Here, $\theta_{109/107/108}$ in the present expression (3-1) is represented as $$\theta_{109/107/108}=\theta_{109/107/110}+\theta_{108/107/110} \quad (3\text{-}2)$$

Further, $\theta_{109/107/110}$ and $\theta_{108/107/110}$ in the present expression (3-2) can be represented, in accordance with the cosine theorem, as $$\theta_{109/107/108}=\cos^{-1}[(L_{107/109}^2+R_{107/110}^2-L_{109/110}^2)/2L_{107/109}\cdot R_{107/110}] \quad (3\text{-}3)$$

$$\theta_{108/107/110}=\cos^{-1}[(L_{107/108}^2+R_{107/110}^2-L_{108/110}^2)/2L_{107/108}\cdot R_{107/110}] \quad (3\text{-}4)$$

Here, since $L_{107/108}$, $L_{107/109}$, $L_{108/110}$, and $L_{109/110}$ in the expressions (3-3) and (3-4) are all known fixed values, the target bucket cylinder length $R_{106/109}$ can be determined by determining $R_{107/110}$, substituting the expressions (3-3) and (3-4) into the expression (3-2) and further substituting the expression (3-2) into the expression (3-1). $R_{107/110}$ can be represented, in accordance with the cosine theorem, as $$R_{107/110}=(L_{107/108}^2+L_{108/110}^2-2L_{107/108}\cdot L_{108/110}\cdot\cos\theta_{107/108/110})^{1/2} \quad (3\text{-}5)$$

Further, $\theta_{107/108/110}$ in the present expression (3-5) can be represented as $$\theta_{107/108/110}=\pi-A_{104/108/107}-A_{110/108/115}-\theta bk' \quad (3\text{-}6)$$

Then, θbk' in the present expression (3-6) can be represented as a function of the bucket angle φ (control target value), the actual boom angle θbm' and the stick angle θst' in the following manner.

$$\theta bk'=\phi-\pi-\theta bm'-\theta st' \quad (3\text{-}7)$$

Accordingly, if the actual boom angle θbm' and stick angle θst' are obtained by the resolvers 20 and 21, then $R_{107/110}$ given above can be determined by substituting the expression (3-7) given above into the expression (3-6) and then substituting the expression (3-6) into the expression (3-5), and $R_{107/110}$ given above can be determined by substituting the expression (3-6) given above into the expression (3-5), and finally, the target bucket cylinder length $R_{106/109}$ can be determined in accordance with the expressions (3-1) through (3-4).

It is to be noted that, while here the target bucket cylinder length $R_{106/109}$ is determined from the actual boom angle θbm' and stick angle θst' as described above, the target bucket cylinder length $R_{106/109}$ may be determined from, for example, the length of the boom cylinder 120 and the length of the stick cylinder 121.

Then, referring to FIGS. 34 and 35, the control deviation detection means 281 detects whether or not the control deviation of the feedback controlling system is higher than a predetermined value, and the AND gate 282 logically ANDs an output of the control deviation detection means 281 and a signal when all of the operation levers 6 and 8 are at their neutral positions (inoperative positions) so that it outputs an H pulse when all of the operation levers 6 and 8 are at their neutral positions and the control deviation described above is higher than the predetermined value (this is determined as a first condition).

Then, the switch 283 exhibits an ON state when an H pulse is outputted from the AND gate 282 described above, and when the switch 283 is in an ON state, the feedback control route of the gain Kpi described hereinabove is added to the feedback control route of the gain Kvp and the feedback route of the gain Kpp described hereinabove.

In short, the present control section 1C includes a first controlling system (first control means) for performing PID feedback control by the routes (proportion operation factor P, differentiation operation factor D and integration operation factor I) of the gain Kpp, the gain Kvp and the gain Kpi when the first condition described above is satisfied, and a second controlling system (second control means) for performing PD feedback control while feedback control by the route of Kpi (integration operation factor I) is inhibited when the first condition described above is not satisfied.

Since the control apparatus for a construction machine as the eighth embodiment of the present invention is constructed in such a manner as described above, upon semi-automatic control, the moving velocity and direction of the bucket tip 112 are first determined from information of a target slope face set angle, pilot hydraulic pressures which control the stick cylinder 121 and the boom cylinder 120, a vehicle inclination angle and an engine rotational speed, and target velocities of the cylinders 120, 121 and 122 are calculated based on the information. It is to be noted that the information of the engine rotational speed in this instance is required to determine an upper limit to the cylinder velocities.

In this instance, in the present embodiment, when all of the operation levers 6 and 8 are at their neutral positions and the first condition that the control deviation described above is higher than the predetermined value is satisfied, the switch 83 in the control section 1C is put into an ON state and PID feedback control (feedback control by the first control system described above) is performed, but when the first condition is not satisfied, the switch 83 exhibits an OFF state and feedback control by the integration operation factor is inhibited while PD feedback control (feedback control by the second control system described above) is performed.

Consequently, since feedback control by the integration operation factor is inhibited while the operation levers 6 and 8 are in their operative positions (in short, while the bucket angle $\phi$ varies), for example, when the control deviation of the bucket cylinder 122 from its target velocity becomes large, such a large variation of the target velocity that the target velocity of the bucket cylinder 122 becomes large by the integration operation factor in order to decrease the control deviation can be suppressed.

Accordingly, when the operation levers 6 and 8 are moved to their neutral positions form a condition wherein they are in operative positions (when the bucket angle $\phi$ is to be kept at a desired angle), where there is a control deviation (when the control deviation is larger than the predetermined value), the switch 283 is switched ON to add feedback control by the integration operation factor I to PD feedback control to effect PID feedback control as described above. Consequently, the control deviation which has not successfully been reduced fully to zero by PD feedback control can be reduced quickly toward zero to control the extension/contraction displacement of the bucket cylinder 122 (in short, the posture of the bucket 400) to a desired target value (bucket angle) rapidly and stop the bucket cylinder 122.

As described above, in the system according to the present embodiment, when the operation levers 6 and 8 are in their neutral positions (when the bucket 400 is to be stopped) and the control deviation is higher than the predetermined value, the control section 1C adds feedback control by the integration operation factor I to PD feedback control to effect PID feedback control, the control deviation which has not successfully been reduced fully to zero only by PD feedback control can be reduced toward zero very rapidly to control the bucket 400 to a desired posture quickly and accurately, and the bucket 400 can be controlled with a very high degree of accuracy while preventing an overshoot or the like of the bucket 400 with certainty.

Further, in the present embodiment, since posture information of the bucket 400 is detected as extension/contraction displacement information of the cylinder 122 by the resolver 22 and the signal converter 26, accurate posture information of the bucket 400 can be detected with a simple and convenient construction.

It is to be noted that, while, in the embodiment described above, the construction shown in FIGS. 34 and 35 is applied to the bucket controlling system, similar operations and effects to those described above can be anticipated also where it is applied to the boom controlling system (control section 1A) or the stick controlling system (control section 1B).

(9) Others

The control apparatus for a construction machine of the present invention is not limited to the various embodiments described above, and can be varied in various forms without departing from the spirit of the present invention.

For example, while, in the embodiments described above, the present invention is described as being applied to a hydraulic excavator, the present invention is not limited to this, and can be applied similarly to any of construction machines such as a tractor, a loader and a bulldozer only if it has a joint type arm mechanism which is driven by cylinder type actuators.

Further, while, in the embodiments described above, a fluid pressure circuit which is operated by cylinder type actuators is described as being a hydraulic circuit, the present invention is not limited to this, and a fluid pressure circuit which employs a pressure of fluid other than operating oil or a pneumatic pressure may be used. Also in this instance, similar operations and effects to those of the embodiments described above can be achieved.

Furthermore, while, in the embodiments described above, the pumps 51 and 52 interposed in the hydraulic circuits are described as being of the variable discharge type, the pumps interposed in the hydraulic circuits may be of the fixed discharge type (fixed capacity type), and also in this instance, similar operations and effects to those of the embodiments described above can be achieved.

Industrial Applicability of the Invention

Where the present invention is applied to a construction machine such as a hydraulic excavator which has a semi-automatic control mode, further augmentation of functions can be achieved. Further, the present invention can contributes to augmentation of the working performance and the operability of a construction machine of the type mentioned, and the utility of the present invention is considered to be very high.

We claim:

1. A control apparatus for a construction machine wherein arm members are supported for rocking movement on a construction machine body side and a working member is supported for rocking movement at an end portion of said arm members and the rocking movements of said arm members and said working member are performed individually by extension/contraction operations of cylinder actuators comprising:

operation members for operating said arm members and said working member;

target moving velocity setting means for setting a target moving velocity of said working member so that a target moving velocity characteristic upon starting of operation by said operation members exhibit a characteristic of the same type even if the target moving velocity characteristic is time differentiated; and control means for receiving information of the target moving velocity set by said target moving velocity setting means as an input and controlling said actuators so that said working member exhibits the target moving velocity.

2. The control apparatus for a construction machine as set forth in claim 1, wherein the target moving velocity characteristic upon starting of the operation is set to a cosine wave characteristic.

3. The control apparatus for a construction machine as set forth in claim 1, wherein the target moving velocity is set by said target moving velocity setting means so that the target moving velocity characteristic upon ending of the operation by said working member exhibits a characteristic of the same type even if the target moving velocity characteristic is time differentiated.

4. The control apparatus for a construction machine as set forth in claim 3, wherein the target moving velocity characteristic upon ending of the operation is set to a cosine wave characteristic.

5. The control apparatus for a construction machine as set forth in claim 1, wherein said target moving velocity setting means includes:

a target moving velocity outputting section for outputting first target moving velocity data corresponding to positions of said operation members;

a storage section storing second target moving velocity data whose characteristics upon starting of the operation and upon ending of the operation exhibit characteristics of the same types even if the target moving velocity characteristics are time differentiated are stored; and a comparison section for comparing the data of said storage section and the data of said target moving velocity outputting section and outputting a lower data as target moving velocity information.

6. A control apparatus for a construction machine wherein arm members are supported for rocking movement on a construction machine body side and a working member is supported for rocking movement at an end portion of said arm members and the rocking movements of said arm members and said working member are performed individually by extension/contraction operations of cylinder actuators comprising:

target value setting means for setting target operation information of said arm member with said working member in response to a position of an operation member;

detection means having at least operation information detection means for detecting operation information of said arm member with said working member and operation condition detection means for detecting an operation condition of said construction machine;

control means of a variable control parameter type for receiving a detection result from said operation information detection means and the target operation information set by said target value setting means as inputs and controlling said actuators so that said arm member with said working member exhibits a target operation condition; and said control means includes a control parameter scheduler which is capable of varying the control parameter in response to the operation condition of said construction machine detected by said operation condition detection means.

7. The control apparatus for a construction machine as set forth in claim 6, wherein said control means includes feedback loop compensation means having a variable control parameter and feedforward compensation means having a variable control parameter.

8. The control apparatus for a construction machine as set forth in claim 6, wherein said control parameter scheduler is constructed so as to allow the control parameter to be varied in response to positions of said actuators.

9. The control apparatus for a construction machine as set forth in claim 6, wherein said control parameter scheduler is constructed so as to allow the control parameter to be varied in response to loads to said actuators.

10. The control apparatus for a construction machine as set forth in claim 6, wherein said control parameter scheduler is constructed so as to allow the control parameter to be varied in response to a temperature relating to said actuators.

11. The control apparatus for a construction machine as set forth in claim 10, wherein the temperature relating to said actuators is a temperature of operating oil or a temperature of controlling oil of said actuators.

12. A control apparatus for a construction machine wherein, when a pair of arm members including first and second arm members connected for pivotal motion to each other and consisting a joint arm mechanism provided on a construction machine body are driven by cylinder actuators, said cylinder actuators are feedback controlled based on detected posture information of said arm members so that said arm members individually assume predetermined postures, wherein said pair of arm members are controlled in a mutually associated relationship with each other such that a control target value of a controlling system of said first arm member is corrected based on the feedback deviation information of a controlling system of the second arm member, and a control target value of a controlling system of said second arm member is corrected based on the feedback deviation information of a controlling system of the first arm member.

13. A control apparatus for a construction machine, comprising:

a construction machine body;

a joint arm mechanism having at least one pair of arm members having one end portion pivotally mounted on said construction machine body and having a working member on the other end side and connected to each other by a joint part;

a cylinder actuator mechanism having a plurality of cylinder actuators for performing extension/contraction operations to actuate said arm mechanism;

posture detection means for detecting posture information of said arm members; and control means for controlling said cylinder actuators based on a detection result detected by said posture detection means so that said arm members exhibit predetermined postures;

said control means including:

a first controlling system for feedback controlling the first cylinder actuator for one arm member of said pair of arm members;

a second controlling system for feedback controlling the second cylinder actuator for the other arm member of said pair of arm members;

a first correction controlling system for correcting a control target value of said first controlling system based on feedback deviation information of said second controlling system; and a second correction controlling system for correcting a control target value of said second controlling system based on feedback deviation information of said first correction controlling system.

14. The control apparatus for a construction machine as set forth in claim 13, wherein said posture detection means is constructed as extension/contraction displacement detection means for detecting extension/contraction displacement information of said cylinder actuators.

15. The control apparatus for a construction machine as set forth in claim 13, wherein said first correction controlling system includes a first correction value generation section for generating a first correction value for correcting the control target value of said first controlling system from the feedback deviation information of said second controlling system, and said second correction controlling system includes a second correction value generation section for generating a second correction value for correcting the control target value of said second controlling system from the feedback deviation information of said first controlling system.

16. The control apparatus for a construction machine as set forth in claim 15, wherein said first correction controlling system includes a first weight coefficient addition section for adding a first weight coefficient to the first correction value.

17. The control apparatus for a construction machine as set forth in claim 15, wherein said second correction controlling system includes a second weight coefficient addition section for adding a second weight coefficient to the second correction value.

18. A control apparatus for a construction machine, comprising:

a construction machine body;

a boom connected at one end thereof for pivotal motion to said construction machine body;

a stick connected at one end thereof for pivotal motion to said boom by a joint part and having a working member, which is capable of excavating the ground at a tip thereof and accommodating sand and earth therein, mounted for pivotal motion at the other end thereof;

a boom hydraulic cylinder interposed between said construction machine body and said boom for pivoting said boom with respect to said construction machine body by expanding or contracting a distance between end portions thereof;

a stick hydraulic cylinder interposed between said boom and said stick for pivoting said stick with respect to said boom by expanding or contracting a distance between end portions thereof;

boom posture detection means for detecting posture information of said boom;

stick posture detection means for detecting posture information of said stick;

a boom controlling system for feedback controlling said boom hydraulic cylinder based on a detection result of said boom posture detection means;

a stick controlling system for feedback controlling said stick hydraulic cylinder based on a detection result of said stick posture detection means;

a boom correction controlling system for correcting a control target value of said boom controlling system based on feedback deviation information of said stick controlling system; and a stick correction controlling system for correcting a control target value of said stick controlling system based on feedback deviation information of said boom controlling system.

19. The control apparatus for a construction machine as set forth in claim 18, wherein said boom posture detection means is constructed as boom hydraulic cylinder extension/contraction displacement detection means for detecting extension/contraction displacement information of said boom hydraulic cylinder, and said stick posture detection means is constructed as stick hydraulic cylinder extension/contraction displacement detection means for detecting extension/contraction displacement information of said stick hydraulic cylinder.

20. The control apparatus for a construction machine as set forth in claim 18, wherein said boom correction controlling system includes a boom correction value generation section for generating a boom correction value for correcting the control target value of said boom controlling system from the feedback deviation information of said stick controlling system, and said stick correction controlling system includes a stick correction value generation section for generating a stick correction value for correcting the control target value of said stick controlling system from the feedback deviation information of said boom controlling system.

21. The control apparatus for a construction machine as set forth in claim 20, wherein said stick correction controlling system includes a stick weight coefficient addition section for adding a stick weight coefficient to the stick correction value.

22. The control apparatus for a construction machine as set forth in claim 18, wherein said boom correction controlling system includes a boom weight coefficient addition section for adding a boom weight coefficient to the boom correction value.

23. A control apparatus for a construction machine wherein, when a pair of arm members including first and second arm members connected for pivotal motion to each other and consisting a joint arm mechanism provided on a construction machine body are actuated by cylinder actuators, said cylinder actuators are controlled based on a calculation control target value obtained from operation position information of operation members so that said arm members assume predetermined postures, wherein, an actual control target value of a controlling system of said first arm member is determined based on the actual posture information of the first arm member and the second arm member and an actual control target value of a controlling system of said second arm member is determined based on the actual posture information of the second arm member and the first arm member, and a composite control target value is determined based on the actual control target value and the calculation control target value, and said cylinder actuator is controlled based on the composite control target value so that one arm member among said pair of arm members assume a predetermined posture, and fluid pressure circuits for said cylinder actuators are open center circuits with which extension/contraction displacement velocities of said cylinder actuators depend upon a load which acts upon said cylinder actuators.

24. A control apparatus for a construction machine, comprising a construction machine body;

a joint arm mechanism includes at least one pair of arm members connected end to end by a joint part and having one end portion pivotally mounted on said construction machine body and other end connected to a working member;

a cylinder actuator mechanism having a plurality of cylinder actuators for actuating said arm mechanism by performing extension/contraction operations;

calculation control target value setting means for determining a calculation target control value based on operation position information of operation members; and control means for controlling said cylinder actuators based on the calculation control target value obtained by said calculation control target value setting means so that said arm members individually assume predetermined postures;

said control means including:

actual control target value calculation means for determining an actual control target value for a controlling system of an arm member among said pair of arm members based on the actual posture information of the arm member and other arm member;

composite control target value calculation means for determining a composite control target value based on the actual control target value obtained by said actual control target value calculation means and the calculation control target value obtained by said calculation control target value setting means; and a controlling system for controlling said cylinder actuator based on the composite control target value obtained by said composite control target value calculation means so that the arm member assumes a predetermined posture.

25. The control apparatus for a construction machine as set forth in claim 24, wherein said controlling system is constructed so as to feedback control said cylinder actuators based on the composite control target value obtained by said composite control target value calculation means and the posture information of said arm members detected by said arm member posture detection means so that said arm members individually assume predetermined postures.

26. The control apparatus for a construction machine as set forth in claim 25, wherein said arm member posture detection means is constructed as extension/contraction displacement detection means for detecting extension/contraction displacement information of said cylinder actuators.

27. The control apparatus for a construction machine as set forth in claim 24, wherein composite control target value calculation means is constructed so as to add predetermined weight information to the actual control target value and the calculation control target value to determine the composite control target value.

28. The control apparatus for a construction machine as set forth in claim 24, wherein fluid pressure circuits for said cylinder actuators are open center circuits with which extension/contraction displacement velocities of said cylinder actuators depend upon a load acting upon said cylinder actuators.

29. A control apparatus for a construction machine, comprising:

a construction machine body;

a boom connected at one end thereof for pivotal motion to said construction machine body;

a stick connected at one end thereof for pivotal motion to said boom by a joint part and having a bucket, which is capable of excavating the ground at a tip thereof and accommodating sand and earth therein, mounted for pivotal motion at the other end thereof;

a boom hydraulic cylinder interposed between said construction machine body and said boom for pivoting said boom with respect to said construction machine body by expanding or contracting a distance between end portions thereof;

a stick hydraulic cylinder interposed between said boom and said stick for pivoting said stick with respect to said boom by expanding or contracting a distance between end portions thereof;

stick control target value setting means for determining a stick control target value for stick control based on operation position information of an arm mechanism operation member;

a stick controlling system for controlling said stick hydraulic cylinder based on the stick control target value obtained by said stick control target value setting means;

boom control target value setting means for determining a boom control target value for boom control based on operation position information of said arm mechanism operation member;

actual boom control target value calculation means for determining an actual boom control target value for boom control based on actual posture information of said boom and said stick;

composite boom control target value calculation means for determining a composite boom control target value based on the actual boom control target value obtained by said actual boom control target value calculation means, and the boom control target value obtained by said boom control target value setting means; and a boom controlling system for controlling said boom hydraulic cylinder based on the composite boom control target value obtained by said composite boom control target value calculation means so that said boom assumes a predetermined posture.

30. The control apparatus for a construction machine as set forth in claim 29, wherein said stick controlling system is constructed so as to feedback control said stick hydraulic cylinder based on the stick control target value and the posture information of said stick detected by said stick posture detection means, and said boom controlling system is constructed so as to feedback control said boom hydraulic cylinder based on the composite boom control target value and the posture information of said boom detected by said boom posture detection means so that said boom assumes a predetermined posture.

31. The control apparatus for a construction machine as set forth in claim 30, wherein said stick posture detection means is constructed as extension/contraction displacement detection means for detecting extension/contraction displacement information of said stick hydraulic cylinder, and said boom posture detection means is constructed as extension/contraction displacement detection means for detecting extension/contraction displacement information of said boom hydraulic cylinder.

32. The control apparatus for a construction machine as set forth in claim 29, wherein said actual boom control target value calculation means includes an actual bucket tip position calculation section for calculating tip position information of said bucket from the actual posture information of said boom and said stick, and an actual boom control target value calculation section for determining the actual boom control target value based on the tip position information of said bucket obtained by said actual bucket tip position calculation section.

33. The control apparatus for a construction machine as set forth in claim 32, wherein said composite boom control target value calculation means is constructed so as to add predetermined weight information to the actual boom control target value and the boom control target value to determine the composite boom control target value.

34. The control apparatus for a construction machine as set forth in claim 33, wherein the weight information added by said composite boom control target value calculation means is set so as to assume a value higher than 0 but lower than 1.

35. The control apparatus for a construction machine as set forth in claim 33, wherein said composite boom control target value calculation means is constructed so as to add a first weight coefficient to the boom control target value and add a second weight coefficient to the actual boom control target value to determine the composite boom control target value.

36. The control apparatus for a construction machine as set forth in claim 35, wherein the first weight coefficient and the second weight coefficient added by said composite boom control target value calculation means are set so as to both assume values higher than 0 but lower than 1.

37. The control apparatus for a construction machine as set forth in claim 36, wherein the first weight coefficient added by said composite boom control target value calculation means is set so as to decrease as an extension amount of said stick hydraulic cylinder increases.

38. The control apparatus for a construction machine as set forth in claim 35, wherein the first weight coefficient and the second weight coefficient are set so that the sum thereof is 1.

39. The control apparatus for a construction machine as set forth in claim 38, wherein the first weight coefficient added by said composite boom control target value calculation means is set so as to decrease as an extension amount of said stick hydraulic cylinder increases.

40. The control apparatus for a construction machine as set forth in claim 29, wherein fluid pressure circuits for said boom hydraulic cylinder 120 and stick hydraulic cylinder are open center circuits with which extension/contraction displacement velocities of said cylinders depend upon a load acting upon said cylinders.

41. A control apparatus for a construction machine wherein, when a joint arm mechanism provided on a construction machine body is actuated by cylinder actuators which are connected to fluid pressure circuits having at least pumps driven by a prime mover and control valve mechanism and operate with delivery pressures from said pumps, control signals are supplied to said control valve mechanism based on detected posture information of said joint arm mechanism to control said cylinder actuators so that said joint arm mechanism assumes a predetermined posture, wherein, if a delivery capacity variation factor of said pumps in said prime mover is detected, then the control signals are corrected in response to the delivery capacity variation factor.

42. A control apparatus for a construction machine, comprising:

a construction machine body;

a joint arm mechanism having at least one pair of arm members having one end portion pivotally mounted on said construction machine body and having a working member on the other end side and connected to each other by a joint part;

a cylinder actuator mechanism having a plurality of cylinder actuators for actuating said arm mechanism by performing extension/contraction operations;

fluid pressure circuits at least having pumps driven by a prime mover and control valve mechanism for supplying and discharging operating fluid to and from said cylinder actuator mechanism to cause said cylinder actuators of said cylinder actuator mechanism to effect extension/contraction operations;

posture detection means for detecting posture information of said arm members;

control means for supplying control signals to said control valve mechanism based on a detection result detected by said posture detection means to control said cylinder actuators so that said arm members individually assume predetermined postures; and variation factor detection means for detecting a delivery capacity variation factor of said pumps in said prime mover;

said control means including:

correction means for correcting, when a delivery capacity variation factor of said pumps is detected by said variation factor detection means, the control signals in response to the delivery capacity variation factor.

43. The control apparatus for a construction machine as set forth in claim 42, wherein said prime mover is constructed as a rotational output prime mover, and said variation factor detection means is constructed as means for detecting rotational speed information of said prime mover, and besides said correction means corrects, when it is detected by said variation factor detection means that the rotational speed information of said prime mover has varied, the control signals in response to the variation.

44. The control apparatus for a construction machine as set forth in claim 43, wherein said correction means includes reference rotational speed setting means for setting reference rotational speed information of said prime mover;

deviation calculation means for calculating a deviation between the reference rotational speed information set by said reference rotational speed setting means and actual rotational speed information of said prime mover detected by said variation factor detection means; and correction information calculation means for calculating correction information for correcting the control signals in response to the deviation obtained by said deviation calculation means.

45. The control apparatus for a construction machine as set forth in claim 44, wherein said correction information calculation means includes storage means for storing correction information for correcting the control signals in response to the deviation obtained by said deviation calculation means.

46. A control apparatus for a construction machine wherein, when arm members which compose a joint arm mechanism provided on a construction machine body are actuated by cylinder actuators whose extension/contraction displacement velocities vary in response to a load thereto, said cylinder actuators are controlled based on a control target value so that said joint arm mechanism assumes a predetermined posture, wherein said control apparatus is constructed so as to reduce, when the load to said cylinder actuators is higher than a predetermined value, the control target value to reduce the extension/contraction displacement velocities of said cylinder actuators.

47. The control apparatus for a construction machine as set forth in claim 46, wherein fluid pressure circuits for said cylinder actuators are open center circuits with which extension/contraction displacement velocities of said cylinder actuators depend upon a load acting upon said cylinder actuators.

48. A control apparatus for a construction machine, comprising:

a construction machine body;

a joint arm mechanism includes at least one pair of arm members connected end to end by a joint part and having one end portion pivotally mounted on said construction machine body and other end connected to a working member;

a cylinder actuator mechanism having a plurality of cylinder actuators for actuating said arm mechanism by effecting extension/contraction operations such that extension/contraction displacement velocities vary depending upon a load;

control target value setting means for calculating a control target value from operation position information of operation members;

control means for controlling said cylinder actuators based on the control target value obtained by said target value setting means so that said arm members individually assume predetermined postures; and actuator load detection means for detecting load conditions to said cylinder actuators;

said control means having:

first correction means for reducing, when the load to said cylinder actuators detected by said actuator load detection means is higher than a predetermined value, the control target value set by said target value setting means in response to the load condition of said cylinder actuators to lower the extension/contraction displacement velocity by said cylinder actuators.

49. The control apparatus for a construction machine as set forth in claim 48, wherein said controlling apparatus comprises posture detection means for detecting the posture information of said arm members, and said control means feedback controls said cylinder actuators based on the control target value obtained by said target value setting means and the posture information of said arm members detected by said posture detection means so that said arm members individually assume predetermined postures.

50. The control apparatus for a construction machine as set forth in claim 49, wherein said arm member posture detection means is constructed as extension/contraction displacement detection means for detecting extension/contraction displacement information of said cylinder actuators.

51. The control apparatus for a construction machine as set forth in claim 49, wherein said control means is constructed as means for controlling said cylinder actuators by feedback controlling systems which at least have a proportion operation factor and an integration operation factor so that said arm members individually assume predetermined postures, and has second correction means for regulating, when the load to said actuators detected by said actuator load detection means is higher than the predetermined value, feedback control by the integration operation factor in response to the load conditions of said cylinder actuators.

52. The control apparatus for a construction machine as set forth in claim 51, wherein said second correction means is constructed so as to increase the regulation amount of the feedback control by the integration operation factor as the load to said cylinder actuators increases.

53. The control apparatus for a construction machine as set forth in claim 48, wherein said first correction means is constructed so as to increase a reduction amount of the control target value to reduce the extension/contraction displacement velocity by said cylinder actuators as the load to said actuators increases.

54. The control apparatus for a construction machine as set forth in claim 48, wherein said control means includes third correction means for increasing, under a transition condition wherein the load to said cylinder actuators detected by said actuator load detection means changes from a condition wherein the load is higher than the predetermined value to another condition wherein the load is lower than the predetermined value, the extension/contraction displacement velocities by said cylinder actuators based on a result obtained through integration means which moderates a variation of a detection result obtained by said actuator load detection means.

55. The control apparatus for a construction machine as set forth in claim 54, wherein said integration means is a low-pass filter.

56. The control apparatus for a construction machine as set forth in claim 48, wherein fluid pressure circuits for said cylinder actuators are open center circuits with which extension/contraction displacement velocities of said cylinder actuators depend upon a load acting upon said cylinder actuators.

57. A control apparatus for a construction machine, comprising:

a construction machine body;

a boom connected at one end thereof for pivotal motion to said construction machine body;

a stick connected at one end thereof for pivotal motion to said boom by a joint part and having a bucket, which is capable of excavating the ground at a tip thereof and accommodating sand and earth therein, mounted for pivotal motion at the other end thereof;

a boom hydraulic cylinder interposed between said construction machine body and said boom for pivoting said boom with respect to said construction machine body by expanding or contracting a distance between end portions thereof;

a stick hydraulic cylinder interposed between said boom and said stick for pivoting said stick with respect to said boom by expanding or contracting a distance between end portions thereof;

control target value setting means for determining a control target value based on operation position information of operation members;

control means for controlling said boom hydraulic cylinder and said stick hydraulic cylinder based on the control target value obtained by said control target value setting means so that said bucket moves at a predetermined moving velocity; and hydraulic cylinder load detection means for detecting a load condition of said boom hydraulic cylinder or said stick hydraulic cylinder; and said control means includes fourth correction means for reducing, when any of the cylinder loads detected by said hydraulic cylinder load detection means is higher than a predetermined value, the control target value set by said target value setting means in response to the cylinder load condition to reduce the bucket moving velocity by said boom hydraulic cylinder and said stick hydraulic cylinder.

58. The control apparatus for a construction machine as set forth in claim 57, comprising boom posture detection means for detecting posture information of said boom, and stick posture detection means for detecting posture information of said stick, and said control means is constructed so as to feedback control said boom hydraulic cylinder and said stick hydraulic cylinder based on the control target value obtained by said control target value setting means and the posture information of said boom and said stick detected by said boom posture detection means and said stick posture detection means so that said bucket moves at a predetermined moving velocity.

59. The control apparatus for a construction machine as set forth in claim 58, wherein said stick posture detection means is constructed as extension/contraction displacement detection means for detecting extension/contraction displacement information of said stick hydraulic cylinder, and said boom posture detection means is constructed as extension/contraction displacement detection means for detecting extension/contraction displacement information of said boom hydraulic cylinder.

60. The control apparatus for a construction machine as set forth in claim 58, wherein said control means is constructed as means for controlling said boom hydraulic cylinder and said stick hydraulic cylinder based on the control target value by feedback controlling systems which have at least a proportion operation factor and an integration operation factor so that said bucket moves at the predetermined moving velocity, and includes fifth correction means for regulating, when the cylinder load detected by said hydraulic cylinder load detection means is higher than a predetermined value, the feedback control by the integration operation factor in response to the cylinder load condition.

61. The control apparatus for a construction machine as set forth in claim 60, wherein said fifth correction means is constructed so as to increase the regulation amount of the feedback control by the integration operation factor as the cylinder load increases.

62. The control apparatus for a construction machine as set forth in claim 57, wherein said fourth correction means is constructed so as to increase the reduction amount of the control target value to reduce the bucket moving velocity as the cylinder load increases.

63. The control apparatus for a construction machine as set forth in claim 57, wherein said control means includes sixth correction means for increasing, under a transition condition wherein any of the cylinder loads detected by said hydraulic cylinder load detection means changes from a condition wherein the load is higher than the predetermined value to another condition wherein the load is lower than the predetermined value, the bucket moving velocity by said boom hydraulic cylinder and said stick hydraulic cylinder based on a result obtained through integration means which moderates a variation of a detection result obtained by said hydraulic cylinder load detection means.

64. The control apparatus for a construction machine as set forth in claim 63, wherein said integration means is a low-pass filter.

65. The control apparatus for a construction machine as set forth in claim 57, wherein fluid pressure circuits for said boom hydraulic cylinder and said stick hydraulic cylinder are open center circuits with which extension/contraction displacement velocities of said boom hydraulic cylinder and said stick hydraulic cylinder depend upon a load acting upon said boom hydraulic cylinder and said stick hydraulic cylinder.

66. A control apparatus for a construction machine wherein, when a working member mounted for pivotal motion at an end of a joint arm mechanism provided on a construction machine body is actuated by cylinder actuators, said cylinder actuators are controlled based on a control target value determined based on operation position information of operation members by feedback controlling systems which have a proportion operation factor, an integration proportion factor and a differentiation operation factor so that said working member assume a predetermined posture, wherein feedback control by said proportion operation factor, said differentiation operation factor and said integration operation factor is performed when a first condition that the operation positions of said operation members are inoperative positions and control deviations of said feedback controlling systems are higher than a predetermined value is satisfied, but when the first condition is not satisfied, feedback control by the integration operation factor is inhibited and feedback control by the proportion operation factor and the differential operation factor is performed.

67. A control apparatus for a construction machine, comprising:

a construction machine body;

a working member mounted on said construction machine body by a joint arm mechanism;

a cylinder actuator mechanism having cylinder actuators for actuating said working member by performing extension/contraction operations;

control target value setting means for determining a control target value based on operation position information of operation members;

posture detection means for detecting posture information of said working member;

control means for controlling said cylinder actuators based on the control target value obtained by said control target value setting means and the posture information of said working member detected by said posture detection means by feedback controlling systems which have a proportional operation factor, an integration operation factor and a differentiation operation factor so that said working member assumes a predetermined posture;

operation position detection means for detecting whether or not operation positions of said operation members are in inoperative positions; and control deviation detection means for detecting whether or not control deviations of said feedback controlling systems are higher than a predetermined value;

said control means includes:

first control means for performing feedback control by the proportion operation factor, the differentiation operation factor and the integration operation factor when a first condition that the operation positions of said operation members detected by said operation position detection means are the inoperative positions and the control deviations of said feedback controlling systems detected by said control deviation detection means are higher than the predetermined value is satisfied; and second control means for inhibiting feedback control by the integration operation factor and performing feedback control by the proportion operation factor and the differentiation operation factor when the first condition is not satisfied.

68. The control apparatus for a construction machine as set forth in claim 67, wherein said posture detection means is constructed as extension/contraction displacement detection means for detecting extension/contraction displacement information of said cylinder actuators.

69. The control apparatus for a construction machine as set forth in claim 67, wherein said joint arm mechanism is composed of a boom and a stick connected for pivotal motion relative to each other by a joint part, and said working member is constructed as a bucket which is mounted for pivotal motion on said stick and is capable of excavating the ground at a tip thereof and accommodating sand and earth therein.

70. A control apparatus for a construction machine wherein arm members are supported for rocking movement on a construction machine body side and a working member is supported for rocking movement at an end portion of said arm members and the rocking movement of said arm member with said working member is performed individually by extension/contraction operations of cylinder actuators comprising:

target value setting means for setting target operation information of said arm member with said working member in response to a position of an operation member, operation information detection means for detecting operation information of said arm member with said working member;

control means for receiving a detection result of said operation information detection means and the target operation information set by said target value setting means as inputs and controlling said actuators so that said arm member with said working member exhibits a target operation condition;

correction information storage means for storing correction information for correcting the target operation information;

said control means is constructed so as to control said actuators using correction target operation information corrected with the correction information from said correction information storage means so that said arm member with said working member exhibits the target operation condition; and said correction information storage means is constructed so as to cause said arm member with said working member to perform a predetermined operation to collect and store the correction information.

71. A control apparatus for a construction machine wherein arm members are supported for rocking movement on a construction machine body side and a working member is supported for rocking movement at an end portion of said arm members and the rocking movement of said arm member with said working member is performed individually by extension/contraction operations of cylinder actuators comprising:

target value setting means for setting target operation information of said arm member with said working member in response to a position of an operation member, operation information detection means for detecting operation information of said arm member with said working member;

control means for receiving a detection result of said operation information detection means and the target operation information set by said target value setting means as inputs and controlling said actuators so that said arm member with said working member exhibits a target operation condition;

correction information storage means for storing correction information for correcting the target operation information;

said control means is constructed so as to control said actuators using correction target operation information corrected with the correction information from said correction information storage means so that said arm member with said working member exhibits the target operation condition;

said correction information storage means is constructed so as to store correction information which is different for different operation modes of said arm member with said working member; and said control means is constructed so as to control said actuators using the correction target operation information corrected with the correction information obtained in response to an operation mode of said arm member with said working member so that said arm member with said working member exhibits the target operation condition.

* * * * *